US011970865B2

(12) United States Patent
Jasinski

(10) Patent No.: US 11,970,865 B2
(45) Date of Patent: Apr. 30, 2024

(54) MODULAR STAIRCASE SYSTEMS

(71) Applicant: Dexx IP Holdings, LLC, Norfolk, VA (US)

(72) Inventor: Chris Jasinski, Woodstock (CA)

(73) Assignee: CB Interests Inc., Woodstock (CA)

( * ) Notice: Subject to any disclaimer, the term of this patent is extended or adjusted under 35 U.S.C. 154(b) by 0 days.

(21) Appl. No.: 17/292,309

(22) PCT Filed: Nov. 5, 2019

(86) PCT No.: PCT/CA2019/051571

§ 371 (c)(1),
(2) Date: May 7, 2021

(87) PCT Pub. No.: WO2020/093150

PCT Pub. Date: May 14, 2020

(65) Prior Publication Data

US 2021/0396017 A1 Dec. 23, 2021

Related U.S. Application Data

(60) Provisional application No. 62/757,434, filed on Nov. 8, 2018.

(51) Int. Cl.

| | |
|---|---|
| ***E04F 21/26*** | (2006.01) |
| ***E04F 11/035*** | (2006.01) |
| ***E04F 11/09*** | (2006.01) |
| ***E04F 11/104*** | (2006.01) |

(52) U.S. Cl.

CPC ..... *E04F 11/035* (2013.01); *E04F 11/09* (2013.01); *E04F 11/1041* (2013.01); *E04F 21/26* (2013.01)

(58) Field of Classification Search

CPC ..... E04F 11/035; E04F 11/09; E04F 11/1041; E04F 11/025; E04F 11/0255; E04F 21/26; E04F 2011/0203; E04F 2011/1046

USPC ..... 52/183

See application file for complete search history.

(56) References Cited

U.S. PATENT DOCUMENTS 1,015,773 A * 1/1912 Auger ..... G01B 3/06 33/456
1,601,138 A * 9/1926 Moore ..... E04F 21/26 33/462
1,834,389 A * 12/1931 Drescher ..... E04F 21/26 33/833

(Continued)

OTHER PUBLICATIONS

TedsDixieSheds, "Swanson Big 12 Speed Square for Stringers", YouTube, Jun. 24, 2013, <https://www.youtube.com/watch?v=IMIJXq4IIbM>.

(Continued)

*Primary Examiner* — Kyle J. Walraed-Sullivan
(74) *Attorney, Agent, or Firm* — Bereskin & Parr LLP

(57) ABSTRACT

Systems and methods for constructing staircases are described herein. The systems include a stringer hanger bracket for coupling a stair stringer of the staircase to an upper floor, two or more tread support structures and a jig. Each tread support structure is configured to couple a tread to the stair stringer. The jig is configured to determine a mounting position of each of the tread support structures on the stair stringer, determine a mounting position of each of the tread support structures on the stair stringer and/or determine a length of the stair stringer.

19 Claims, 85 Drawing Sheets

(56) References Cited

U.S. PATENT DOCUMENTS 1,921,356 A * 8/1933 Gravell ..... E04F 21/26 144/136.6
2,494,462 A * 1/1950 Elmore ..... E04F 21/26 33/418
3,112,568 A * 12/1963 Baker ..... E04F 21/26 33/421
3,153,859 A * 10/1964 Jones ..... E04G 21/1891 33/419
3,478,434 A * 11/1969 Catalano ..... E04F 21/26 33/418
3,962,838 A * 6/1976 Cox ..... E04F 11/0255 182/1
4,422,270 A * 12/1983 Lapointe ..... E04F 11/1041 52/182
4,586,585 A * 5/1986 Zaner ..... E04F 11/0255 182/206
4,709,520 A * 12/1987 Vochatzer ..... E04F 11/025 182/220
4,819,391 A * 4/1989 Tassin ..... E04F 11/1041 52/715
4,833,791 A * 5/1989 Campbell ..... B43L 13/206 33/562
4,866,894 A * 9/1989 Brown ..... E04F 11/1041 52/182
4,875,315 A * 10/1989 Champagne ..... E04F 11/025 52/191
5,388,340 A * 2/1995 Marty ..... E04F 21/26 33/421
5,461,798 A * 10/1995 Ribeiro ..... E04F 21/26 33/526
5,636,483 A * 6/1997 Wille ..... E04F 11/0255 182/228.1
5,899,032 A * 5/1999 Buzby ..... E04F 11/0255 52/715
6,088,977 A * 7/2000 Lawrence ..... E04F 11/1041 52/190
6,230,454 B1 * 5/2001 Meagher ..... E04F 11/108 52/190
6,260,283 B1 * 7/2001 Abernathy ..... B43L 7/12 33/484
6,314,652 B1 11/2001 English
6,510,616 B1 * 1/2003 Sparkman ..... E04F 21/26 33/456
7,627,955 B1 * 12/2009 Perkey ..... B43L 7/14 33/476
7,631,463 B2 12/2009 Greenlee et al.
7,946,085 B2 5/2011 Prins
7,954,249 B1 * 6/2011 Perkey ..... E04F 21/26 33/476
8,833,008 B2 * 9/2014 Truckner ..... E04F 11/181 52/191
9,121,688 B1 * 9/2015 Schmid ..... B25H 7/02
10,300,735 B2 * 5/2019 Mullins ..... E04G 21/1891
2002/0124492 A1 * 9/2002 Gobeil ..... E04F 11/00 52/191
2003/0093959 A1 * 5/2003 Couture ..... E04F 11/1041 52/182
2004/0049934 A1 * 3/2004 Huff ..... B27M 3/12 33/562
2005/0081461 A1 * 4/2005 Gibson ..... E04F 11/00 52/741.2
2007/0017169 A1 * 1/2007 Gibson ..... E04F 11/025 52/182
2007/0113416 A1 * 5/2007 Reed ..... E04F 21/26 33/474
2007/0113493 A1 * 5/2007 Gibson ..... E04F 11/1043 52/188
2008/0040992 A1 * 2/2008 Greenlee ..... E04F 11/025 52/188
2009/0025238 A1 * 1/2009 Bowman ..... E04F 21/26 33/472
2009/0056268 A1 * 3/2009 Greenlee ..... E04B 1/2608 52/702
2009/0205267 A1 * 8/2009 Prins ..... E04F 11/1041 52/182
2011/0107610 A1 * 5/2011 Farr ..... E04F 21/0076 33/421
2012/0285028 A1 * 11/2012 Atwood ..... G01B 3/02 33/452
2015/0233131 A1 * 8/2015 Hofstetter ..... E04F 21/26 33/427
2016/0060875 A1 * 3/2016 Kvols ..... E04F 21/26 52/191
2017/0356196 A1 * 12/2017 Jean ..... E04F 11/025
2019/0106890 A1 * 4/2019 Stalemark ..... E04F 21/26
2020/0200518 A1 * 6/2020 Scribner ..... G01B 3/566
2020/0407980 A1 * 12/2020 Spremulli ..... E04F 11/035

OTHER PUBLICATIONS

International Search Report and Written Opinion, dated Feb. 25, 2020, in related International Application No. PCT/CA2019/051571.

* cited by examiner

MODULAR STAIRCASE SYSTEMS

CROSS-REFERENCE

This application claims the benefit of U.S. Provisional Application No. 62/757,434 filed on Nov. 8, 2018, the entirety of which is incorporated herein by reference.

TECHNICAL FIELD

The embodiments disclosed herein relate generally to staircase systems and in particular to modular staircase systems with variable rises.

BACKGROUND

Staircases provide for people to walk from one floor level to another, but there are no rigidly enforced standards defining the vertical difference between floor levels. As a result, staircases are usually purpose-built for each application. This requires that the rise of each step of a staircase be calculated and defined before staircase construction. The International Building Code (IBC), International Residential Code (IRC), and regional building codes collectively the "Codes", mandate the construction of residential and commercial staircases. The Codes require maximums and minimums for rise and run and also require that all steps are uniform in size.

Beyond code compliance, there are informal comfort rules that should also be followed when designing a staircase to ensure that the staircase is comfortable for the human gait. For instance, the comfort rule of 18 says that "Rise+Run" should equal 18 inches (+−1.25 inches) and the comfort rule of 25 says that "2×Rise+Run" should equal 25 inches (+−1.50 inches). The construction of comfortable staircases that are also IBC and IRC compliant requires significant knowledge and skill on the part of the craftsman contractor/installer.

Many contractors that build staircases do not have a clear understanding of the codes or common comfort rules introduced above and as a result are uncomfortable with building staircases. Further, staircases are notoriously difficult to build and finish in a clean and aesthetically pleasing manner.

There are two common types of staircases in use: Closed staircases and Open staircases. Closed staircases are those in which the stair structure is typically hidden, and in which the risers and treads are solid. Closed staircases are the most common type of staircases. Open staircases are those in which the risers are open and the staircase structure is exposed. Open staircases are most commonly found in high-end residential, commercial applications and exterior decking projects. In both open and closed systems, the market demands that a finished staircase is nicely finished and aesthetically pleasing. In both open and closed cases, the stair stringer is the foundation for strength and should be built according to the relevant building codes and comfort rules.

Stair stringers are generally unique in terms of rise, run and slope for a given application. Choosing the correct rise, run and slope and subsequently laying out stringers and constructing them properly is significant technical challenge for many contractors/installers and beyond most do-it-yourself designers and installers.

Accordingly, there is a need for modular staircase systems with variable rise that can be assembled in a code compliant and relatively simple manner and that also respects the comfort rules introduced above.

SUMMARY

In accordance with a broad aspect, a system for constructing a staircase is described herein. The system includes a hanger bracket for coupling a stair stringer of the staircase to an upper floor, two or more tread support structures, each tread support structure being configured for coupling a tread to the stair stringer and at least one jig for constructing the staircase. The jig may be configured for determining a slope of the stair stringer of the staircase, determining a length of the stair stringer of the staircase and/or determining a mounting position of each of the tread support structures on the stair stringer.

In some embodiments, the jig is further configured for determining a length of the stair stringer of the staircase.

In some embodiments, the jig is further configured for determining a mounting position of each of the tread support structures on the stair stringer.

In some embodiments, the jig is further configured for determining a mounting position of the hanger bracket with respect to an upper floor.

In some embodiments, the system comprises a first jig and a second jig for constructing the staircase, each jig having at least one scale marked thereon including a plurality of markings, each marking representing a rise of each of the treads of the staircase.

In some embodiments, each of the tread support structures is configured to slidingly engage the stair stringer.

In some embodiments, each of the tread support structures includes a tread bracket configured to adaptively support the tread on the stair stringer based on the slope of the stair stringer.

In some embodiments, the tread bracket includes a bendable base configured to adaptively support the tread on the stair stringer.

In some embodiments, each of the tread support structures further includes a support bracket configured to support a respective tread bracket on the stair stringer.

In some embodiments, the hanger bracket is configured to bend to accommodate the slope of the stair stringer.

In some embodiments, the hanger bracket includes a first bending line to provide for the hanger bracket to bend upwardly to an angle that accommodates the slope of the stair stringer.

In some embodiments, the hanger bracket includes a second bending line to provide for the hanger bracket to bend upwardly and provide for attaching a component to the stair stringer.

In some embodiments, the hanger bracket includes a lateral support member configured to laterally support the stair stringer.

In accordance with a broad aspect, a tread support structure for coupling a tread to a stair stringer is described herein. The tread support structure includes a tread bracket comprising: a base having a top end and a bottom end, the base being configured to: slidingly engage the stair stringer, be affixed to the stair stringer and adaptively support the tread on the stair stringer based on the slope of the stair stringer; a flange shaped for supporting the tread of the staircase; and at least one side member extending upwardly from a side edge of the base, the side member being coupled to the flange; and a support bracket for supporting the tread bracket on the stringer, the support bracket comprising: an upper receiving portion configured to couple to the tread bracket; and a lower receiving portion configured to couple to a top edge of the stringer and support the tread bracket when the tread bracket is parallel with a ground surface.

In some embodiments, the base includes a slot formed therein, the slot being shaped to receive a fastener for coupling the tread bracket to the support bracket.

In some embodiments, the slot is formed in the base at a position towards the bottom end of the base.

In some embodiments, the base includes a support bracket receiving portion and a connection tab, the support bracket receiving portion being configured to bend about a bending line between the support bracket receiving portion and the connection tab to adaptively support the tread on the stair stringer.

In some embodiments, the bending line includes one or more perforations to facilitate bending along the bending line.

In some embodiments, the connection tab is configured to be affixed on a top edge of the stair stringer.

In some embodiments, an edge of the connection tab is configured to be aligned with a mounting line on the stair stringer to position the tread bracket on the stair stringer.

In some embodiments, the tread bracket includes one or two side members extending upwardly from the base to support the tread and, when the tread bracket includes two side members, the side members are positioned on opposite sides of the base.

In some embodiments, each of the side members has a first height at the top end of the base and a second height at the bottom end of the base, the first height being greater than the second height.

In some embodiments, the support bracket has a feature to provide for a height of the support bracket to be adjustable.

In accordance with one broad aspect, a hanger bracket for coupling a stair stringer of a staircase to an upper floor is described herein. The hanger bracket includes an upper floor mounting portion configured to mount to a face of the upper floor; and stringer mounting portion configured to mount to an edge of the stair stringer; wherein the hanger bracket is configured to bend to accommodate the slope of the stair stringer.

In some embodiments, the hanger bracket includes a first bending line to provide for the hanger bracket to bend upwardly to an angle that accommodates the slope of the stair stringer.

In some embodiments, the hanger bracket includes a second bending line to provide for two or more hanger brackets to bend upwardly together and provide for attaching a tread to at least two stair stringers.

In some embodiments, the hanger bracket includes a lateral support member configured to laterally support the stair stringer.

In some embodiments, the lateral support member extends outwardly from the upper floor mounting portion.

In accordance with a broad aspect, a modular staircase system is described herein. The staircase system includes: a first stringer assembly and a second stringer assembly spaced apart from the first stringer assembly, each stringer assembly being coupleable to a front face of an upper floor to extend between the upper floor and a lower floor, the two stringer assemblies connected to each other by at least two treads extending between the stringer assemblies, each stringer assembly comprising: a hanger bracket configured to be coupleable to a front face of the upper floor and bend about a bending line thereof; a stair stringer having an upper end and a lower end, the upper end of the stair stringer being coupled to the hanger bracket; and two or more tread support structures, each tread support structure for coupling one of the treads to the stair stringer, the tread support structure including: a base having a top end and a bottom end, the base being configured to: slidingly engage the stair stringer, be affixed to the stair stringer and adaptively support the tread on the stair stringer so the tread is level for any slope of the stair stringer; a flange shaped for supporting the tread of the staircase; and at least one side member extending upwardly from a side edge of the base, the side member being coupled to the flange.

In accordance with a broad aspect, a method of preparing a stair stringer for a staircase is described herein. The method includes determining a number of treads of the staircase; determining a rise of each of the treads of the staircase; placing a jig at a first position relative to the stair stringer to provide for a first feature of the jig to indicate a first cut line on the stair stringer that defines a slope of the stair stringer; marking the first cut line on the stair stringer; placing the jig at a second position relative to the stair stringer to provide for a second feature of the jig to indicate a second cut line on the stair stringer; marking the second cut line on the stair stringer; and cutting the stair stringer along the first cut line and the second cut line to prepare the stair stringer.

In some embodiments, placing the jig at the first position relative to the stair stringer provides for a third feature of the jig to indicate a mounting position of a lowermost tread support structure on the stair stringer.

In some embodiments the method also includes marking a position of the lowermost tread support structure on the stair stringer when the jig is at the first position.

In some embodiments, the jig includes a first jig releasably coupled to a second jig and the step of placing the jig at a first position relative to the stair stringer includes placing the first jig at the first position relative to the stair stringer and manipulating the second jig relative to the first jig to provide for a feature of the second jig to indicate the first cut line on the stair stringer that defines the slope of the stair stringer.

In some embodiments, the step of placing the jig at the second position relative to the stair stringer includes manipulating the second jig relative to the first jig to provide for the feature of the second jig to indicate the second cut line on the stair stringer.

In some embodiments, determining the number of treads of the staircase includes: measuring a vertical distance between an upper floor and a lower floor; dividing the vertical distance by a largest rise marked on a scale of the jig; rounding up to the nearest whole number; and subtracting one.

In accordance with a broad aspect, a jig for preparing a stair stringer for a staircase is described herein. The jig includes at least one scale marked thereon, each scale including a plurality of markings, each marking representing a rise of each tread of the staircase.

In some embodiments, the jig is configured for determining a mounting position of two or more tread support structures on the stair stringer.

In some embodiments, the jig is configured for determining a length of the stair stringer.

In some embodiments, the jig is configured for determining a mounting position of a hanger bracket with respect to an upper floor.

In some embodiments, the jig is configured for determining a slope of the stair stringer of the staircase.

In accordance with a broad aspect, a set of jigs for preparing a stair stringer for a staircase is described herein.

The set of jigs including a first jig and a second jig, each jig having at least one scale marked thereon, each scale including a plurality of markings, each marking representing a rise of each tread of the staircase.

In some embodiments, the set of jigs is configured for determining a mounting position of two or more tread support structures on the stair stringer.

In some embodiments, the set of jigs is configured for determining a length of the stair stringer.

In some embodiments, the set of jigs is configured for determining a mounting position of a hanger bracket with respect to an upper floor.

In some embodiments, the set of jigs is configured for determining a slope of the stair stringer of the staircase.

In accordance with a broad aspect, a method of attaching a tread support structure to a stair stringer is described herein. The method includes attaching a first end of a tread bracket of the tread support structure to the stair stringer, adapting the tread bracket until a base of the tread bracket is level and attaching a support bracket to the stair stringer and to the tread bracket to support the tread bracket and maintain the base of the tread bracket being level.

In some embodiments, adapting the tread bracket until the base of the tread bracket is level includes bending the tread bracket upwardly until the base of the tread bracket is level.

Other aspects and features will become apparent, to those ordinarily skilled in the art, upon review of the following description of some exemplary embodiments.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1:
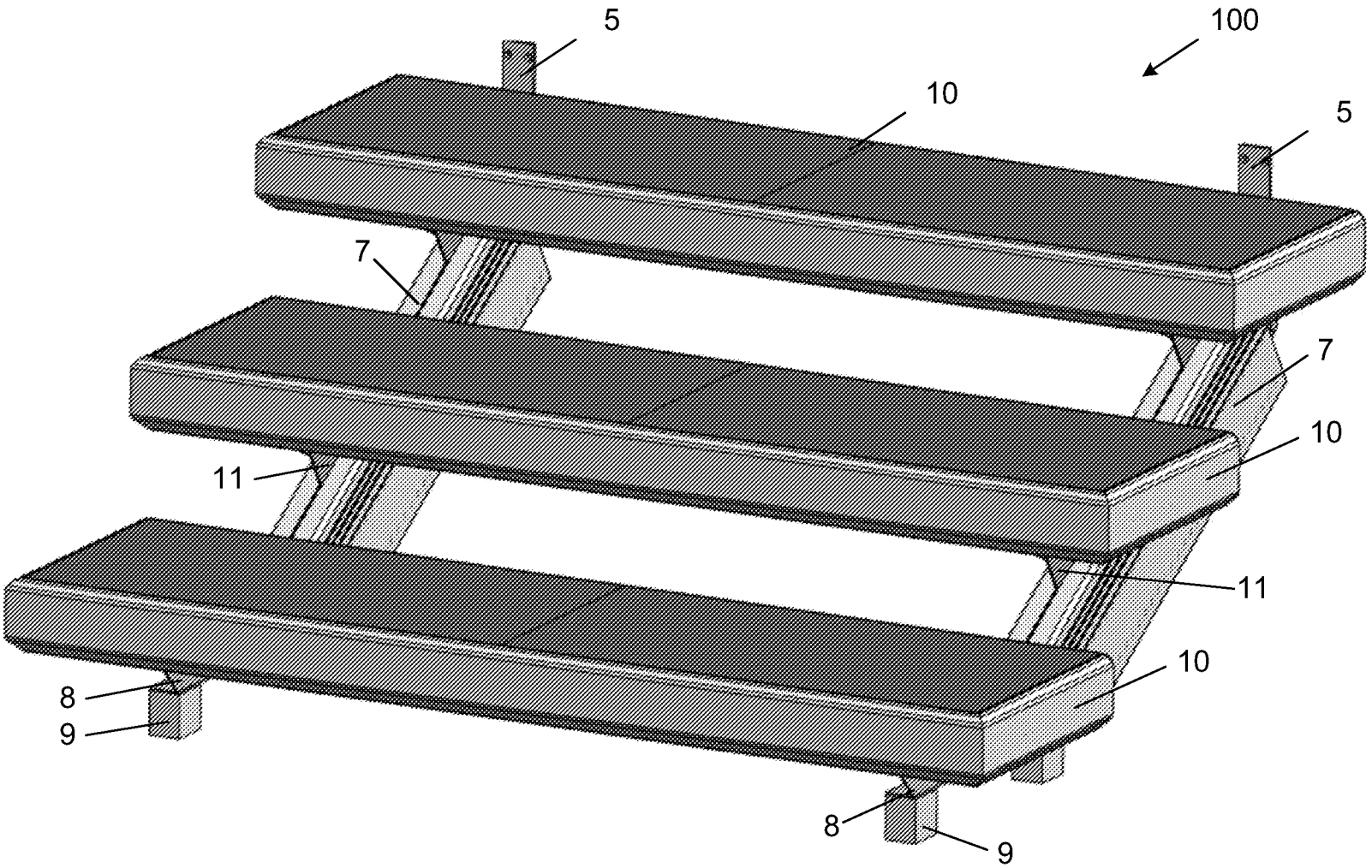
FIG. 1 is an isometric view of an open modular staircase system, according to one embodiment.

The skilled person in the art will understand that the drawings, further described below, are for illustration purposes only. The drawings are not intended to limit the scope of the applicant's teachings in any way. Also, it will be appreciated that for simplicity and clarity of illustration, elements shown in the figures have not necessarily been drawn to scale. For example, the dimensions of some of the elements may be exaggerated relative to other elements for clarity. Further aspects and features of the example embodiments described herein will appear from the following description taken together with the accompanying drawings.

DETAILED DESCRIPTION

In spite of the technologies that have been developed, there remains a need in the field for systems and methods for constructing staircases.

Systems and methods for constructing staircases are described herein. The systems include systems having components to construct a staircase with a fixed slope (i.e. the components are configured to construct a staircase with a pre-determined slope that is not able to be changed during construction of the staircase) and systems having components to construct a staircase with a variable slope (i.e. the components are adaptable during construction of the staircase to provide a staircase having a slope within a range of possible slopes).

The systems for constructing staircases described herein generally include at least three components: a hanger bracket configured to mount a stair stringer of the staircase to an upper floor, a tread support structure configured to couple a tread of the staircase to the stair stringer, and a jig. This jig is generally configured to determine a slope of the stair stringer, determine a mounting position of each of the tread support structures on the stair stringer and/or determine a length of the stair stringer. Each of these components of these systems is described in greater detail below.

It should be understood that herein the terms "stringer", "stringer backbone", "backbone" and "stair stringer" are used synonymously to refer to the housing on either side of a flight of stairs onto which the treads and risers are fixed.

For any given slope, the components of the fixed slope staircase systems described herein can be configured to construct a staircase having treads with a rise and a run that results in the staircase conforming to the comfort rules introduced above. For example, for a staircase with a 29 degree slope, the components of the fixed slope staircase systems described herein can be configured to construct a staircase that falls with the comfort rules having a rise of each tread in a range of about 6.15 inches to about 6.85 inches and a run of each tread in a range of about 11.0 inches to about 12.4 inches. Generally, the components of the fixed slope staircase systems described herein provide for constructing staircases that have a fixed slope and a variable run.

It should be understood however that although the comfort rules introduced above are generally applied for constructing most staircases, they are informal rules and the components of the fixed slope staircase systems described herein should not be limited to being configured to construct staircases that conform to the comfort rules. Rather, it should be understood that for any given slope, the fixed slope staircase systems described herein can be configured to construct a staircase that does not conform to the comfort rules.

Components of the variable slope systems described herein are configured to construct staircases having treads with a rise and a run that results in the staircases conforming to the comfort rules introduced above for any given slope. Generally, the components of the variable slope staircase systems described herein provide for constructing staircases that have a variable slope and a fixed run. It should be understood that, the ability the components of the of the variable slope staircase systems described herein to adapt to different staircase slopes provide for greater flexibility when constructing staircases that conform to the comfort rules when compared to the fixed slope systems described herein. For example, the range of available rises of each tread that is possible when constructing a staircase conforming to the comfort rules is generally bigger than the range of available rises of each tread that is possible using the fixed slope systems described herein. Herein, the term "adapt" refers to being modifiable or adjustable. Examples of ways that components described herein can be adapted include but are not limited to bending, rotating, twisting, spinning, swiveling and the like.

It should be understood however that although the comfort rules introduced above are generally applied for constructing most staircases, they are informal rules and the components of the variable slope staircase systems described herein should not be limited to being configured to construct staircases that conform to the comfort rules. Rather, it should be understood that for any given slope, the variable slope staircase systems described herein can be configured to construct a staircase that does not conform to the comfort rules.

The following paragraphs provide several examples of systems and methods for constructing staircases, however, the scope of the application should not be limited to the systems and methods described specifically herein.

In accordance with at least one embodiment, a variable rise and fixed run modular staircase system is provided. The modular staircase system includes standard parts that can be configured to produce code compliant (i.e. 2015 International Building Code (IBC)) staircase stringers. In this embodiment, the staircase stringers are code compliant and also respect the comfort rules.

In order to vary the rise of the staircase to accommodate different vertical distances between upper and lower floors while also providing treads with a fixed run, the slope of the stair stringer relative to the lower floor needs to be variable. In at least one embodiment, to assemble stair stringers such as these, an installer can follow a set of instructions that direct the installer to prepare the stringer, for example by making cuts (e.g. utilizing one or more jigs) and using locator jigs and connecting one or more brackets to the stair stringer. As discussed below, to provide for a stringer backbone to be customizable for various distances between upper and lower floors, the stringer backbone may be made from a material such as but not limited to wood (e.g. standard dimension lumber). In some embodiments, such as in the case of an open staircase, the stringer backbone may be shrouded (e.g. shielded) by a cover or made of extruded aluminum or other structural material.

Turning to the figures, FIG. 1 depicts an isometric view of an open staircase system 100 made in accordance with an embodiment described herein. Generally, the staircase system 100 shown in FIG. 1 includes two stringer hangers 5, two stringer backbones 7 horizontally spaced apart from each other, two base riser brackets 8 and two base feet 9. Each stringer backbone 7 is coupled to at least one stringer bracket 11 that supports a tread 10. In the embodiment shown in FIG. 1, each stringer backbone 7 is coupled to two stringer brackets 11 that each co-ordinate with a respective stringer bracket 11 of the other stringer backbone 7 to support a tread 10.

Figure 2A:
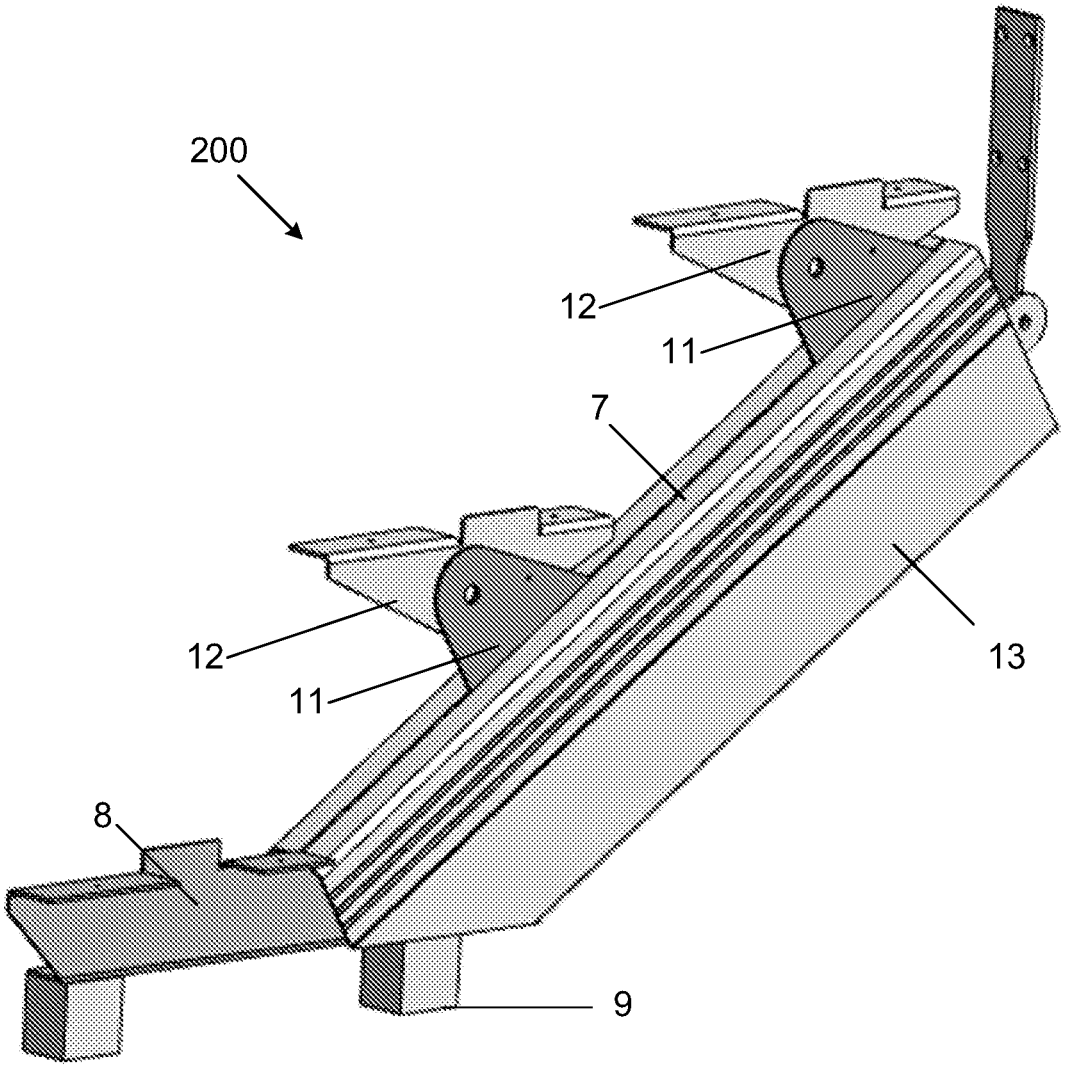
FIG. 2A is an isometric view of a shrouded stair stringer of the staircase system of FIG. 1.
Figure 2B:
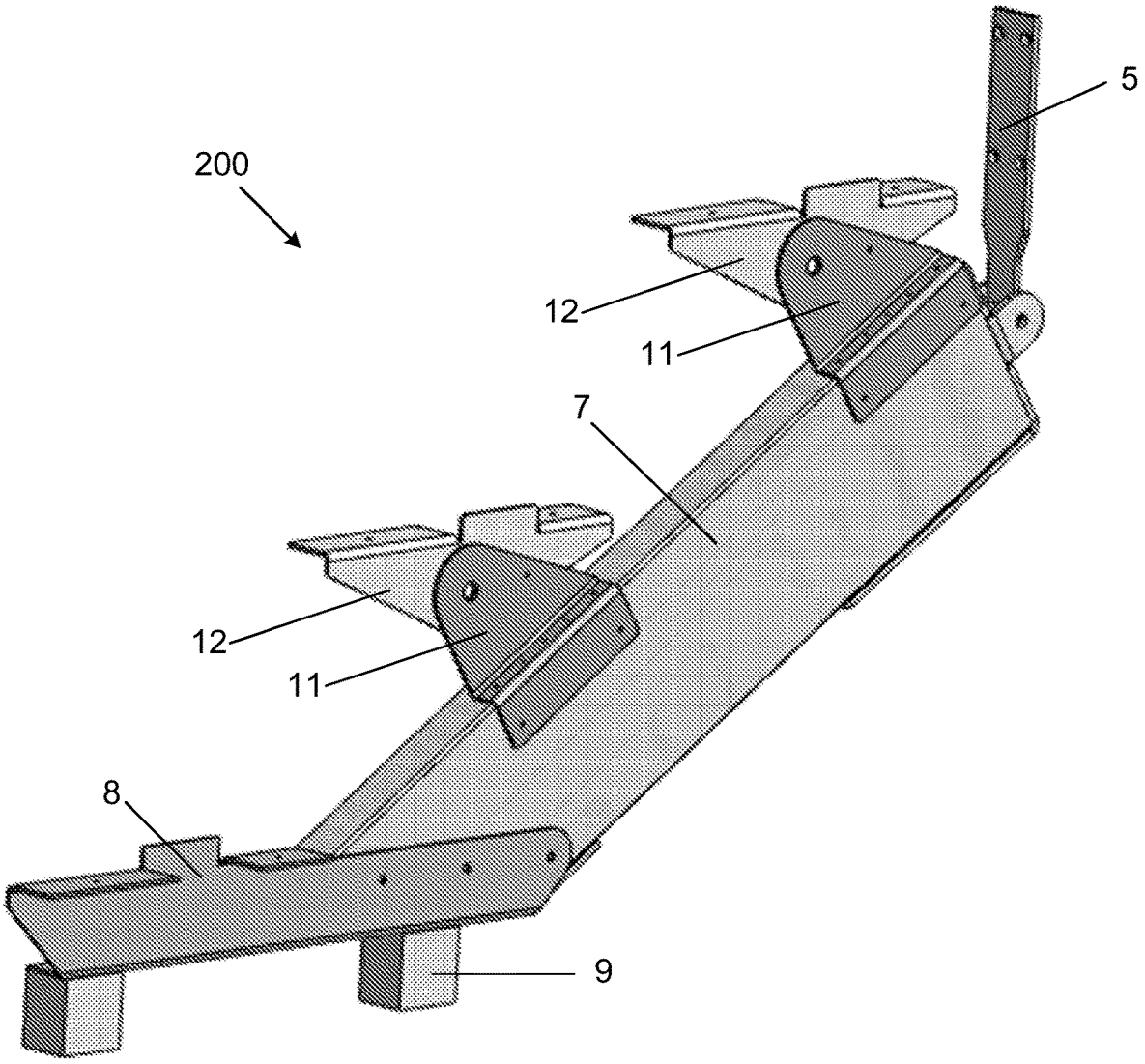
FIG. 2B is an isometric view of an unshrouded stair stringer of the staircase system of FIG. 1.

FIG. 2A is an isometric view of a stringer assembly 200 of staircase system 100 of FIG. 1. Stringer assembly 200 is shown in FIG. 2A as having a stringer backbone 7 that is shrouded by a cover 13. FIG. 2B shows the stringer assembly 200 where stringer backbone 7 is unshrouded.

Figure 3A:
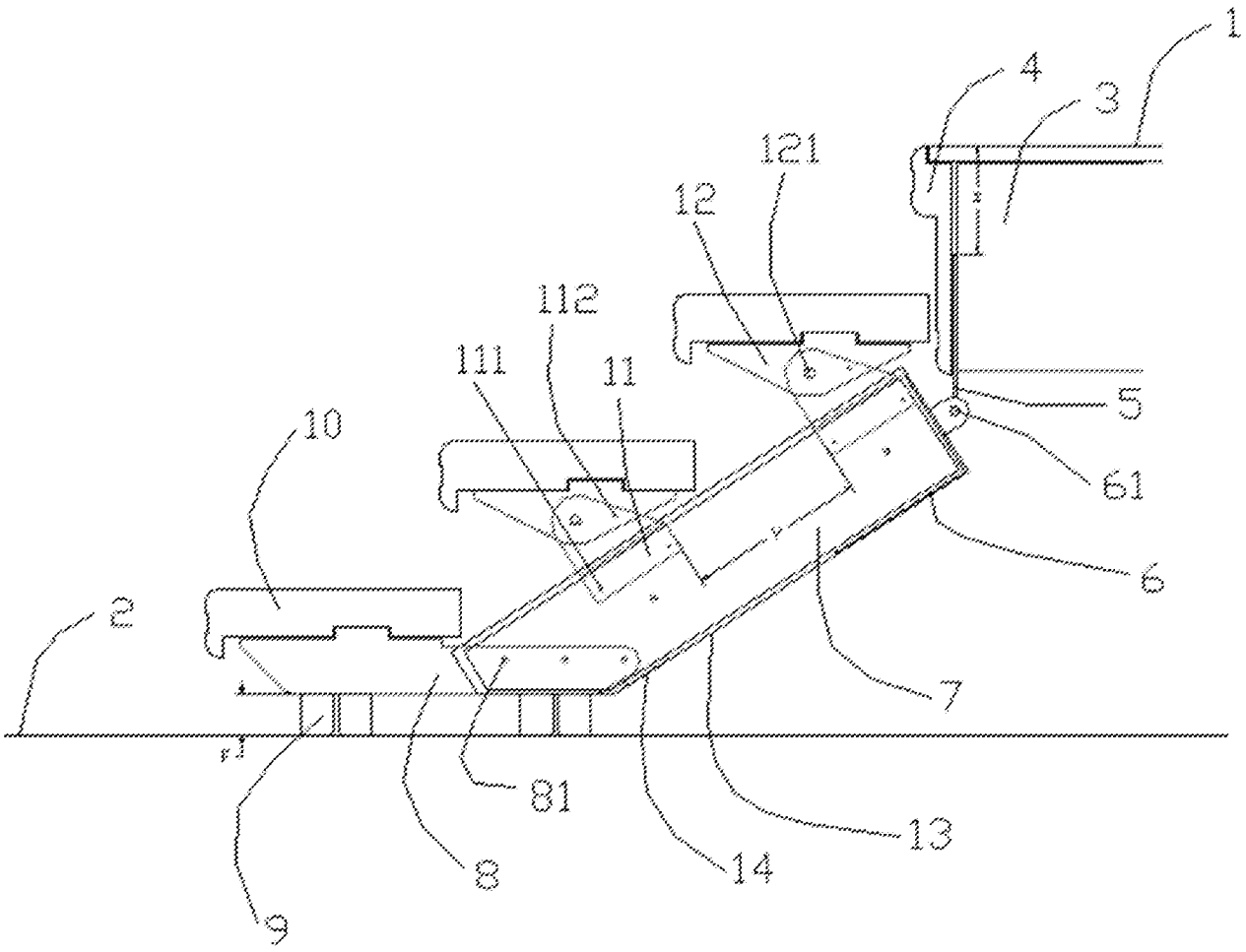
FIG. 3A is a side view of the staircase system of FIG. 1 extending between an upper floor and a lower floor.

FIG. 3A shows a side view of the staircase system 100 of FIG. 1 shown installed between an upper floor and a lower floor. FIG. 3A shows upper floor 1, lower floor 2, a floor structure 3 of upper floor 1, and a face molding 4 of upper floor 1. Face molding 4 is shown as being offset from the floor structure 3 to provide space to attach the stringer hanger 5 to the floor structure 3.

In the embodiment shown in FIG. 3A, stringer hanger 5 may be coupled to a rotational bracket 6 at a rotary attachment point 61 and the rotational bracket 6 may in turn be attached to the stringer backbone 7. As previously mentioned, the stringer backbone 7 may be a standard dimensional piece of wood (i.e. lumber) that is sized to the purpose of being the stringer backbone 7. A shim 14 having a same thickness as rotational bracket 6 may be coupled to a bottom end of the stringer backbone 7 (e.g. adjacent bottom floor 2) to level the base for applying cover 13.

Figure 3B:
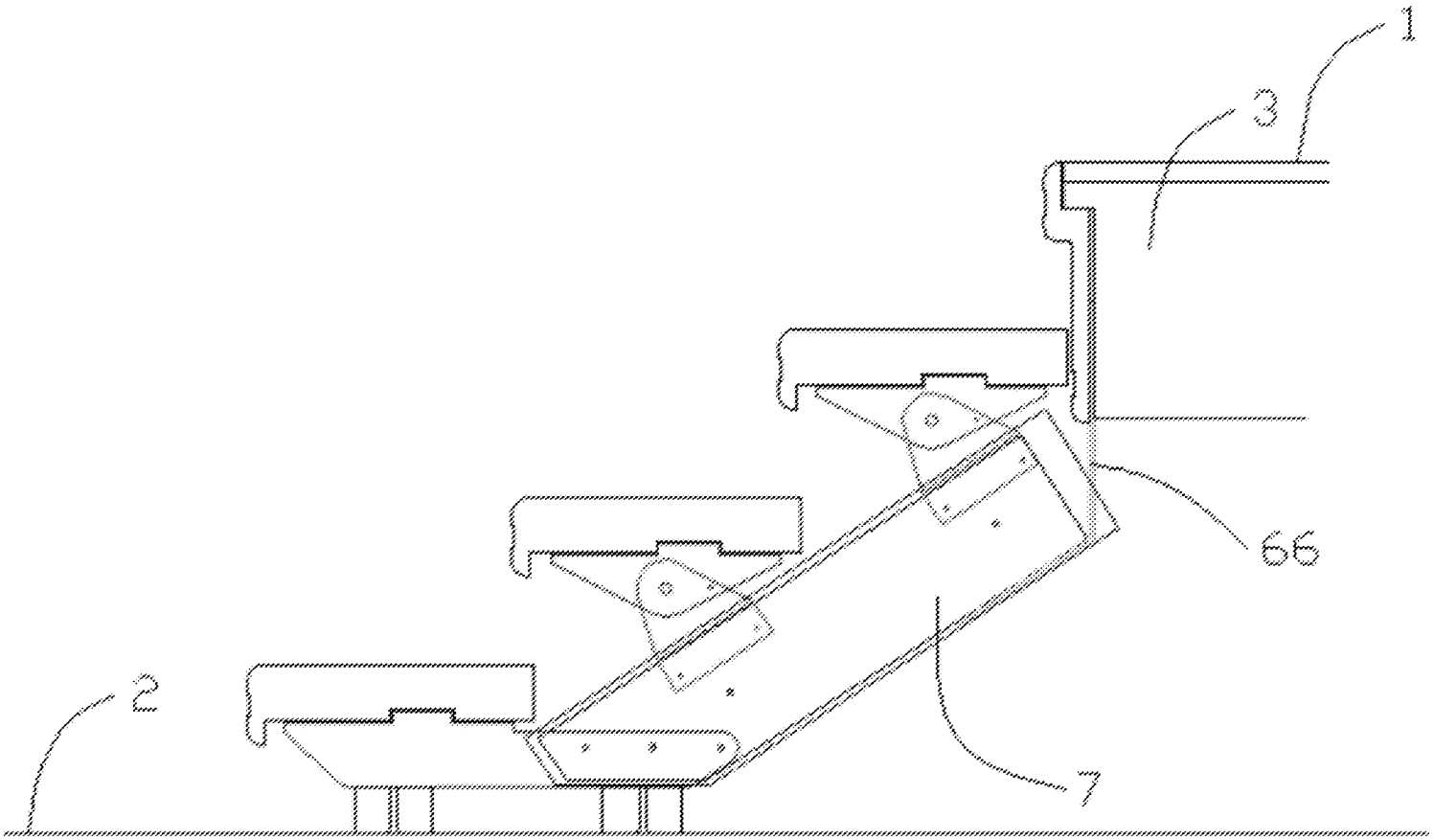
FIG. 3B is a side view of a second embodiment of an open staircase system.

FIG. 3B shows another embodiment of staircase system 100 where stringer hanger bracket 5 and rotational bracket 6 have been replaced by a bracket 66. In this embodiment, bracket 66 is a single piece that is mountable to the upper floor 1 and stringer backbone 7.

Returning to FIG. 3A, in this embodiment, the stringer backbone 7 may be coupled at a lower end to the base riser bracket 8 via fasteners (e.g. screws) via, for example, a datum hole 81. Once the stringer backbone 7 is coupled to the base riser bracket 8, a base foot 9 can be cut to an appropriate height to provide for a tread 10 thereupon to be with the proper distance above lower floor 2. Base foot 9 is then coupled to the base riser bracket 8 with appropriate hardware, such as but not limited to one or more screws. Base foot 9 may be configured as a single piece or may include two or more pieces co-operating form the base foot 9.

Each stringer bracket 11 is generally coupled to the stringer backbone 7 by fasteners (e.g. screws) via a datum hole 111. The stringer brackets 11 are generally spaced apart from each other by a width V as shown in FIG. 3. Width V can be measured using any appropriate method, such as by employing a spacer. In some embodiments, a spacer offers dimensional repeatability and quality.

Each step bracket 12 is coupled to a respective stringer bracket 11 via locator hole 121. Each step bracket 12 can be rotated about its respective stringer bracket 11 e.g. about the locator hole 121) to a position where a tread 10 supported thereupon is level with a lower floor 2 and/or upper floor 1. Each step bracket 12 can be rotationally fixed, for example by drilling a corresponding hole in step bracket 12 and inserting a fastener through keeper hole 112. A tread 10 can then be affixed to the base riser bracket 8 and each step bracket 12 using fasteners.

Backbone cover 13 may be coupled to stringer backbone 7 to shroud the stringer backbone 7. Backbone cover 13 may be coupled to any surface of the stringer backbone 7 to shroud the stringer backbone 7.

Figure 4A:
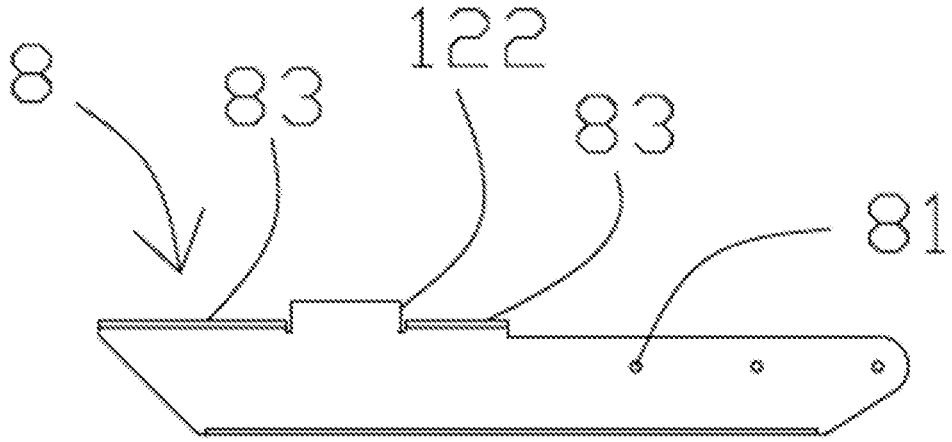
FIGS. 4A and 4B are side and top views, respectively, of a base foot bracket of the staircase system of FIG. 1, according to one embodiment.
Figure 4B:
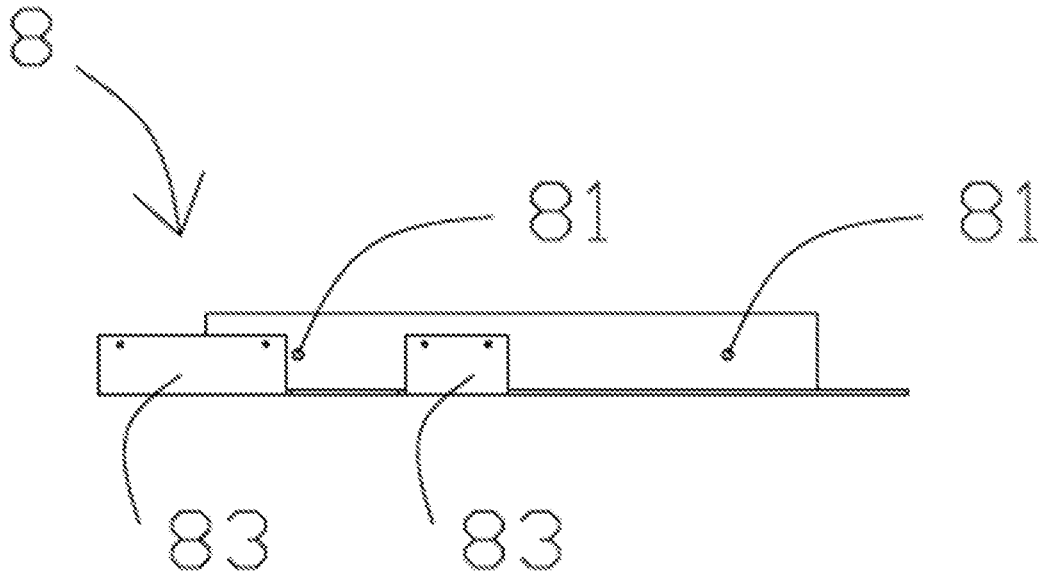

Turning to FIGS. 4A and 4B, shown therein are the side and top views, respectively, of a base riser bracket 8. Base riser bracket 8 is coupled to a lowermost end of the stringer backbone 7 to support a lowermost tread 10 of the staircase system 100. Base riser bracket 8 may include a hole 81 that acts as a datum assembly point for base riser bracket 8, a hole 82 for base foot 9 to the base riser bracket 8, and surface 83 and an edge 122 as a datum for mounting the step tread 10.

Figures 5A, 5B:
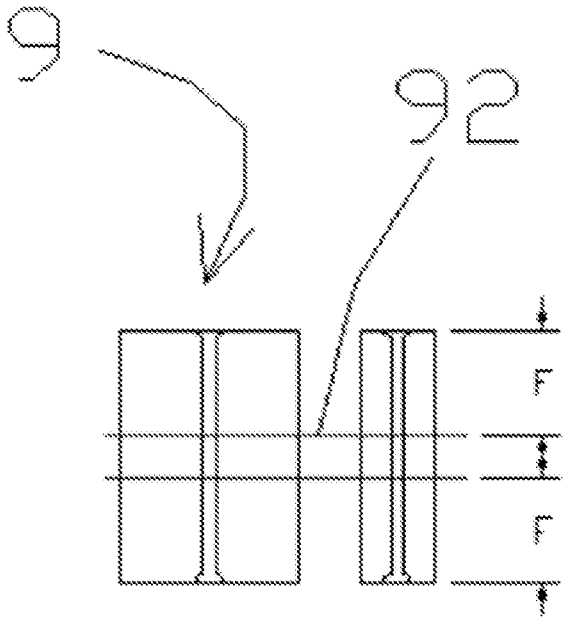
FIGS. 5A to 5C are front, side and top views, respectively, of a base foot of the staircase system of FIG. 1, according to one embodiment.
Figure 5C:
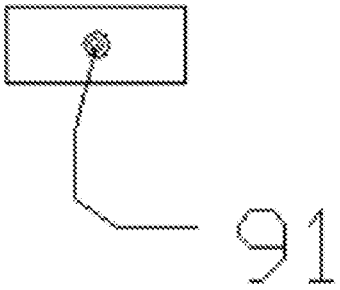

FIGS. 5A to 5C show front, side and top views, respectively, of base foot 9 according to one embodiment. In this embodiment, base foot 9 is double-ended thereby facilitating cutting two parts to dimension from one piece of stock. In some embodiments, base foot 9 may include two or more pieces that can be cut from a single piece of stock (e.g. wood) to minimize material usage. The height of base foot 9 is dependent on the riser height, i.e. a height between subsequent treads 10 of the staircase system 100, and therefore is customizable to a specific staircase application. As shown in FIG. 5C, base foot 9 may include a counter-sink mounting hole 91 for mounting the base foot 9 to the base riser bracket 8. As shown on FIG. 3, base foot 9 has a height F after being cut and coupled to the base riser bracket 8.

Figure 6A:
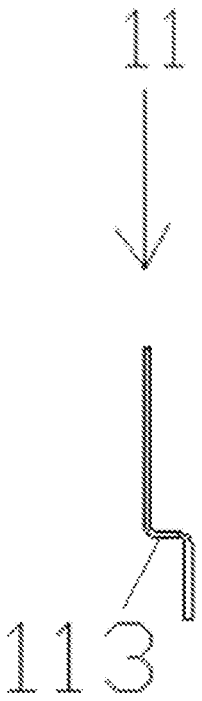
FIGS. 6A to 6C are front, side and top views, respectively, of a stringer bracket of the staircase system of FIG. 1, according to one embodiment.
Figure 6B:
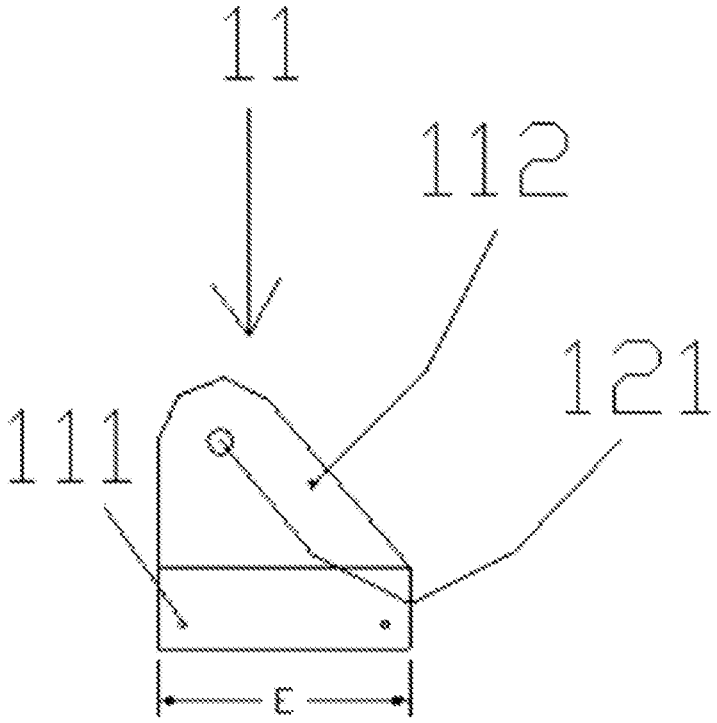
Figure 6C:
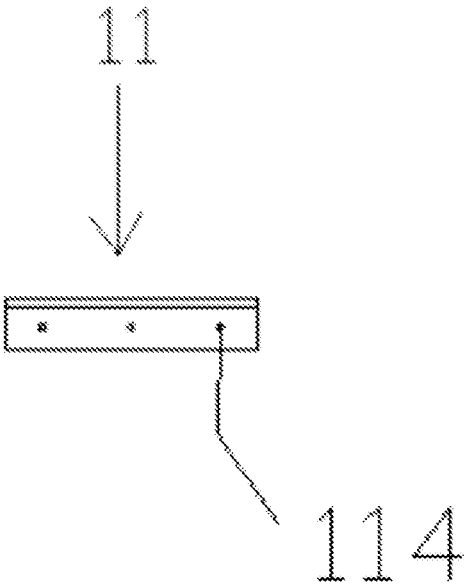

FIGS. 6A to 6C shown front top and side views, respectively, of a stringer bracket 11 according to one embodiment. FIGS. 6A to 6C show a stringer bracket 11 that includes a datum hole 111 for coupling the stringer bracket 11 to the stringer backbone 7, a rotational hole 121 for rotationally coupling a step bracket 12 to the stringer bracket 11 and a keeper hole 112 for rotationally fixing the step bracket 12 relative to the stringer bracket 11. Stringer bracket 11 may also be configured to include an offset break 113. Offset break 113 may be configured to be positioned along a centerline of the backbone 7 (e.g. along a top surface of the stringer backbone 7) and may stiffen the stringer bracket 11 and provide a surface for attachment holes 114 for coupling the stringer bracket 11 to the stringer backbone 7.

Figure 7A:
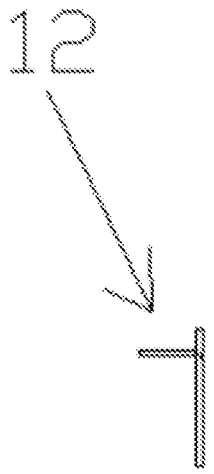
FIGS. 7A to 7C are front, side and top views, respectively, of a step bracket of the staircase system of FIG. 1, according to one embodiment.
Figure 7B:
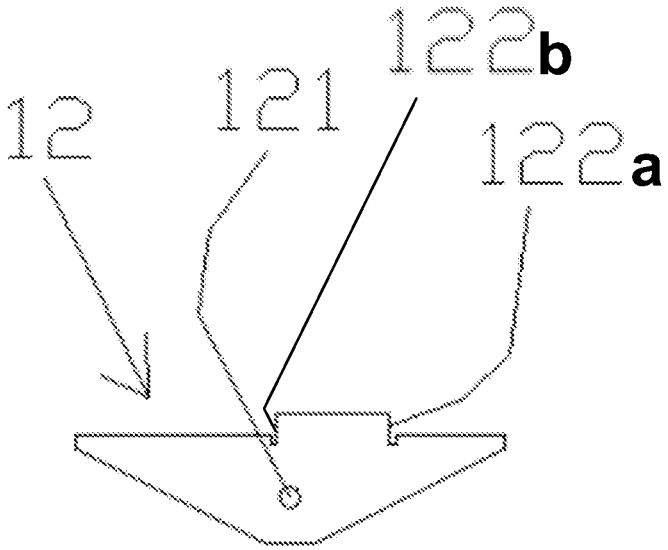
Figure 7C:
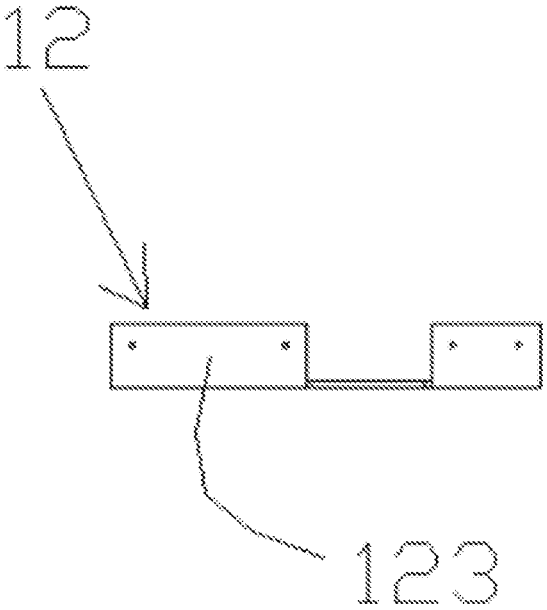

Referring now to FIGS. 7A to 7C, shown therein are top, front and side views, respectively, of a step bracket 12 according to one embodiment. In this embodiment, step bracket 12 features a rotational hole 121 for rotationally coupling the step bracket 12 to the stringer bracket 11. For instance, rotational hole 121 may be configured to receive a fastener that provides for the rotation of the step bracket 12 relative to the stringer bracket 11. Step bracket 12 also includes a supporting surface 123 for the step tread 10 and a first mounting edge 122*a* and/or 122*b* that may act as a datum for mounting a step tread 10 to the step bracket 12.

Figure 8:
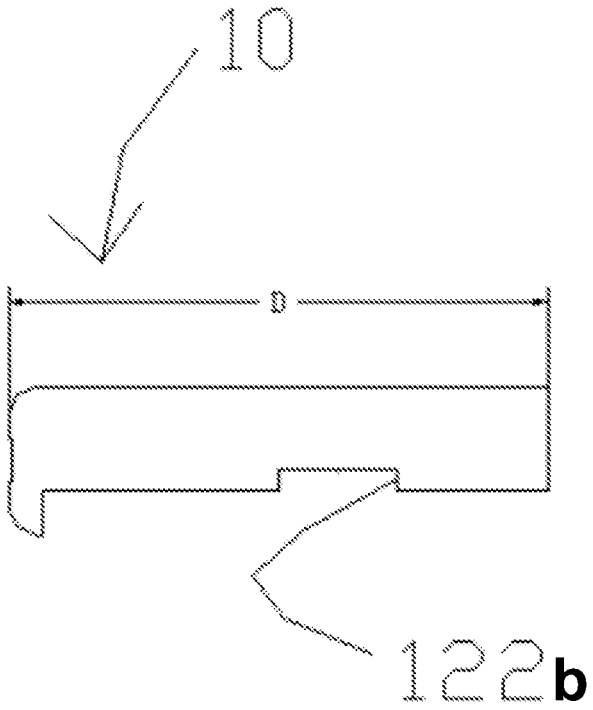
FIG. 8 is a side view of a step tread of the staircase system of FIG. 1, according to one embodiment.

FIG. 8 depicts a side view of a step tread 10 according to one embodiment. Step tread 10 may have a width D and a mounting edge 122 for mating with corresponding first mounting edge 122*a* and/or 122*b* when step tread 10 is placed upon and/or coupled to step bracket 12.

Figure 9A:
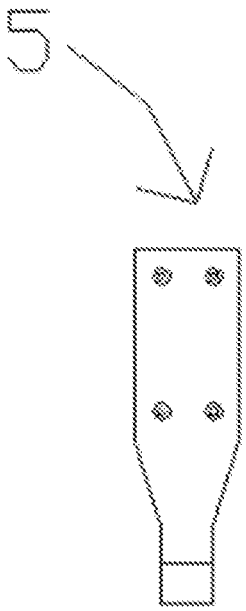
FIGS. 9A and 9B are front and side views of a hanger bracket of the staircase system of FIG. 1, according to one embodiment.
Figure 9B:
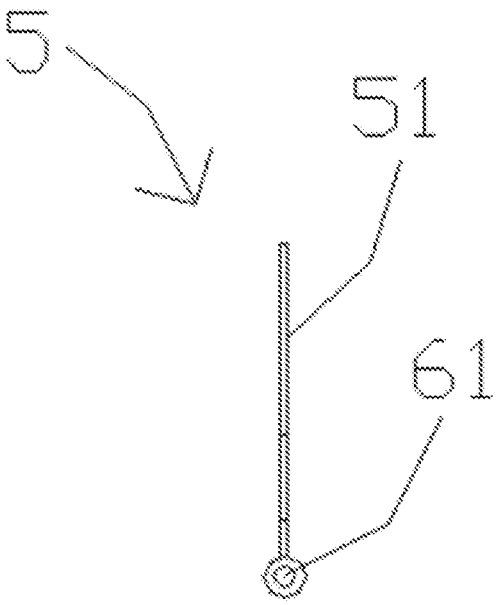
Figure 10A:
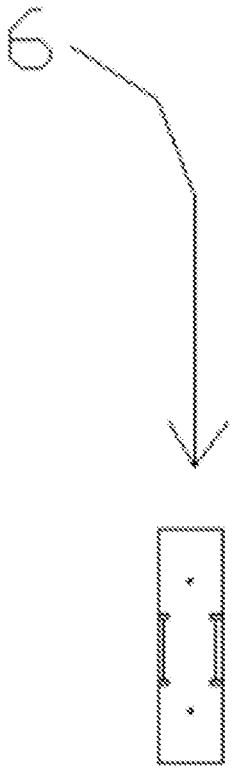
FIGS. 10A to 10C are front, side and top views, respectively, of a rotational hanger bracket of the staircase system of FIG. 1, according to one embodiment.
Figure 10B:
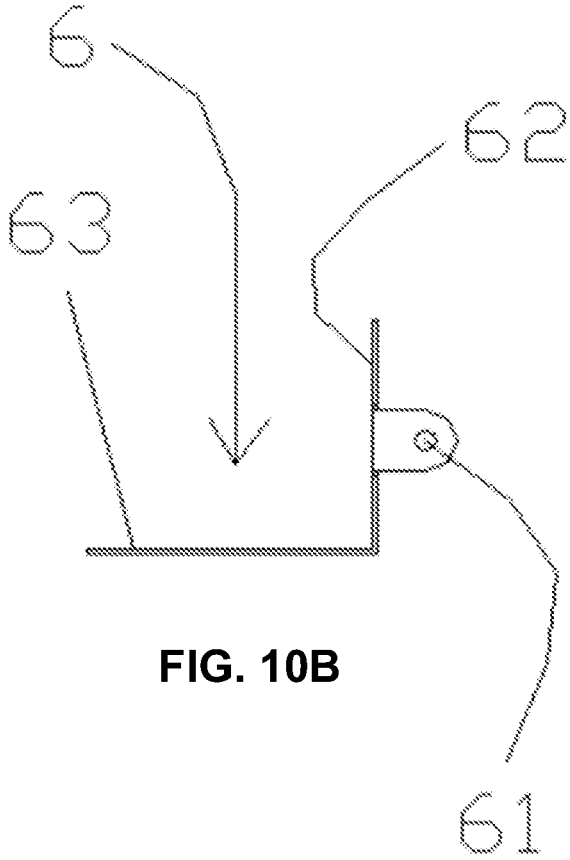
Figure 10C:
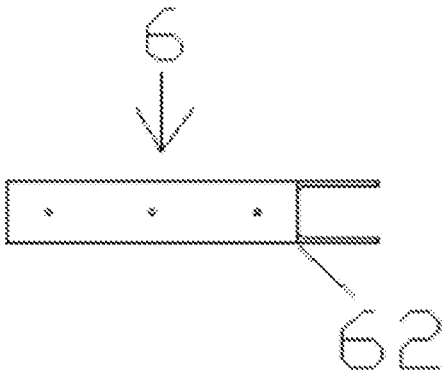

FIGS. 9A and 9B show front and side views, respectively of a stringer hanger 5 and FIGS. 10A to 10C show front, side and top views, respectively, of a rotational bracket 6, each according to an embodiment. Stringer hanger 5 shown in FIGS. 9A and 9B depicts a point of rotation 61 and mounting surface 51 which are configured to couple with a front face of upper floor structure 3 at a specified distance from a top surface of upper floor 1. The specified distance is a function of the desired rise of each of the step of the staircase system 100. The vertical location of stringer hanger 5 relative to the top floor 1 is dependent on the riser height and therefore is unique to a specific stair application. It should be noted that stringer hanger 5 is generally hidden behind face molding 4 when the staircase system 100 is installed.

Rotational bracket 6 is coupled to stringer hanger 5 at the point of rotation 61. Rotational bracket 6 is also coupled to the stringer backbone 7 via the underside-mounting surface 62 and end face mounting surface 63 of the rotational bracket 6.

Figure 11A:
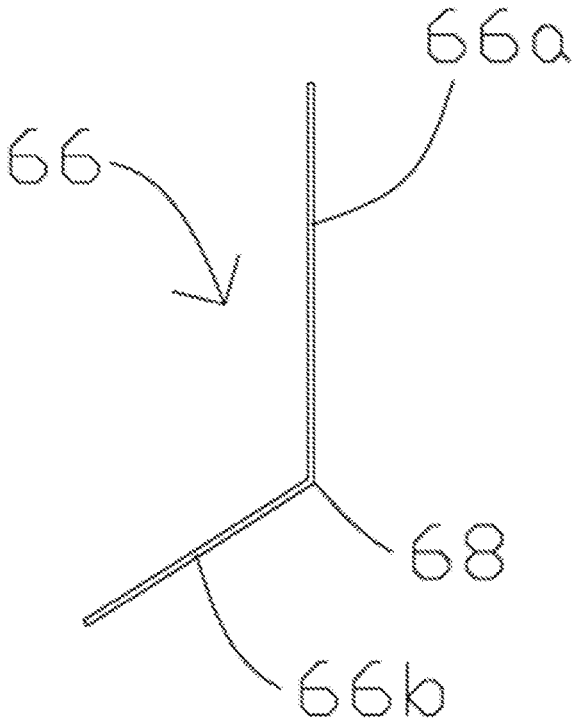
FIGS. 11A and 11B are front and side views, respectively, of a bendable stringer hanger bracket of the staircase system of FIG. 3B, according to one embodiment.
Figure 11B:
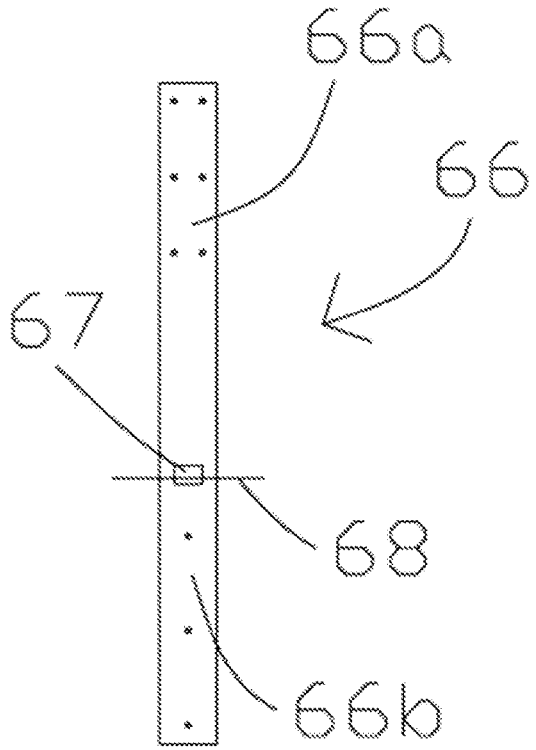

FIGS. 11A and 11B show top and side views, respectively of a bracket 66 of the system shown in FIG. 3B. Bracket 66 has a first end 66*a* that is configured to be mounted to the upper floor 1 and a second end 66*b* that is configured to be mounted to the underside of stringer backbone 7 to give support to the stringer backbone 7.

Bracket 66 may be received in a bent form (as shown in FIG. 3B) or may be bent to an appropriate angle by an installer of the system 100. Bracket 66 may include perforations 67 to provide for the installer to consistently and easily bend the bendable stringer hanger bracket 66 to the appropriate angle for supporting stringer backbone 7.

Bracket 66 shown in FIGS. 11A and 11B depicts a bend line 68 and mounting surface 66*a* which are configured to couple with a front face of upper floor structure 3 at a specified distance from a top surface of upper floor 1. The specified distance is a function of the desired rise of each of the step of the staircase system 100. The vertical location of bracket 66 relative to the top floor 1 is dependent on the riser height and therefore is unique to a specific stair application. It should be noted that first end 66*a* is generally hidden behind face molding 4 when the staircase system 100 is installed.

Figure 12A:
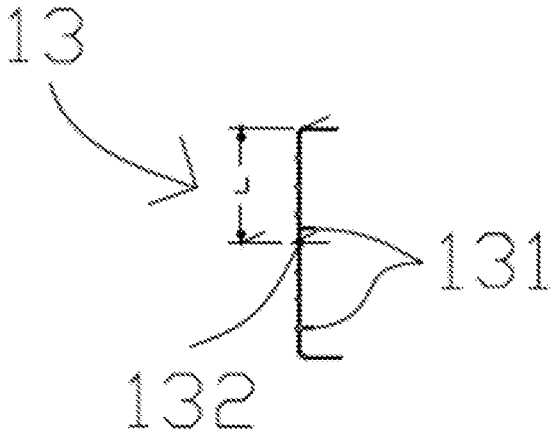
FIGS. 12A to 12C are front, end views, respectively, of a backbone and backbone cover assembly of the staircase system of FIG. 1, according to one embodiment.
Figure 12B:
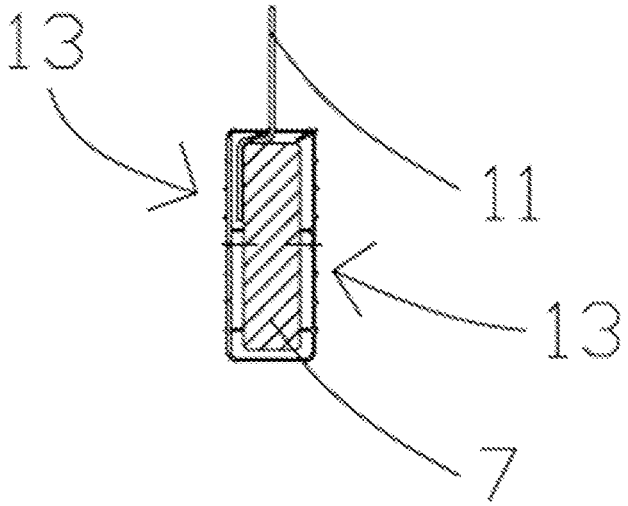
Figure 12C:
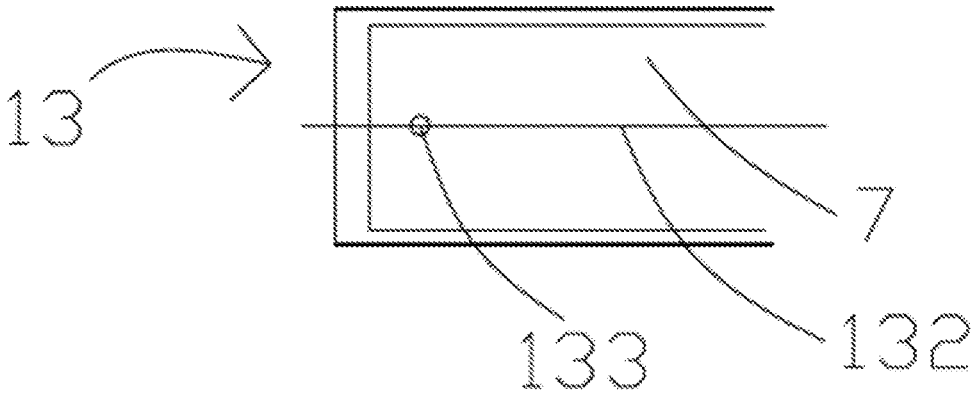

FIGS. 12A, 12B and 12C show a cover 13 according to one embodiment. Cover 13 generally co-operates with a second cover 13 to surround stringer backbone 7, as shown in FIG. 12B. The two covers 13 are generally identical and provide space for the stringer bracket 11 to pass between them. Covers 13 may each include tabs 131 having a width J and which press against the side of the backbone stringer 7 and create a space for the various brackets and mounting hardware. Grove 132 is near the center of the cover 13 and between tabs 131 and facilitates the location for Mounting Screw 133.

Figure 13:
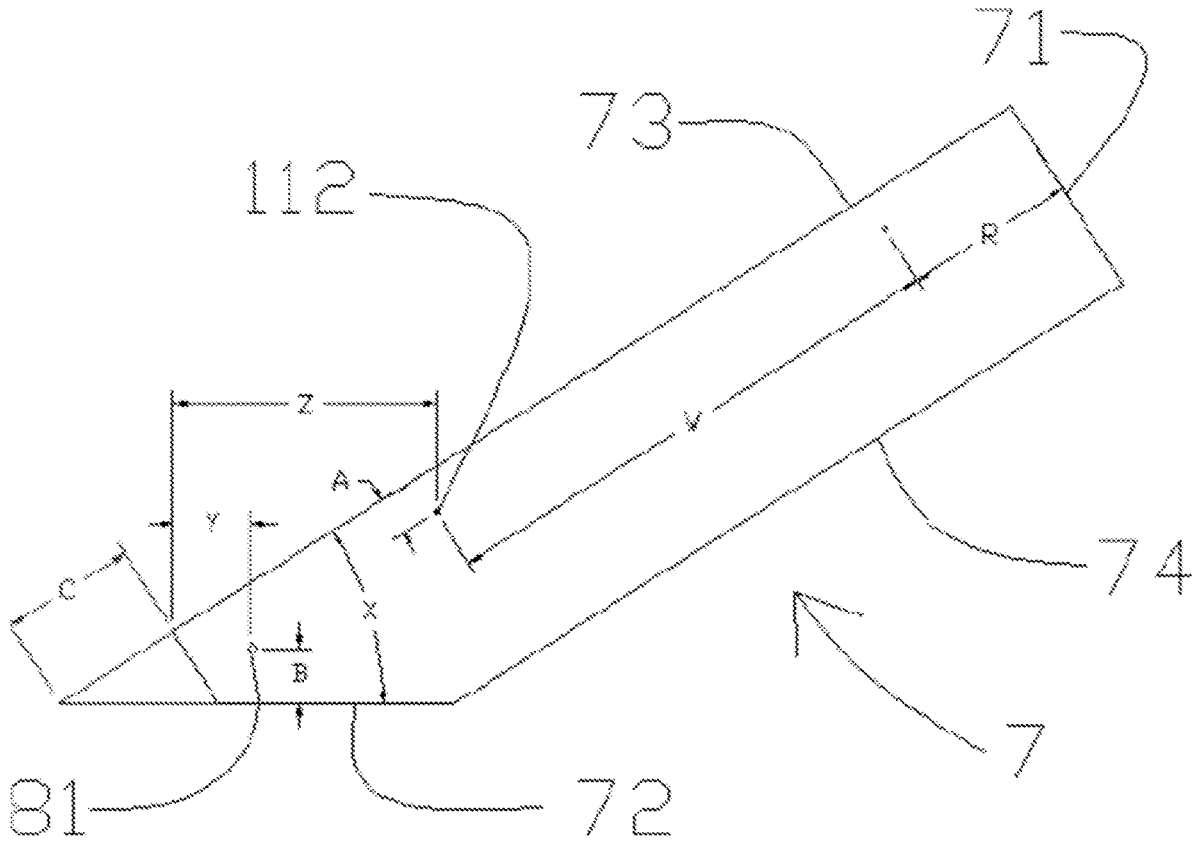
FIG. 13 is a side view of a stringer backbone of the staircase system of FIG. 1 showing the critical dimensional and angular relationships, according to one embodiment.

FIG. 13 shows a side view of the stringer backbone 7 according to one embodiment. Stringer backbone 7 is generally made of a material such as wood, light gauge steel or aluminum to provide for the stringer backbone to be customized for different staircase applications.

FIG. 13 shows the specific dimensions that are distinct for each riser height selection and therefore uniquely define the stringer backbone 7. Dimensions A, B, C and R on stringer backbone 7 are generally constant. Angle X and dimensions W, Y and Z generally change as the riser height changes. Stringer backbone 7 is cut-off at the top end of the final stringer bracket 11 as depicted on end 71 of FIG. 13.

Figure 14A:
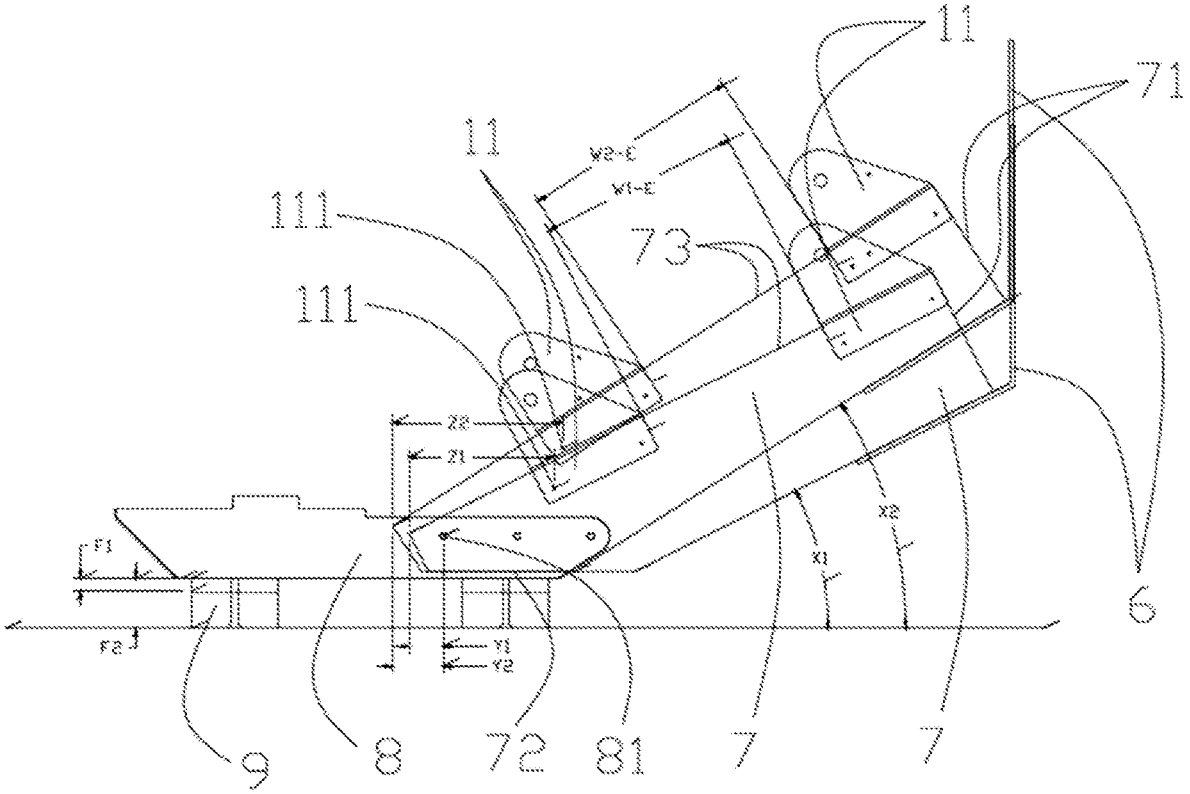
FIG. 14A is a superimposed side view of two stringer assemblies showing positioning differences between various components for two different rise applications.

FIG. 14A depicts two stringer assemblies 200, superimposed based on datum hole 81 with both utilizing a run of 11.75 inches and a distinct rise. Both stringer assemblies are respectful of the IBC code, Rule of 18 and Rule of 25. FIG. 14A illustrates how the slope and positioning of the stringer backbone 7 and locations of stringer brackets 11 will vary as the rise changes.

Changes in tread depth (e.g. as a proxy for stair run) also affect critical dimensions. Tread depth is a defined term in IBC and IRC. Tread depth is also constant for each step of a staircase. The staircase systems described herein can be adapted to work with any tread depth as per dimension D on FIG. 8.

Figure 14B:
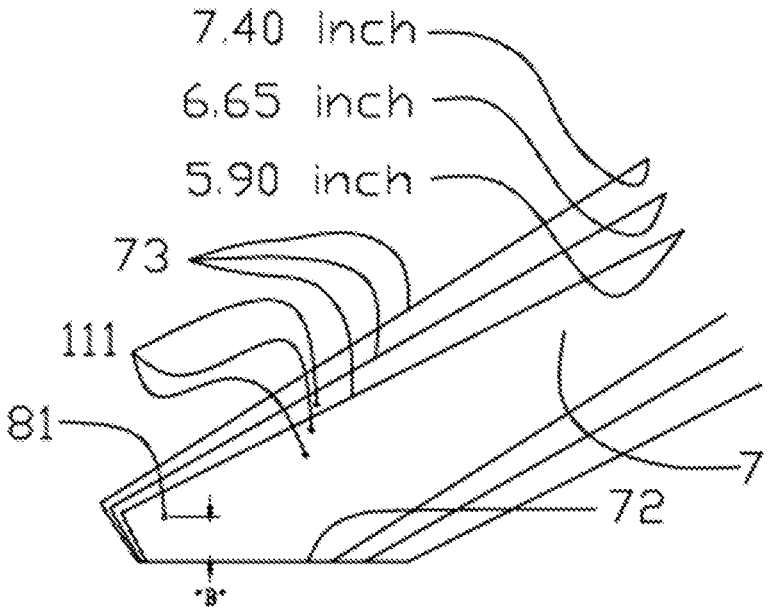
FIG. 14B is another superimposed side view of a portion of two stringer assemblies showing positioning differences between various components for two different rise applications.

FIG. 14B shows a side view of three embodiments of stringer 7, each embodiment having a different stair riser height (e.g. 5.90", 6.65" and 7.40"). The three stringers 7 are shown as being superimposed on one another with each of their base edges 72 sharing a common plane and each having datum hole 81 having a common position.

Figure 14C:
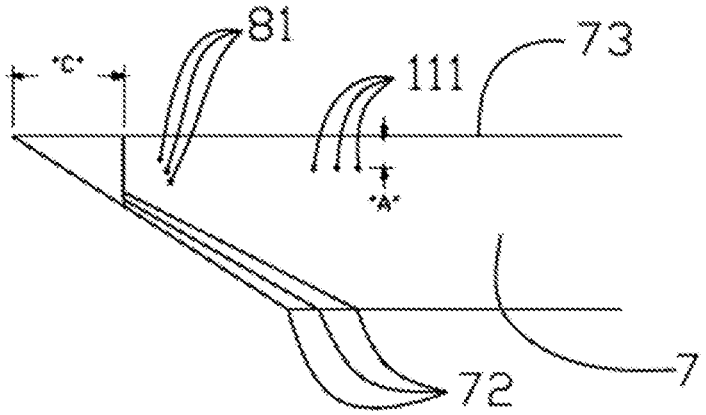
FIG. 14C is another superimposed side view of a portion of two stringer assemblies showing positioning differences between various components for two different rise applications.

FIG. 14C shows a side view of the same three stringers 7 shown in FIG. 14B being superimposed on one another. However, in FIG. 14C, the three stringers 7 are shown as being superimposed on one another with each of their top edges 73 sharing a common plane and with a common dimension "A" of datum hole 111 for coupling stringer bracket 11 and with a common intersection point of top edge 73 and bottom edge 72 of stringer 7 (as identified by dimension C). Orienting the stringers in this manner creates the foundation for building a jig to place the various components in relation to each other as the stair rise changes.

FIGS. 15A through 16L show various views of a first jig 300 and a second jig 400 to be used in assembling staircase systems as described herein having a stair run (e.g. proxy for tread depth) of 11.75 inches. It should be understood that although the embodiment described herein has a tread depth of 11.75 inches, the first jig 300 and second jig 400 may be modified (as described below) for use in assembling staircase systems as described herein.

Figure 15A:
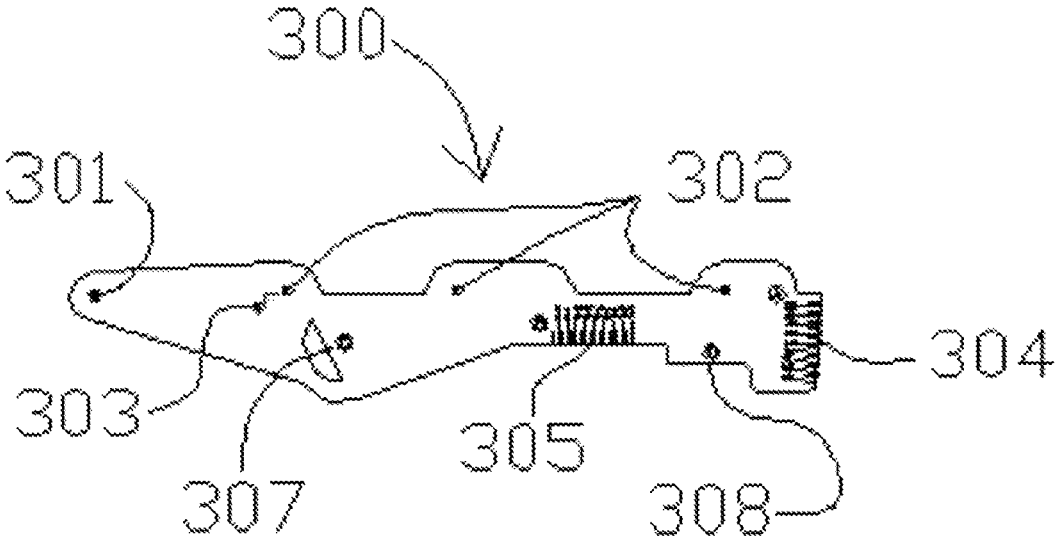
FIGS. 15A and 15B show top and side views of a first jig for use in installing a modular staircase system, according to one embodiment.
Figure 15B:
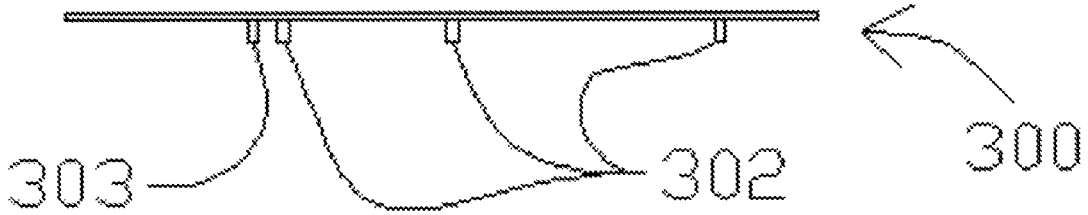
Figure 15C:
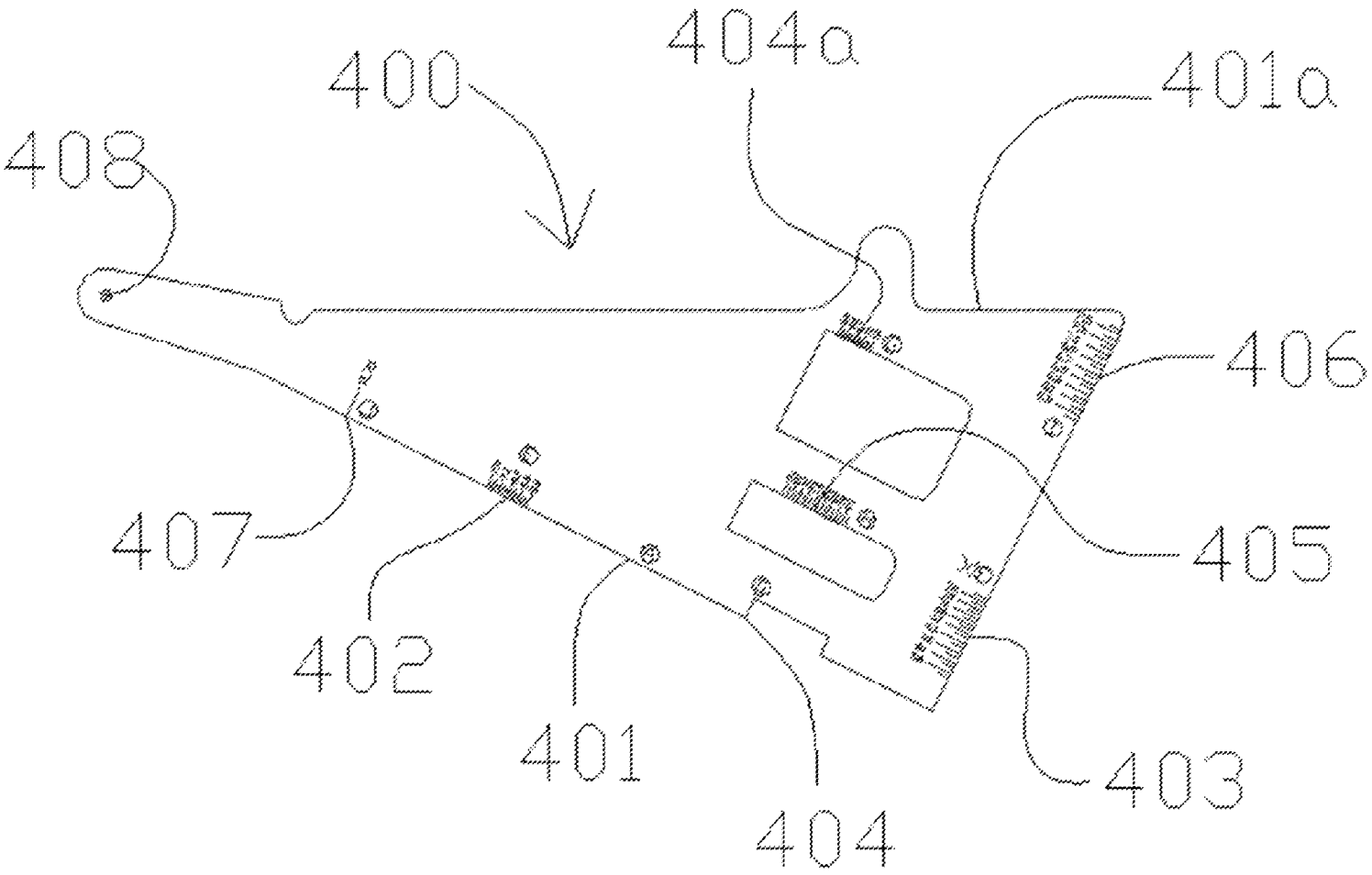
FIG. 15C shows a top view of a second jig for use in installing a modular staircase system, according to one embodiment.

Specifically, FIGS. 15A and 15C show side views of a first jig 300 and a second jig 400, respectively, according to one embodiment. First jig 300 and second jig 400 are configured to include one or more scales that can be used to assemble staircase systems having differing stair riser heights. Herein, a scale is a set of markings located in close proximity on first jig 300 or second jig 400, each marking of the scale representing a measurement between two points on the jig that is used to assemble a stair system having a particular stair rise. For instance, in the embodiments shown in the figures, first jig 300 includes two scales, each scale having a set of markings. The set of markings are used to assemble stair systems that differ by their riser height. The markings labelled "6.65" in each of the first scale 304 and the second scale 305 are collectively used to assemble a stair system having a stair rise height of 6.65 inches. Likewise, the markings labelled "6.95" in each of the first scale 304 and the second scale 305 are collectively used to assemble a stair system having a stair rise height of 6.95 inches.

In the embodiment shown in the figures, the first jig 300 and the second jig 400 are each include more than one scale that is used to assemble stair systems. Each scale has markings representing stair systems that vary 0.05 inch increments of stair rise. Providing one or more scales on the first jig 300 and the second jig 400 for various stair rises simplifies the method of assembling the stair systems described herein by eliminating the need for an installer to perform individual measurements while assembling the stair system. Increments of 0.05 inch have been included because the rounding process from the theoretical rise (+/−0.025 inch) is beyond the required accuracy of the codes and beyond the practical accuracy standard of most contractors.

FIG. 15A is a top view of first jig 300. First jig 300 includes a rotational pin 301 and location pins 302 and 303 for aligning the first jig 300 to a top and a toe of stringer 7. FIG. 15B shows a side view of first jig 300 including rotational pin 301 and location pins 302 and 303 for alignment to top and toe of stringer 7.

As noted above, each scale 304, 305 on the first jig 300 includes a plurality of individual markings on the jig. As shown in FIG. 15A, first jig 300 includes first scale 304 used for setting a slope of stringer 7 for a distinct stair rise and second scale 305 used for setting a location of datum hole 111 of stringer bracket 11. FIG. 15A includes an arc 307 and a line 308 that are used in co-operation with each other to set the location of datum hole 81 of base foot bracket 8.

FIG. 15C is a top view of second jig 400 that includes rotational hole 408 that couples with rotational pin 301 of first jig 300 during use. FIG. 15C also includes the following:

a. Edge 401 and edge 401*a* that are used in conjunction with first scale 304 of first jig 300 to set the slope of stringer 7 for a distinct stair rise.
b. Third scale 402 that is used to determine the length of the spacer required to separating the stringer brackets 11 along the top of the stringer 7, for a distinct stair rise.
c. Fourth scale 403 that is used to determine the height of the foot 9 that is attached to the base foot bracket 8 along the bottom of the stringer 7, for a distinct stair rise.
d. Point 404 and fifth scale 404*a* that is used in conjunction to locate the mounting position of second end 66*b* of bendable stringer hanger bracket 66 along the bottom of the stringer 7, for a distinct stair rise.
e. Sixth scale 405 that is used to locate the vertical mounting position of first end 66*a* of bendable stringer hanger bracket 66 onto upper floor structure 3, for a distinct stair rise.
f. Seventh scale 406 and eighth scale 407 that is used in conjunction to check the rise and run of each step of each stringer assembly 200 after installing the stringer assembly with upper floor structure 3. Eighth scale 407 also defines a run of the first jig 300 and the second jig 400.

Method of Construction and Assembly

Figure 17:
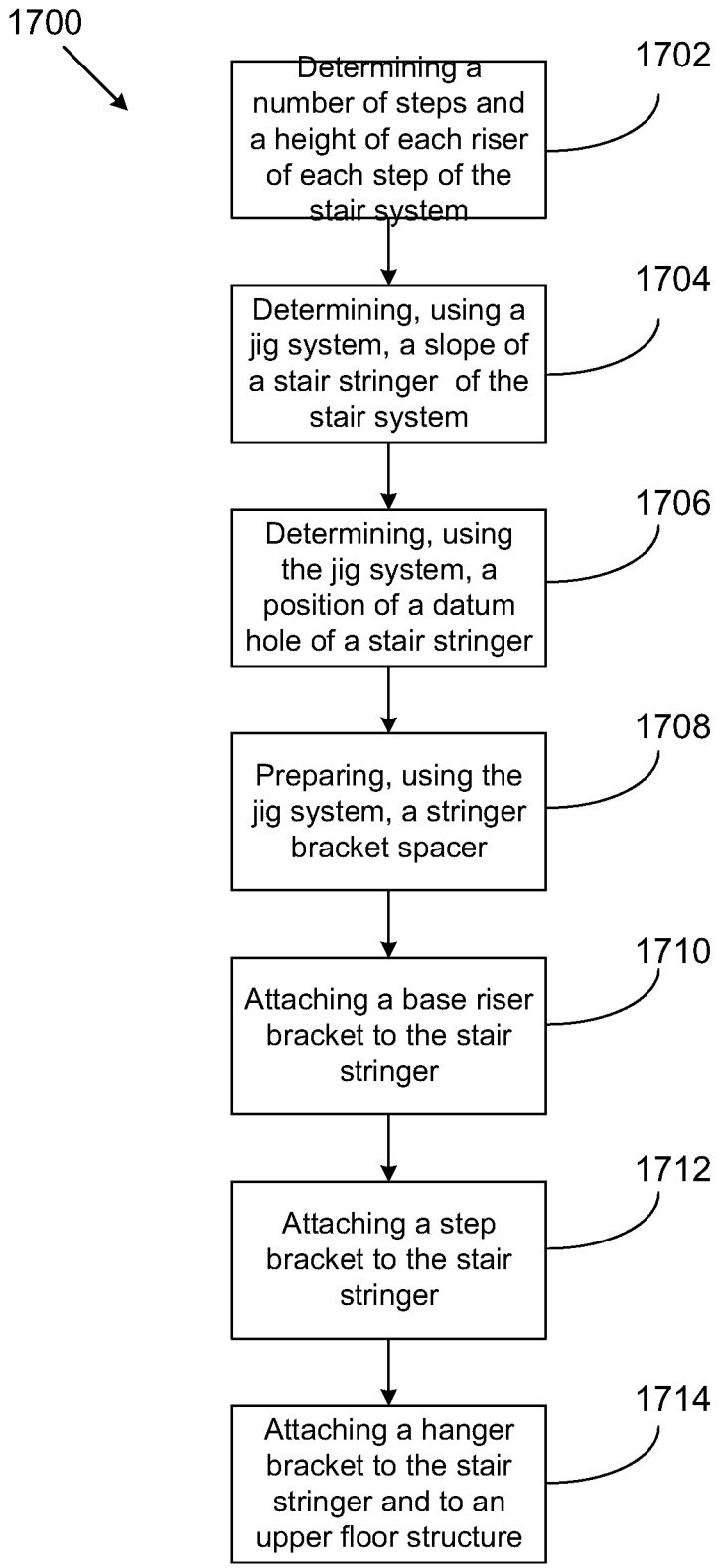
FIG. 17 is a block diagram of a method of assembling a staircase system, according to one embodiment.

FIG. 17 shows a method 1700 of assembling a stair system. At a first step 1702, a number of steps and a height of each step of the stair system is determined. This is done in the following manner:

a) Measure total rise between upper floor 1 and lower floor 2 in inches and divide by 7. Round-up the answer to the nearest whole number (by way of example, if the total distance is 53.25 inches, then 53.25/7=7.61 and therefore the number of steps required is 8)
b) Divide the total rise by the number of risers required (by way of example, 53.25/8=6.66 inches. Round to the nearest 0.05 inch and therefore the height of each riser should be 6.65 inches).

It should be understood that in the following example a 6.65-inch stair rise is used, however, the following steps could be used to assemble a staircase system having any other stair rise.

Figure 16A:
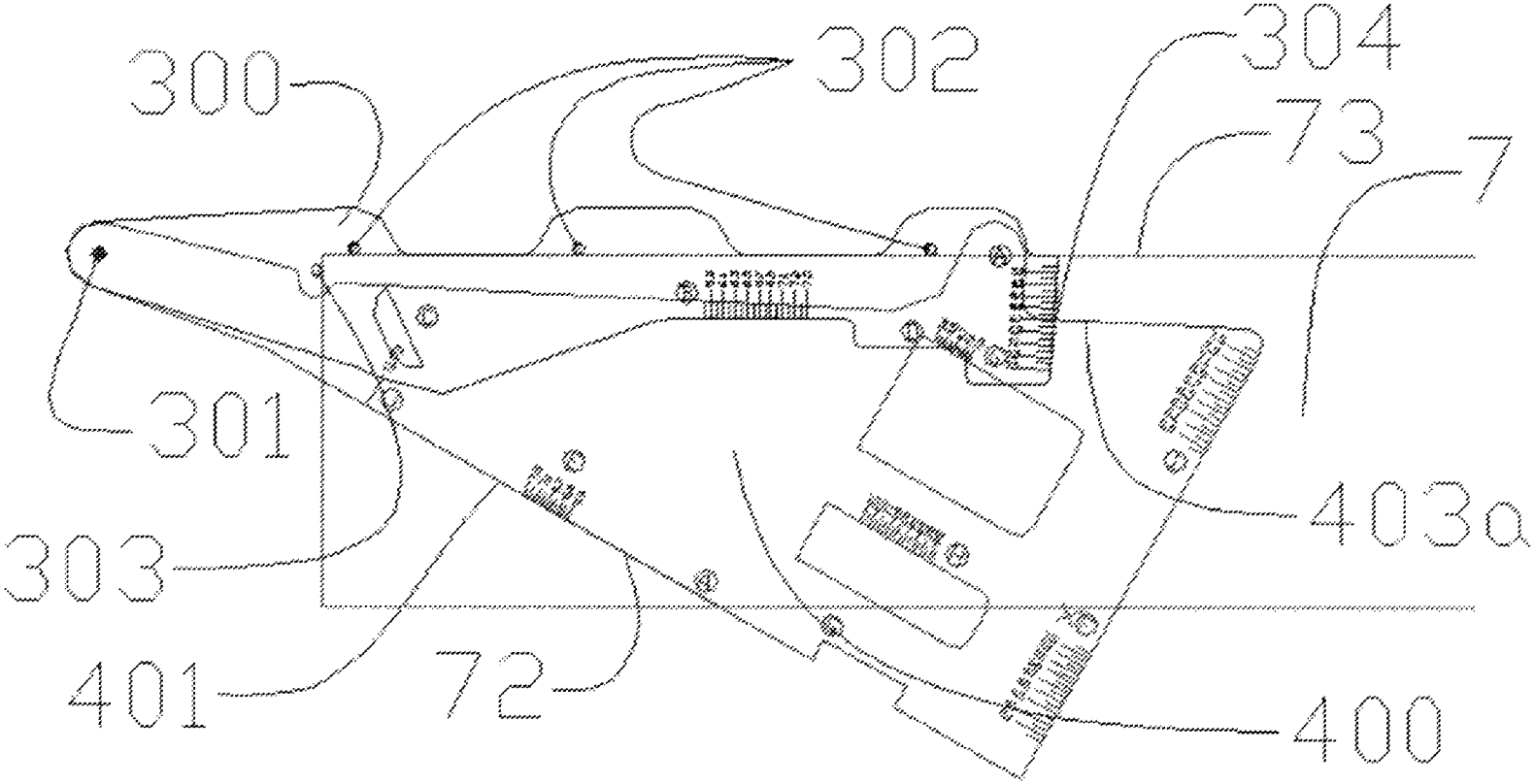
FIGS. 16A to 16K show side views of the first jig shown FIG. 15A or the second jig shown FIG. 15C being used during various steps of a method of assembling a modular staircase system, according to one embodiment.

At step 1704, FIG. 16A shows second jig 400 coupled to first jig 300 by first pin 301 and oriented on stringer 7 so that locator pins 302 and 303 are in contact with the toe and edge 73 of stringer 7. Second jig 400 is rotated around pin 301 so that edge 403*a* aligns with first scale 304 corresponding to the 6.65-inch stair riser scale. Bottom edge 72 of stringer 7 is marked and cut along edge 401 of second jig 400.

Figure 16B:
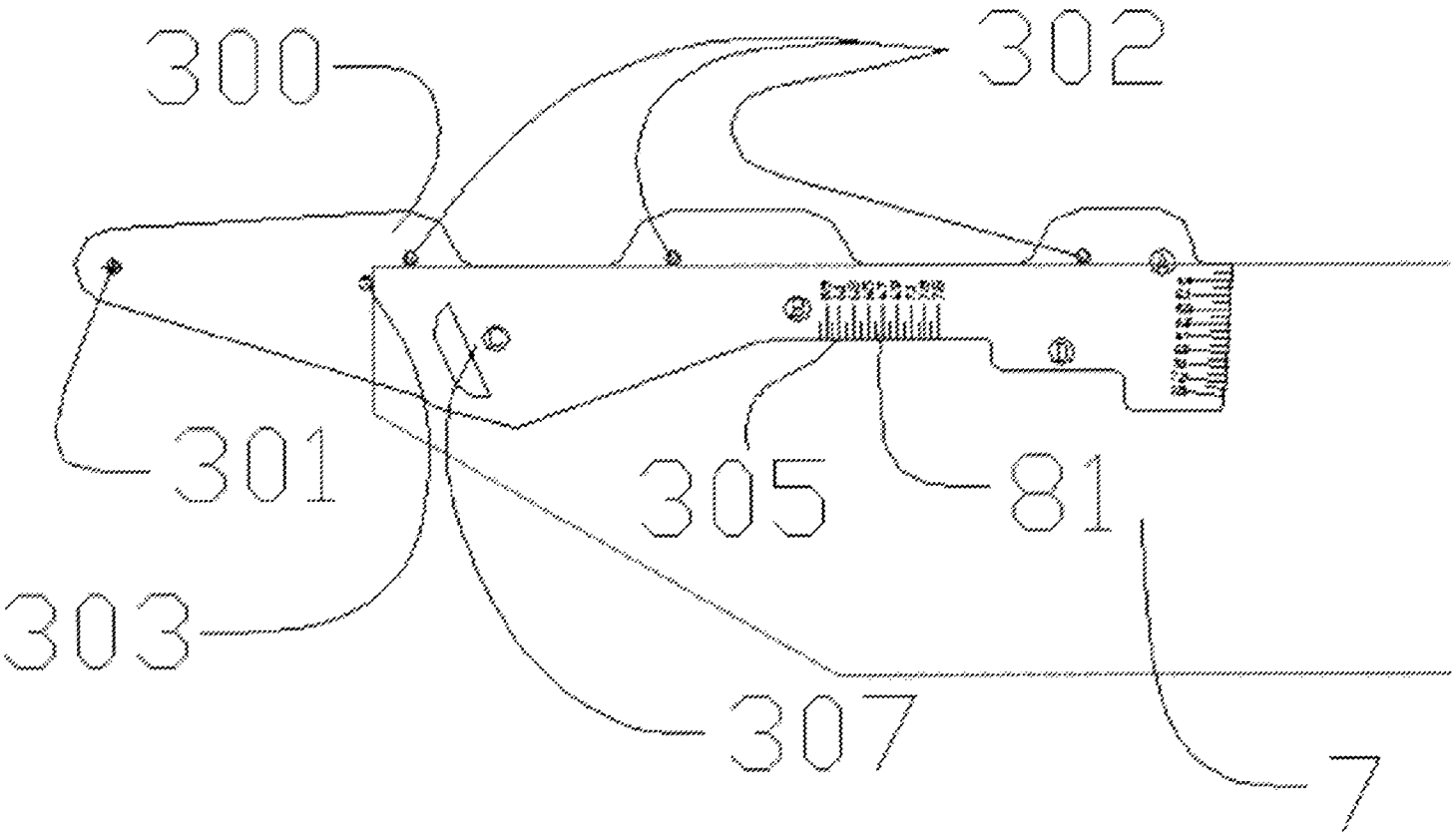

At step 1706, FIG. 16B shows first jig 300 oriented on stringer 7 so that locator pins 302 and 303 are in contact with the toe and edge 73 of stringer 7. Second scale 305 is then used to locate a position of a datum hole 111 of stinger bracket 11 corresponding to the 6.65-inch stair riser scale. Arc 307 is then used to partially locate a position of a datum hole 81 of base riser bracket 8.

Figure 16C:
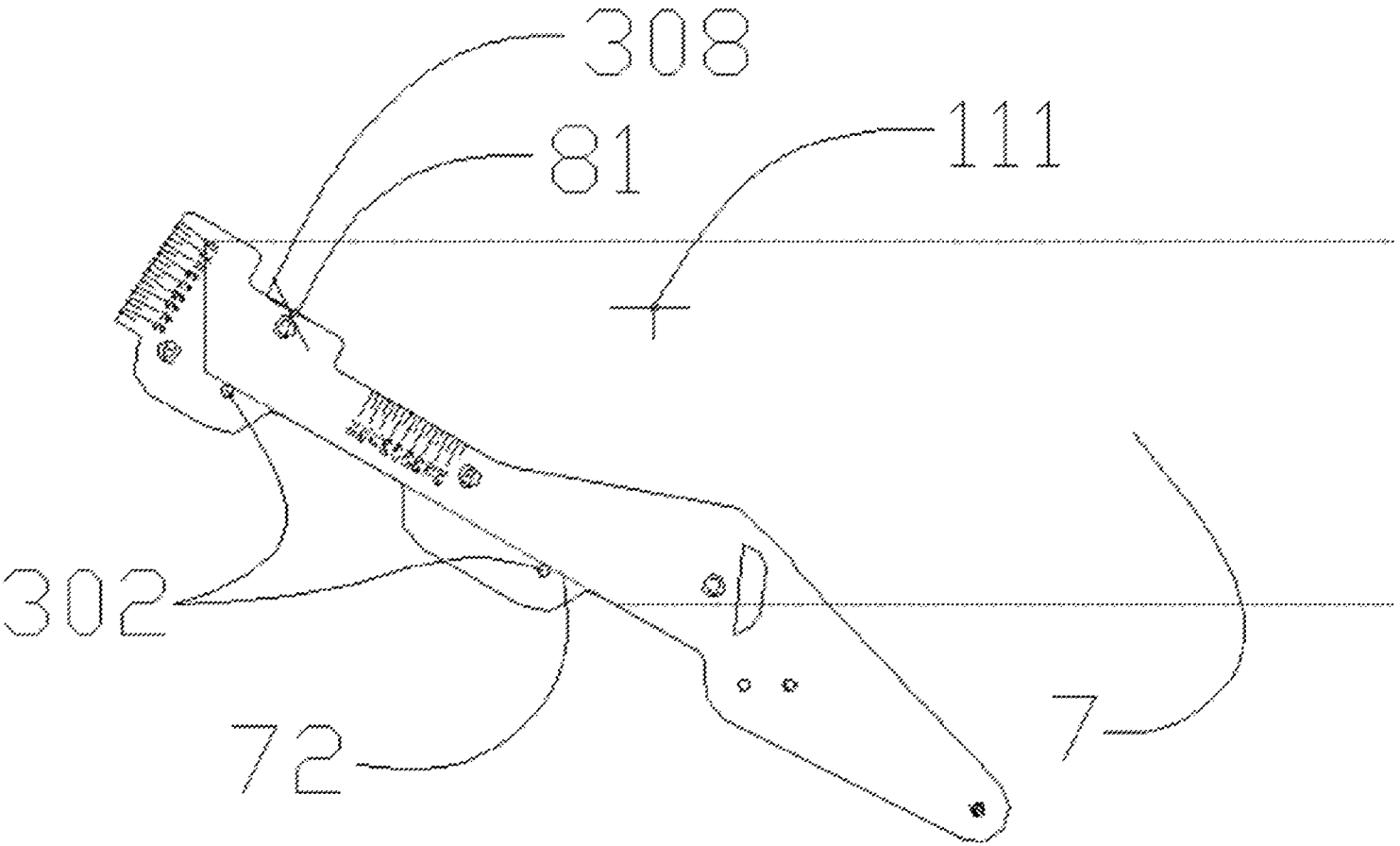

FIG. 16C shows first jig 300 oriented on stringer 7 so that locator pins 302 are in contact with bottom edge 72 of stringer 7. Edge 308 is used to finish locating datum hole 81 of base riser bracket 8.

Datum holes 81 and 111 on stringer 7 are drilled at locations determined using the first jig 300 and the second jig 400.

Figure 16D:
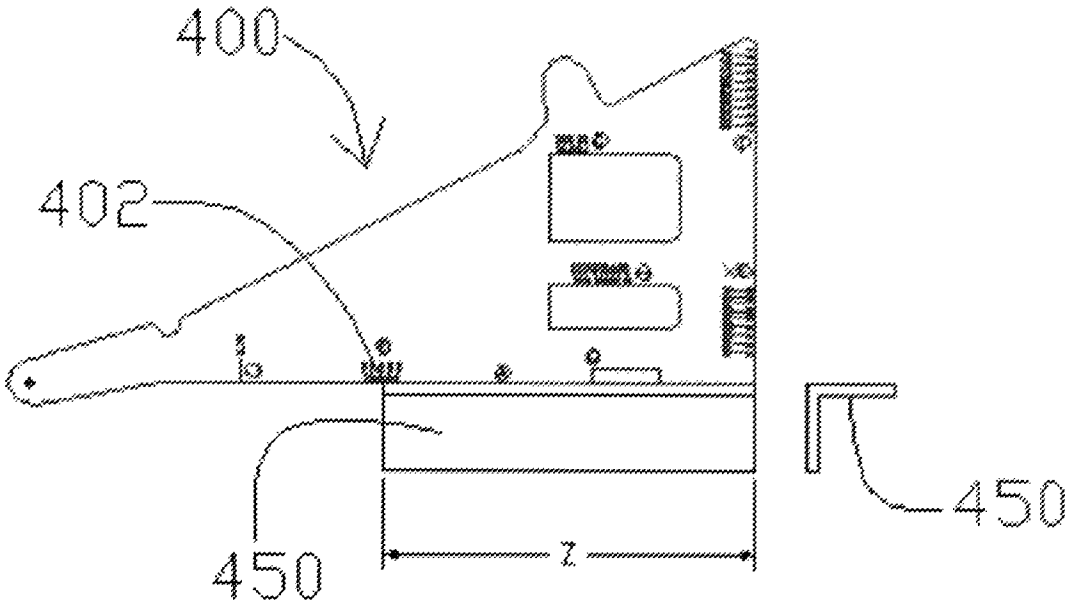

At step 1708, FIG. 16D shows third scale 402 on second jig 400 being used to mark stringer bracket spacer 450 for cutting at a length corresponding to the spacing between stringer brackets 11 for a riser height of 6.65-inches.

Figure 16E:
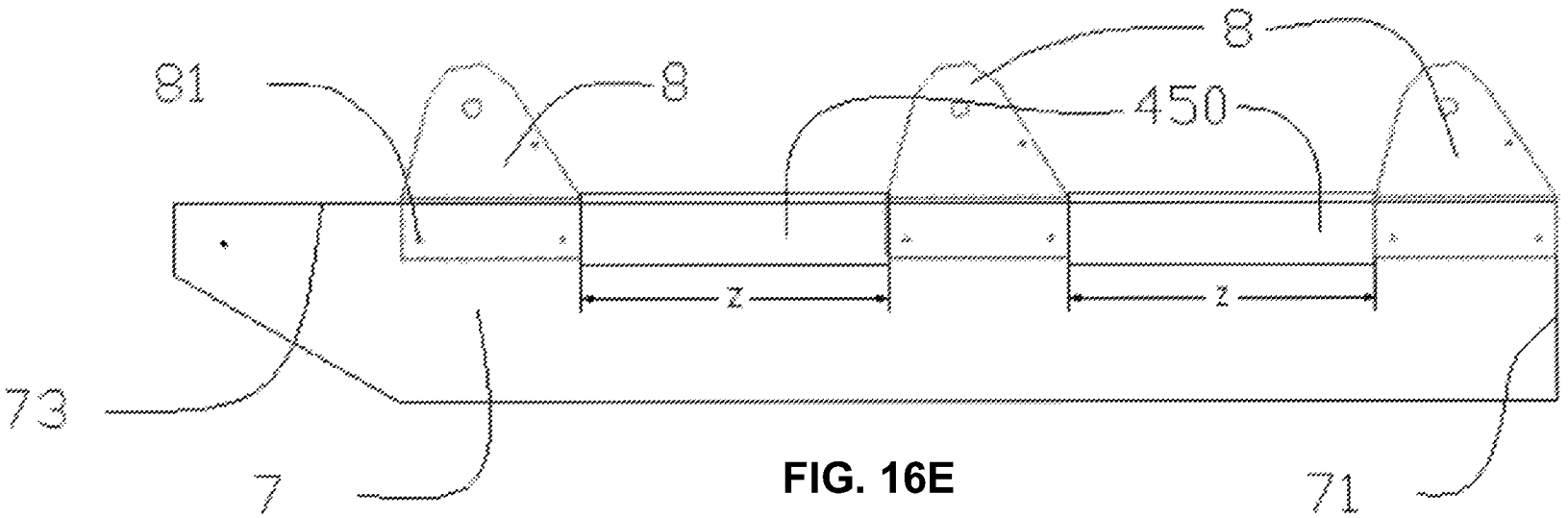

FIG. 16E shows a first stringer bracket 11 (e.g. a lowermost stringer bracket 11) located on edge 73 of stringer 7 at datum hole 81 location. Subsequent stringer brackets 11 are spaced apart from other stringer brackets 11 by a distance Z measured using stringer bracket spacer 450. At the top end of the stringer 7, the stringer 7 is cut perpendicular to edge 73 at final overall length at edge 71.

Figure 16F:
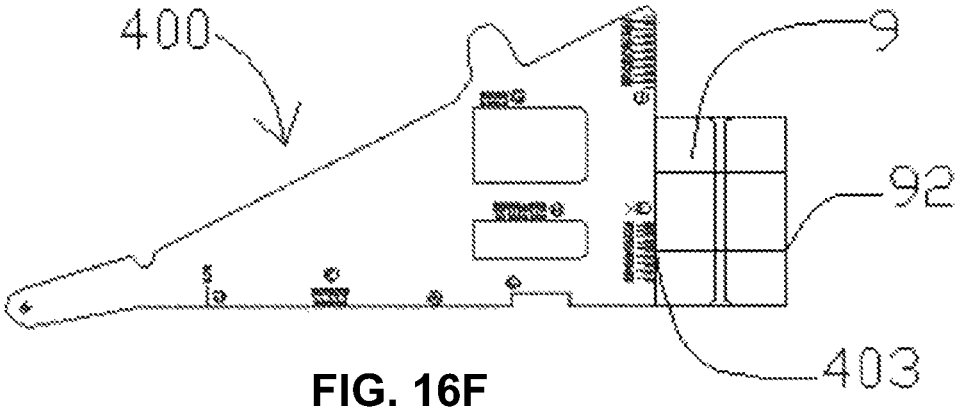

At step 1710, base riser bracket 8 is attached to stringer 7. FIG. 16F shows fourth scale 403 on second jig 400 being used to determine a cut line 92 on double ended foot 9 at a length corresponding to a riser height of 6.65-inches.

Figure 16G:
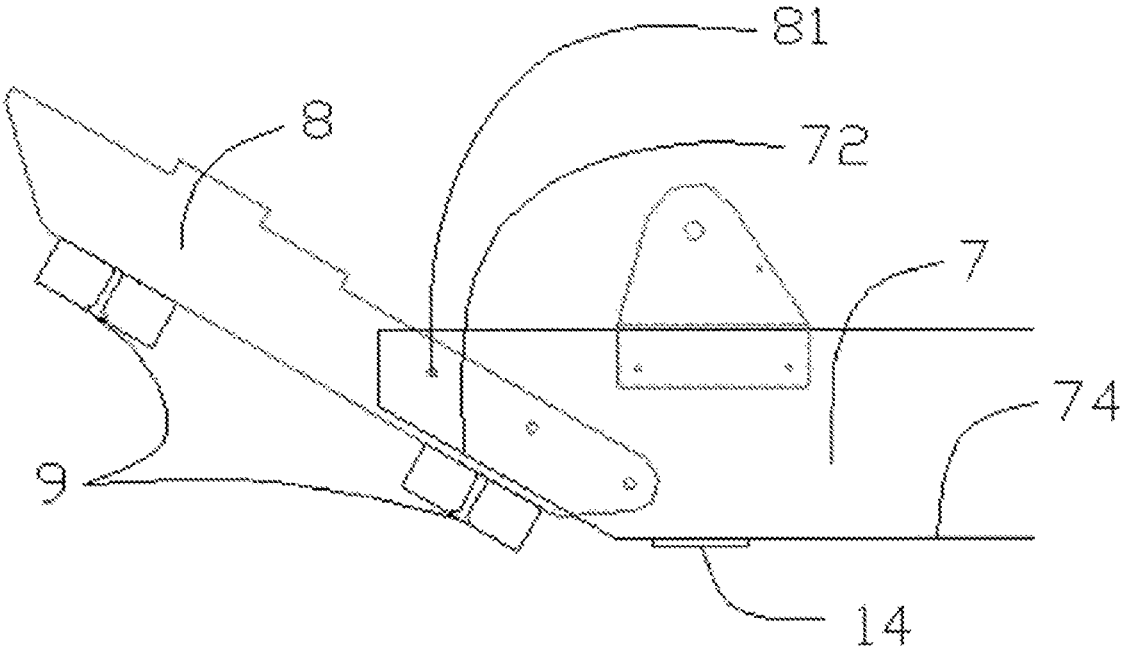

FIG. 16G shows a base riser bracket 8 being attached to stringer 7 along bottom edge 72 at datum hole 81. FIG. 16G also shows spacer 14 being attached along edge 74 of stringer 7 near the bottom edge 72. Finally, FIG. 16G shows feet 9 attached to the base riser bracket 8 at holes provided in bottom face of the base riser bracket 8.

Figure 16H:
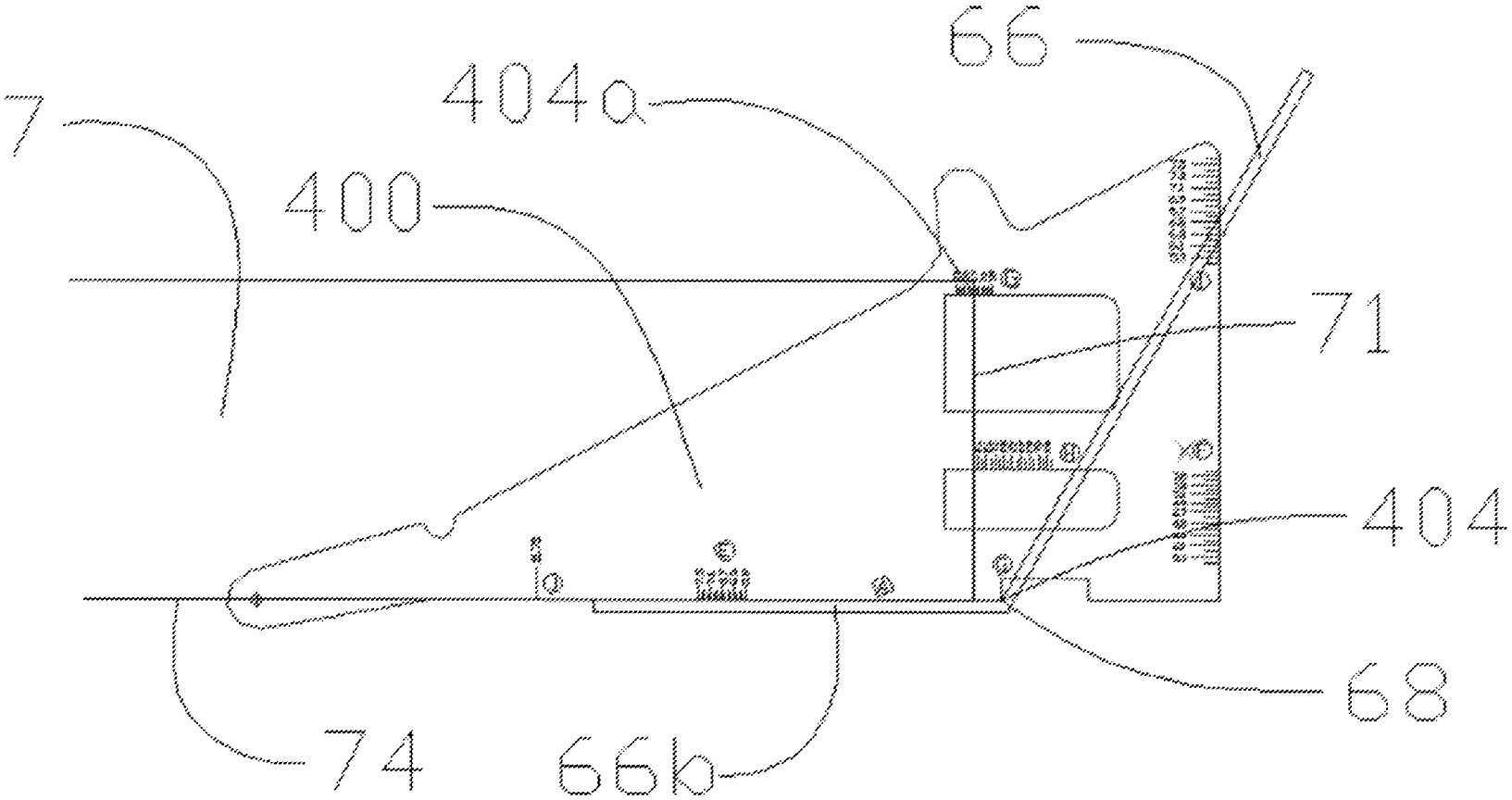

FIG. 16H shows fifth scale 404*a* of second jig 400 aligned to edge 71 of stringer 7 when end 66*b* of hanger bracket 66 is coplanar with stringer 7 along edge 74. Further, FIG. 16H shows point 404 on second jig 400 being aligned with bend line 68 of bendable bracket 66 in order to mount bendable bracket 66 to stringer 7 at a location corresponding to a riser height of 6.65-inches.

Figure 16I:
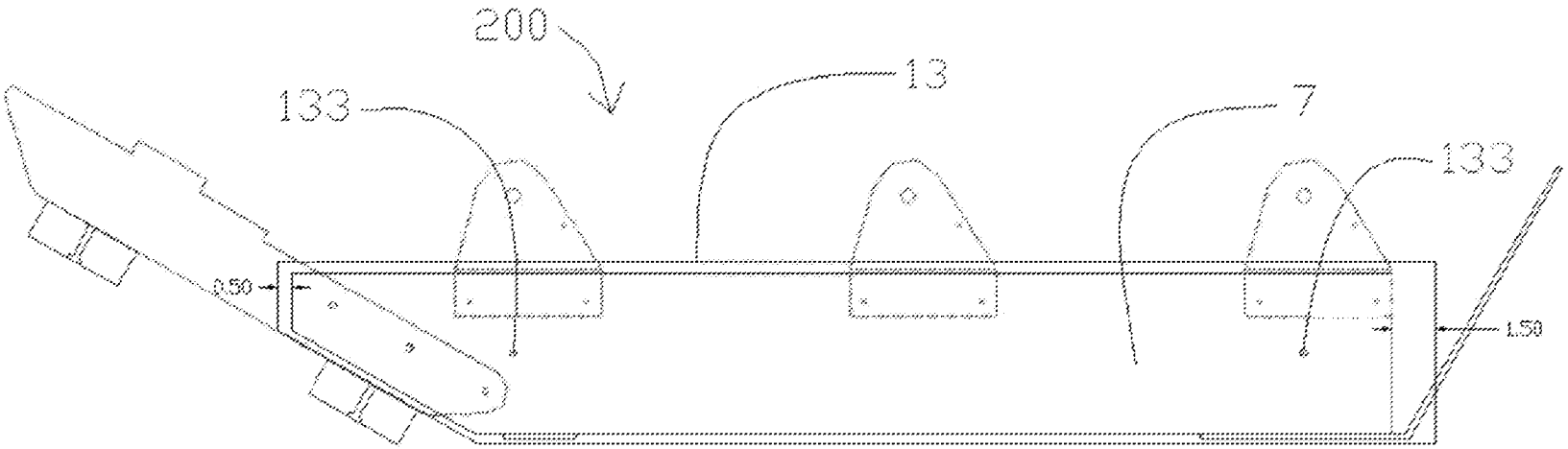

FIG. 16I shows the stringer assembly 200 being completed by installing cover 13 on both sides of stringer 7 by screws at mounting holes 133.

Figure 16J:
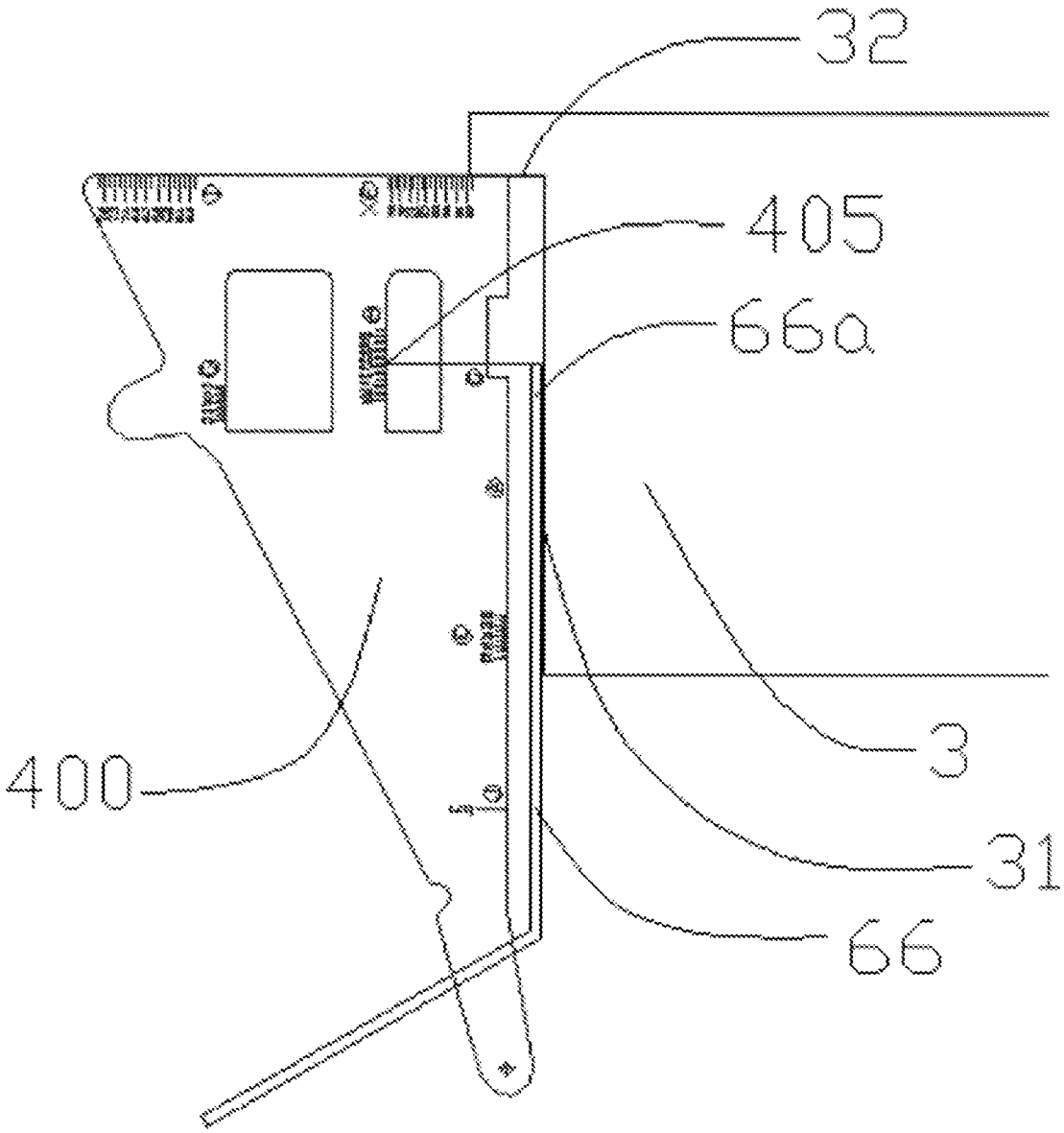

FIG. 16J shows second jig 400 aligned against front face 31 and datum edge 32 of upper floor structure 3, to determine a vertical mounting location of end 66*a* of hanger bracket 66. The mounting location corresponds to a point on front face 31 aligned with a sixth indicator 405 of second jig 400 corresponding to a riser height of 6.65 inches when second jig 400 abuts front face 31 and datum edge 32 of upper floor structure 3.

All stinger assemblies 200 are constructed and installed in a similar manner as outlined above.

Figure 16K:
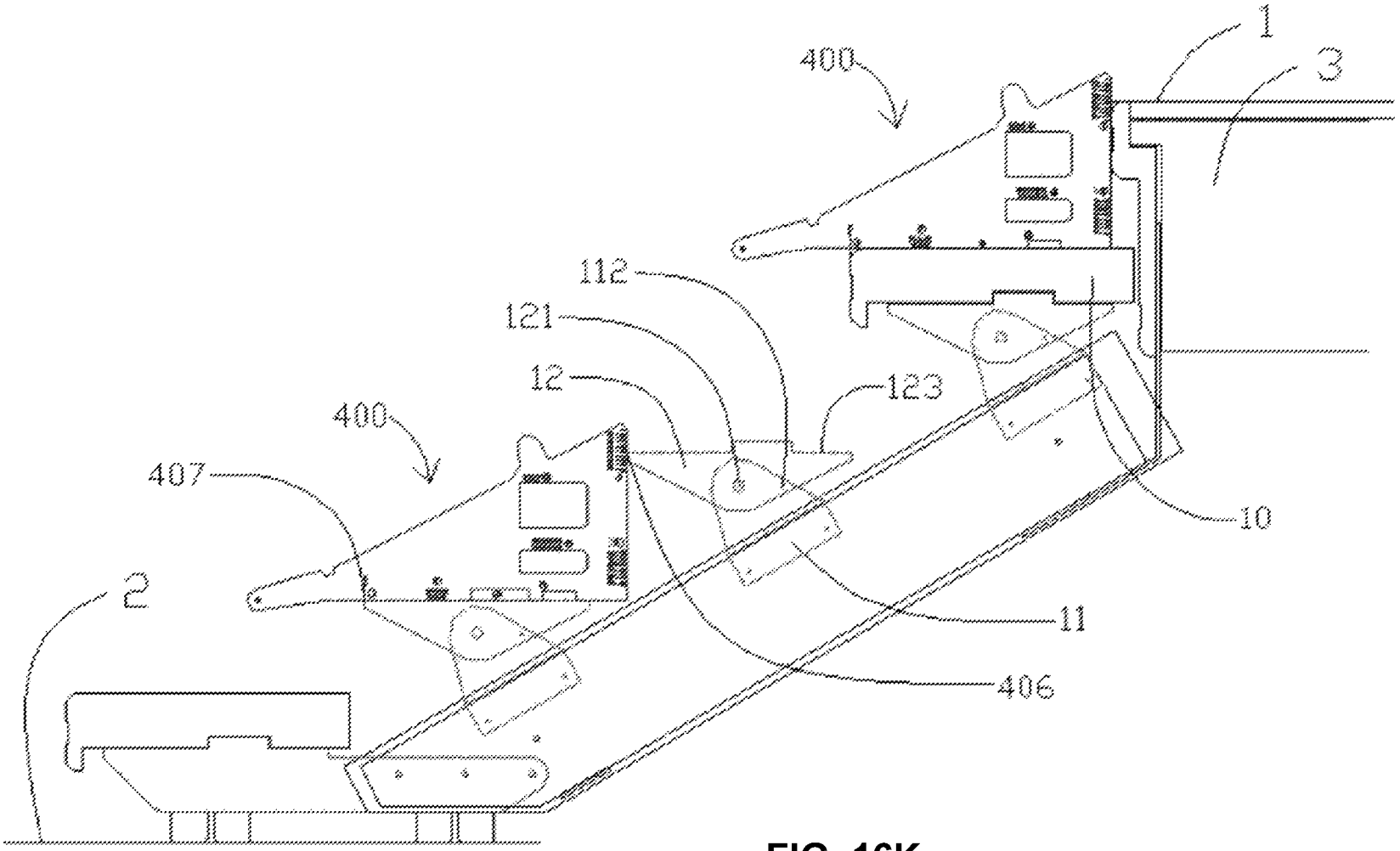

FIG. 16K shows a plurality of step brackets 12 having been attached to stringer brackets 8, each at a rotation point 121 when level and parallel to floors 1 and 2. Further, each step bracket 12 is locked in position with stringer bracket 8 by a locking bolt at hole 112.

FIG. 16K also shows seventh scale 406 of second jig 400 being used to check the rise of each step (before and after installation of step tread 10). Lastly, FIG. 16K shows seventh scale 405 of second jig 400 being used to check the run of each step (before and after installation of step tread 10). This is the final step of the construction and assembly process.

Figure 18A:
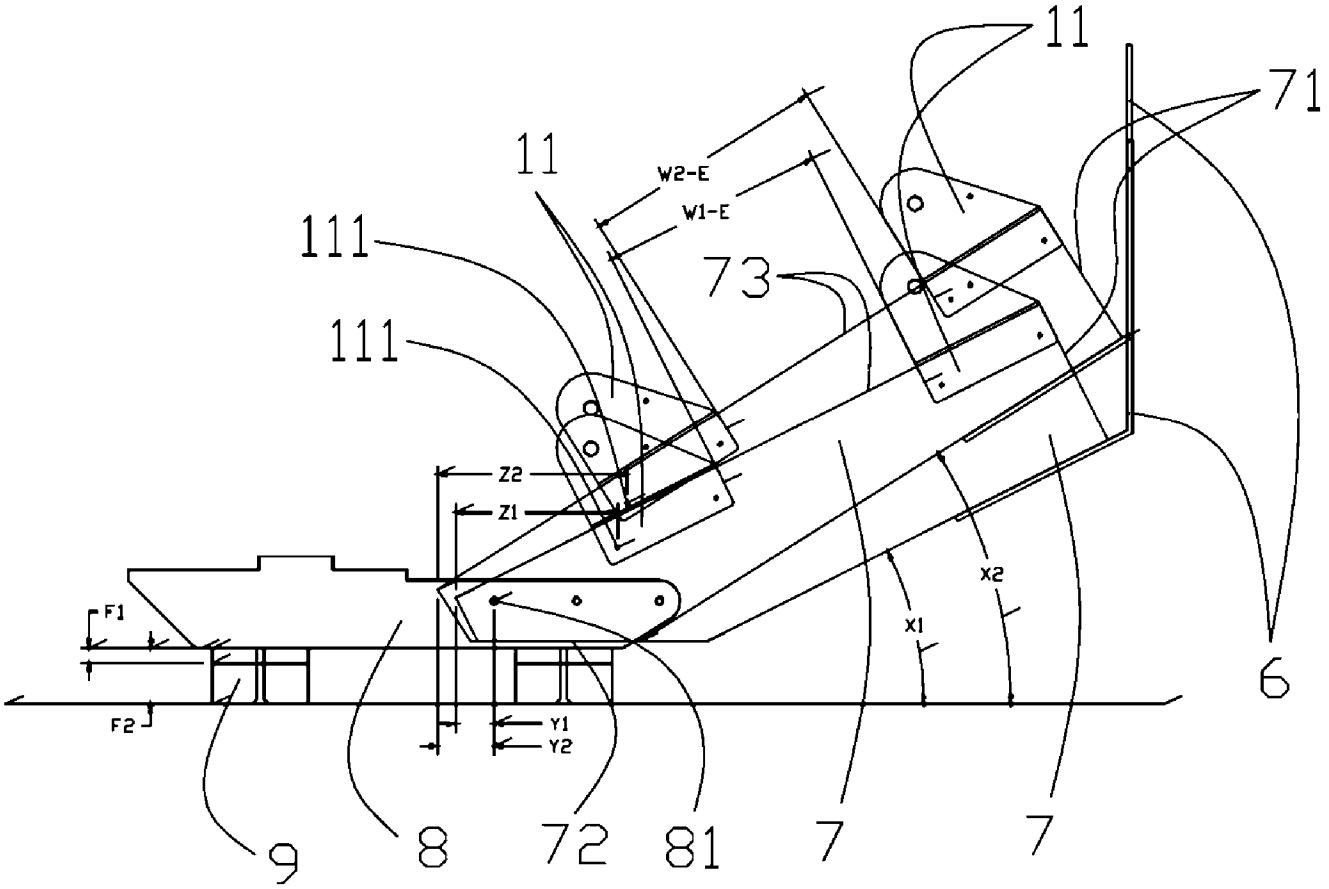
FIG. 18A is a side view of a stair assembly of FIG. 1 showing the limits of the Rule of 18 and the Rule of 25 with a fixed run of 11.75 inches and a variable rise ranging between 5.90 and 7.40 inches.
Figure 18B:
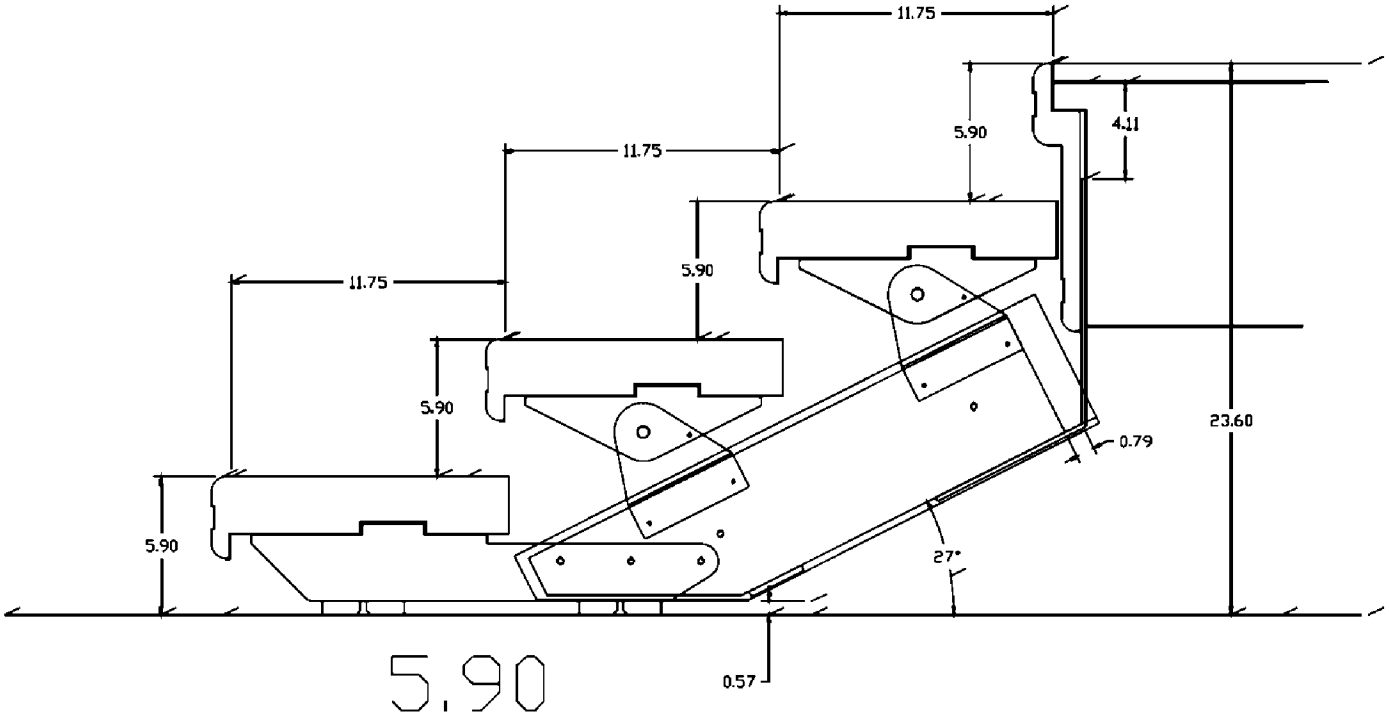
FIG. 18B is a side view of a stair assembly of FIG. 1 showing a code compliant staircase that respects the Rule of 18 and the Rule of 25 with a fixed run of 11.75 inches and a rise of 5.90 inches.
Figure 18C:
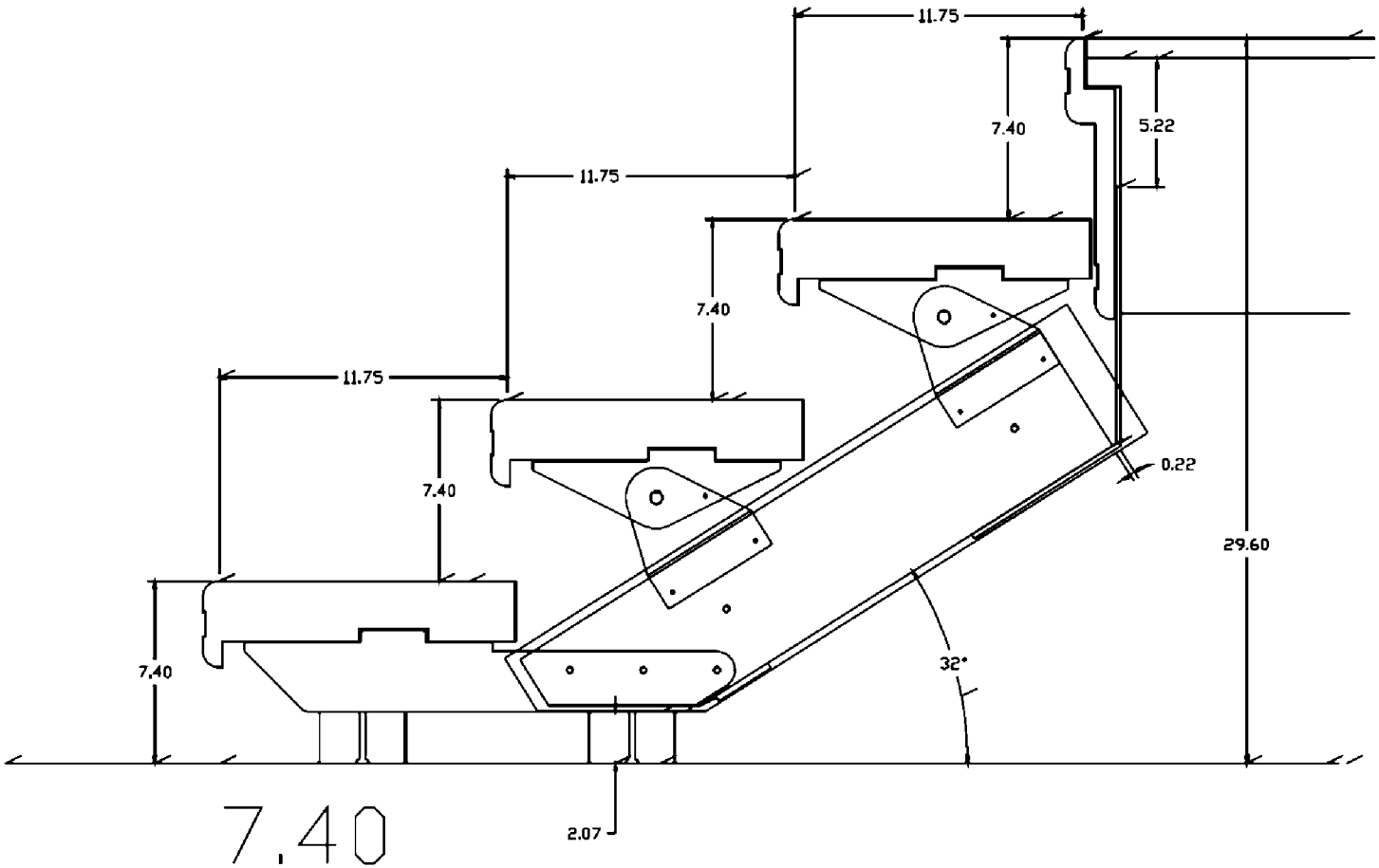
FIG. 18C is a side view of a stair assembly of FIG. 1 showing a code compliant staircase that respects the Rule of 18 and the Rule of 25 with a fixed run of 11.75 inches and a rise of 7.40 inches.

FIGS. 18A and 18B depict two three-riser stair systems built in accordance with an embodiment described herein, both utilizing a run of 11.75 inches and being respectful of the IBC code, Rule of 18 and Rule of 25. The differences between the two stair systems show the practical limits of respecting the Rule of 18 and Rule of 25, that being a range of rise between 5.90 inches and 7.40 inches. This results in a backbone stringer slope ranging between 26.7 degrees and 32.2 degrees. The foot 9 dimension varies between 0.50 inches and 2.00 inches and the stringer hanger 5 offset ranges between 3.75 and 5.60 inches.

Figure 19A:
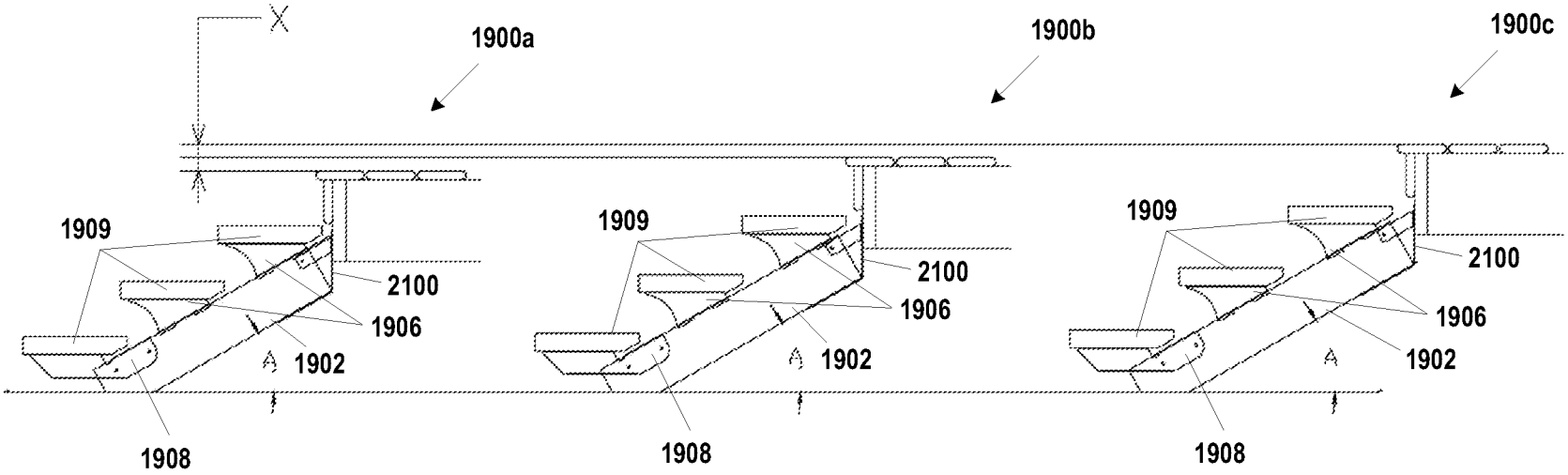
FIG. 19A shows a side view of three staircases having stair stringers with the same slope, the treads of each staircase having a rise and a run that varies from the rise and the run of the other two staircases, each staircase constructed using a specific jig according to one embodiment described herein.

Turning to FIG. 19A, staircases 1900*a*, 1900*b* and 1900*c* shown therein are examples of staircases having a fixed slope that can be constructed using the systems described herein. Staircases 1900*a*, 1900*b* and 1900*c* show a range of rises that can be accommodated by the systems described herein. Staircases 1900*a*, 1900*b* and 1900*c* are each configured to be code compliant (i.e. 2015 International Residential Code (IRC)) and follow the common comfort rules for staircases introduced above.

Staircases 1900*a*, 1900*b* and 1900*c* each include a system including a hanger bracket 2101, two tread support structures 1906 and a base tread support structure 1908, however, it should be understood that staircases having systems with component parts to provide the staircase with more or less treads than is shown in these examples can be constructed using the systems described herein. For instance, the systems described herein may be used to mark a lower cut line on a stringer and/or mark an upper cut line on the stringer. Further, it should be understood that systems described herein may be used to construct staircases having one tread, two treads and/or more than two treads. In some embodiments, systems described herein may be particularly effective at constructing staircases having more than three treads.

Staircases 1900*a*, 1900*b* and 1900*c* each have a stair stringer 1902 having a slope of angle A. The component parts of the systems used to construct the fixed slope staircase systems (e.g. hanger bracket 2100, tread support structure 1906 and base tread support structure 1908) may not adapt to provide for the stair stringers 1902*a*, 1902*b* and 1902*c* of the staircases 1900*a*, 1900*b* and 1900*c*, respectively, to have a slope other than a pre-determined slope. The pre-determined slope of staircases 1900*a*, 1900*b* and 1900*c* is defined by a jig that is used to construct the staircases 1900*a*, 1900*b* and 1900*c*. In some embodiments, the slope A of the stair stringers 1902*a*, 1902*b* and 1902*c* may be in a range to provide for common staircases, such as staircases having a rise of each tread in a range of about 4.0 inches to about 8.0 inches and a run in a range of about 8 inches to about 12 inches. In some embodiments, the slope A of the stair stringers 1902*a*, 1902*b* and 1902*c* may be in a range of about 10 degrees to about 40 degrees. In some embodiments, the slopes of the stringer may be in a range of about 26 degrees to about 36 degrees, or in a range of about 29 degrees to 34 degrees, with a rise in a range of about 5.90 inches to about 7.40 inches, or in a range of about 6.15 inches to about 7.55 inches. As shown in FIG. 19A, the treads 1909*a*, 1909*b* and 1909*c* of the staircase 1900*a*, the treads 1909*a*, 1909*b* and 1909*c* of the staircase 1900*b* and the treads 1909*a*, 1909*b* and 1909*c* of the staircase 1900*c* have different rises as the total rise of each of the staircases 1900*a*, 1900*b* and 1900*c* varies. The potential range of the rise of each tread of a staircase having a fixed common slope described herein may be approximately 0.70 inches.

Figure 19C:
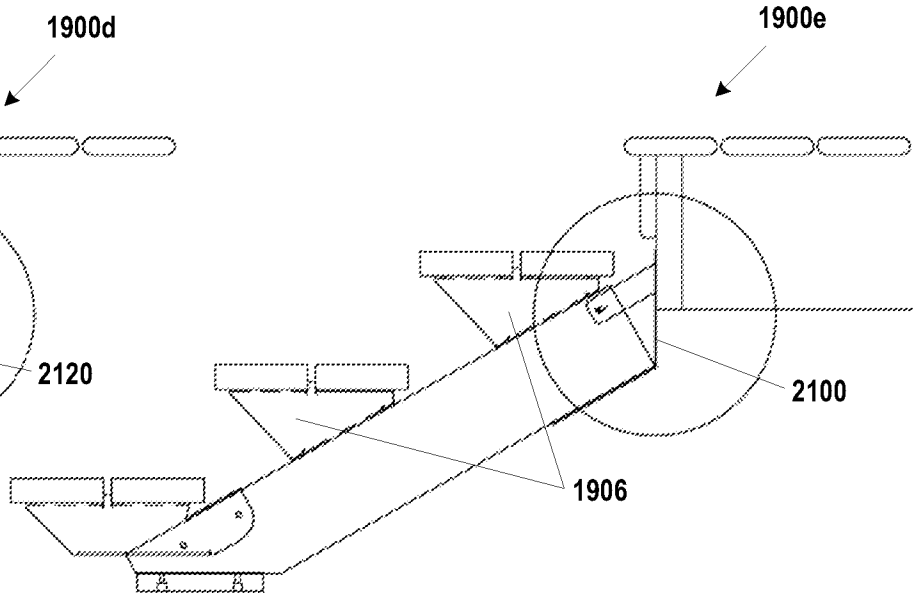
FIG. 19C shows a side view of a staircase having a stair stringer with a fixed slope, an upper end of the stair stringer cut to be square to a top edge of the stair stringer and utilizing a hanger bracket that incorporates a lateral support member, according to one embodiment described herein.
Figure 19B:
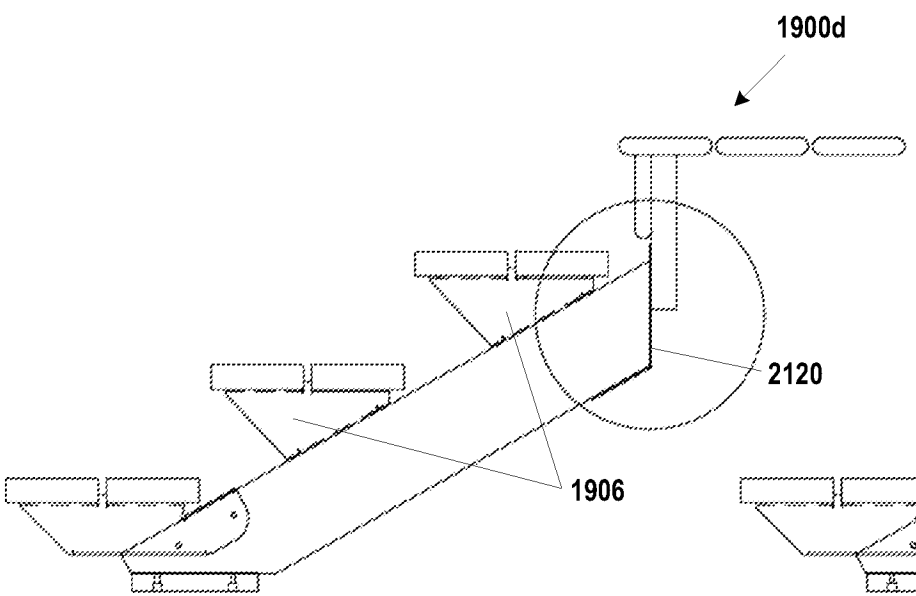
FIG. 19B shows a side view of a staircase having a stair stringer with a fixed slope and an upper end cut to be flush with a hanger bracket, according to one embodiment described herein.

As noted above, staircases 1900*a*, 1900*b* and 1900*c* each include at least one hanger bracket 2100 to couple the stair stringer 1902 to an upper floor. One embodiment of a hanger bracket 2100 for use in the staircase systems described herein is shown in FIG. 19A, however, it should be understood that the staircase systems described herein can include other embodiments of hanger brackets. For example, as shown in FIG. 19B, staircase 1900*d* includes a hanger bracket 2120 that does not include a lateral support member. Rather, the stair stringer of 1900*d* is cut on an angle such that an upper end surface the stair stringer is flush with a mounting portion of the hanger bracket 2120. FIG. 19C shows another embodiment of a staircase 1900*e* with a hanger bracket 2100.

Herein, the term "tread support structure" refers to a structure including one or more component parts that supports a tread of a staircase on a stair stringer of a staircase. In some embodiments, the tread support structures described herein comprise a single component. In other embodiments, tread support structures described herein include two components. In some embodiments, these two components may be a tread bracket and a support bracket.

Each tread support structure described herein couples a tread of a staircase to a respective stair stringer. Each tread support structure described herein is configured to provide for the tread to be parallel to a lower floor underlying the staircase and/or to be parallel to an upper floor above the staircase when coupled to a stair stringer. In FIGS. 19A-19C, each staircase shown therein includes two tread support structures 1906 that are shown dispersed along a stair stringer 1902. In some embodiments, the tread support structures 1906 can be used to couple any tread of a staircase to a stair stringer. In other embodiments, the tread support structures 1906 can be used to couple any tread of a staircase to a stair stringer other than a lowermost tread of the staircase. In other embodiments, the tread support structures 1906 can be used to couple any tread of a staircase to a stair stringer other than an uppermost tread of the staircase. It should be understood that the tread support structures described herein are generally a connection point between each tread and the stair stringer. In embodiments where the stair stringer is made of wood, the strength of the wood is a factor in determining how the tread support structure couples to the stair stringer. Specifically, the size of a base of the tread support structure and how the tread support structure couples to the stair stringer is determined by the strength of the material that forms the stair stringer.

The tread support structures described herein include a base that is configured to slidably engage a top surface of a stair stringer. In this manner, the tread support structures described herein can slide along a length of a stair stringer, such as along a top surface of the stair stringer, to a position that, when the tread support structure is mounted to the top surface of the stair stringer, provides for a staircase to be code compliant and follow the common comfort rules. The tread support structure base can be configured to engage various different types of stair stringers, including but not limited to stair stringers made from materials such as pressure-tread wood, extruded aluminum, steel tube and the like. The tread support structure top flange can be configured to engage different types of tread configurations. The tread support structure can be constructed of various structural materials and be created with various technologies such as forming, casting, extruding, fabricating, etc.

FIGS. 20A to 20D show one embodiment of a tread support structure 1906 of a system for a staircase having a fixed slope. In the embodiment shown in FIGS. 20A to 20D, tread support structure 1906 includes three base portions 1902*a*, 1902*b* and 1902*c* (see specifically FIG. 20C) that co-operate to form the base of the tread support structure. Each of the base portions 1902*a*, 1902*b* and 1902*c* are configured to slidably engage a top edge of a stair stringer to provide for the tread support structure 1906 to be positioned anywhere along the top edge of the stair to support a tread on the stair stringer. Base portions 1902*a*, 1902*b* and 1902*c* may each include one or more apertures 1903 for receiving a fastener for mounting the tread support structure 1906 to the stair stringer.

Figure 20A:
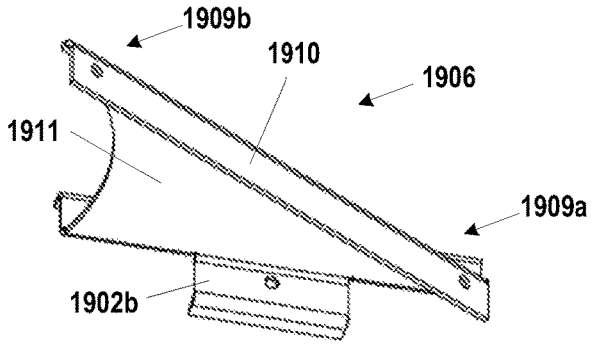
FIGS. 20A to 20D show an upper perspective view from an inner side, an upper perspective view from an outer side, a bottom view and a side view, respectively, of a tread support structure of the staircases of FIGS. 19A to 19C, according to one embodiment described herein.
Figure 20B:
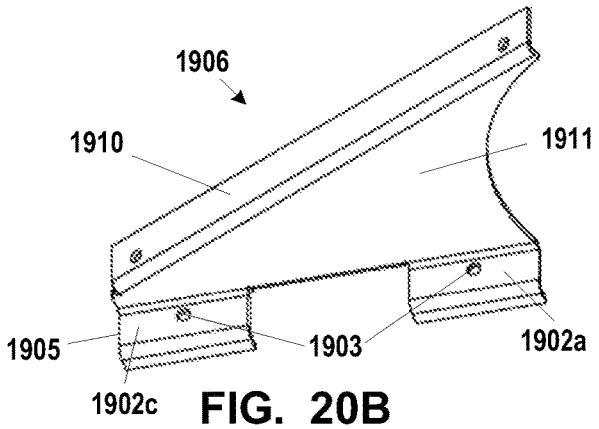
Figure 20C:
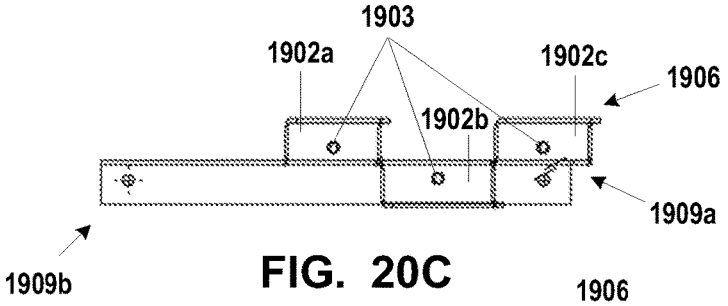
Figure 20D:
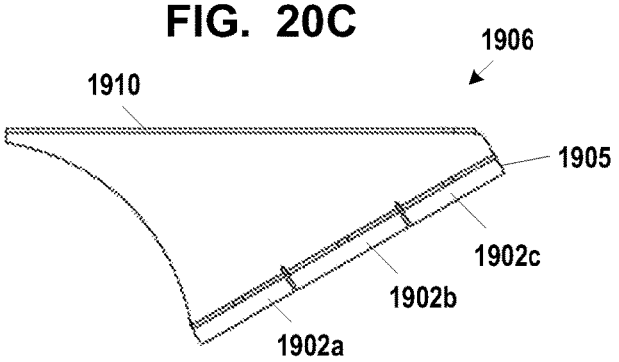

Referring specifically to FIG. 20B, base 1902 includes a feature 1905 for positioning the tread support structure 1906 on the stair stringer. For instance, in the embodiment shown, feature 1905 is an outer edge of base portion 1902*c*. As will be described in greater below, a jig of the systems described herein is configured to provide a mounting position of the tread support structure 1906 on the stair stringer when preparing the stair stringer. Feature 1905 of the tread support structure 1906 is then aligned at the mounting position provided by the jig for preparing the stair stringer.

The tread support structures described herein also includes an extending member extending away from the base. In FIGS. 20A and 20B, extending member 1911 is shown as having a variable height along its length (e.g. its height increases linearly along its length from a top end 1909*a* to a bottom end 1909*b* of the tread support structure 1906) to provide for a tread supported by the tread support structure 1906 to be level.

The tread support structures described herein also includes a flange extending away from the extending member to receive a tread. In the embodiment shown in FIGS. 20A to 20D, flange 1910 is shown extending away from the extending member 1911 to receive a tread. Flange 1910 can be configured to receive different styles of treads for different applications. For instance, in some embodiments, flange 1910 can be planar to provide a flat surface for supporting a tread. In other embodiments, flange 1910 can include upwardly extending portions that space apart two narrow planks that combine to create full treads received on the flange 1910. Top flange 1910 can be configured in many ways to act as a receiver for a tread that can be configured for several applications.

Figure 20E:
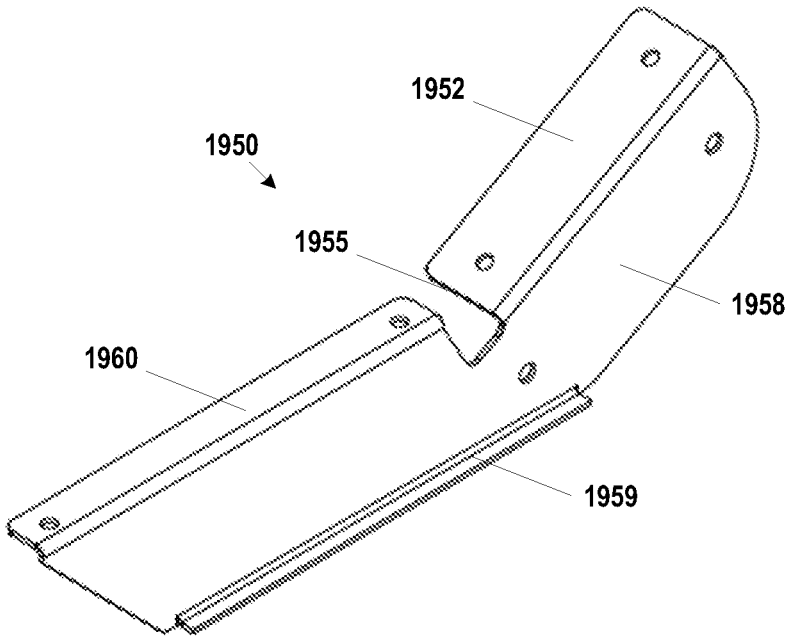
FIGS. 20E to 20G show perspective, top and side views, respectively, of a base tread support bracket of the staircases of FIGS. 19A to 19C, according to one embodiment described herein.
Figure 20F:
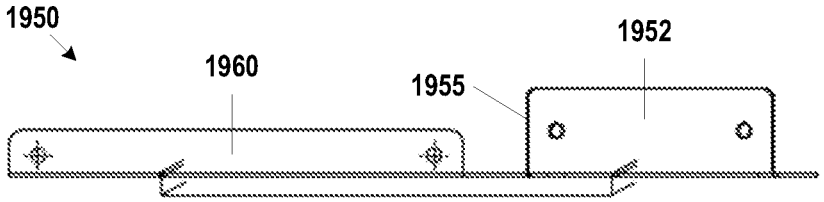
Figure 20G:
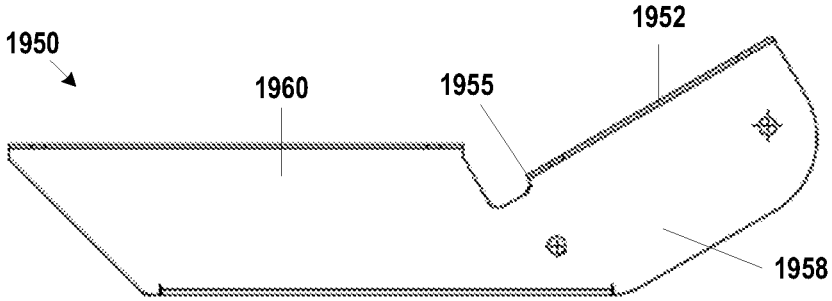

FIGS. 20E to 20G show another embodiment of a tread support structure 1950 of the systems described herein. In this embodiment, the tread support structure is a base tread support structure 1950. Base tread support structure 1950 can be used to couple any tread of a staircase to the stair stringer other than an uppermost tread of the staircase with more than one tread.

Like tread support structure 1906 described above, base tread support structure 1950 is also configured to slidably engage a top surface of the stair stringer and support a tread on the stair stringer. Base tread support structure 150 is configured to be affixed to both a top surface of the stair stringer and a side surface of the stair stringer. This additional support (i.e. being configured to be affixed to both the top surface and the side surface of the stair stringer) provides for the base tread support structure 1950 to positively engage a smaller portion of the top surface of the stair stringer when compared with the tread support structure 1906 described above and base tread support structure 1950 has been configured specially to support the lowermost tread of the staircase.

Specifically, as shown in FIG. 20E, base tread support structure 1950 includes a base 1952, a flange 1960 and an extending member 1958 coupling base 1952 to flange 1960. Base tread support structure 1950 also includes a stiffener flange 1959.

Like base 1910 described above, base 1952 is configured to slidably engage and be affixed to a top surface of the stair stringer. By being configured to slidably engage the top edge of the stair stringer, the base 1952 provides for the tread support structure 1950 to slide along the top edge of the stair stringer and be mounted to the stair stringer at any position along the stair stringer.

Base 1952 includes a feature 1955 (see FIGS. 20E, 20F and 20G) for positioning the tread support structure 1950 on the stair stringer. For instance, in the embodiment shown, feature 1955 is an edge of the base 1952. Like feature 1905 described above, feature 1955 of the tread support structure 1950 is aligned with a mounting position provided by a jig when constructing a staircase.

Extending member 1958 is configured to couple base 1952 to flange 1960 and for the base tread support structure 1950 to be affixed to a side surface of a stair stringer.

Flange 1960 extends away from the extending member 1958 at an angle to provide for a tread received by the flange 1960 and affixed to the flange to be level with at least one upper floor and a lower floor when the staircase is constructed. Flange 1960 can be configured to receive different styles of treads for different applications. For instance, in some embodiments, flange 1960 can be planar to provide a flat surface for supporting a tread. In other embodiments, flange 1960 can include upwardly extending portions that space apart two treads received on the flange 1960.

The systems described herein for constructing staircases also include a hanger bracket configured to mount an upper end of a stair stringer of a staircase to an upper floor. In some embodiments, the hanger brackets described herein provide lateral support to a side surface of the stair stringer to inhibit the stair stringer from twisting when the upper end of the stair stringer is mounted to the upper floor. In some embodiments, the hanger brackets described herein include one piece. In other embodiments, the hanger brackets described herein may include two pieces coupled together.

Figure 21A:
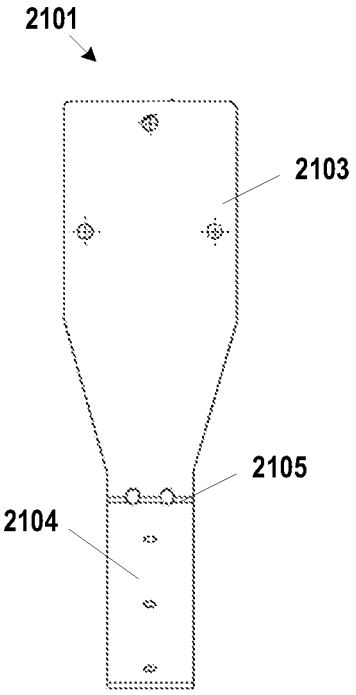
FIGS. 21A to 21C show front, perspective, and side views, respectively, of a hanger member of a lateral support hanger bracket, according to one embodiment described herein.
Figure 21B:
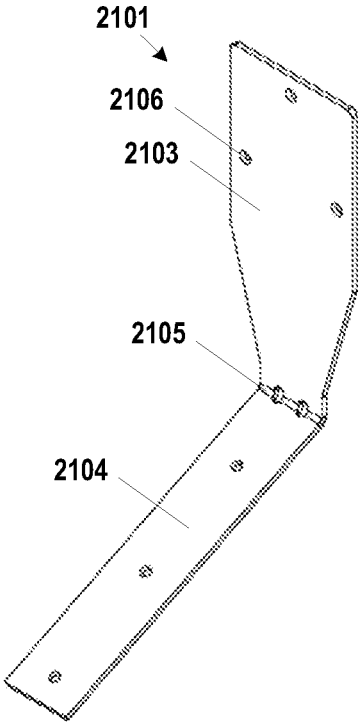
Figure 21C:
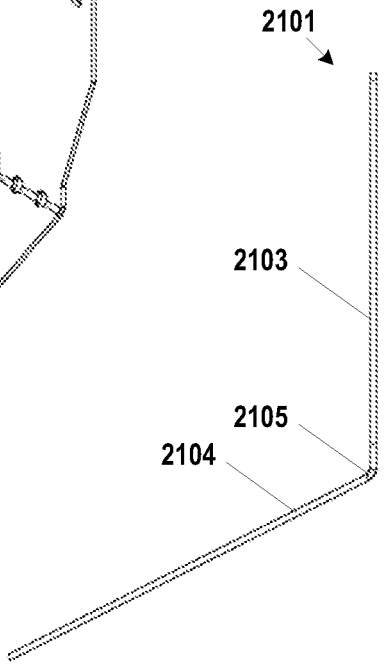

FIGS. 21A to 21C show a hanger member 2101 of a lateral support hanger bracket 2100 (see FIGS. 21G to 21I), according to one embodiment. Hanger member 2101 includes an upper floor mounting portion 2103 and a stringer mounting portion 2104. Upper floor mounting portion 2103 and mounting portion 2104 meet at bending line 2105.

Upper floor mounting portion 2103 is generally planar in shape and configured to mount to a face of an upper floor. Stringer mounting portion 2104 is also planar in shape and configured to mount to an edge of a stair stringer such as a lower edge. Stringer mounting portion 2104 extends outwardly and downwardly from the upper floor mounting portion 2103 at an angle that approximates the angle of a stair stringer (e.g. stair stringer 1902). Stringer mounting portion 2104 supports the stair stringer above a floor when the upper floor mounting portion 2103 is mounted to an upper floor.

Figure 21E:
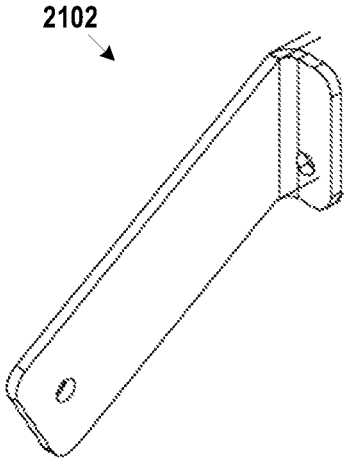
FIGS. 21D to 21F show front, perspective and side views, respectively, of a lateral support member of a lateral support hanger bracket, according to one embodiment described herein.
Figure 21D:
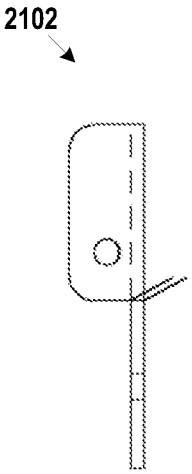
Figure 21F:
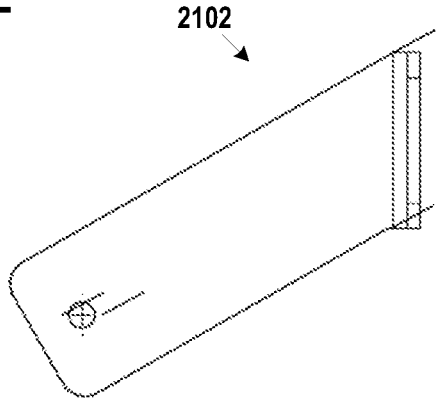
Figure 21G:
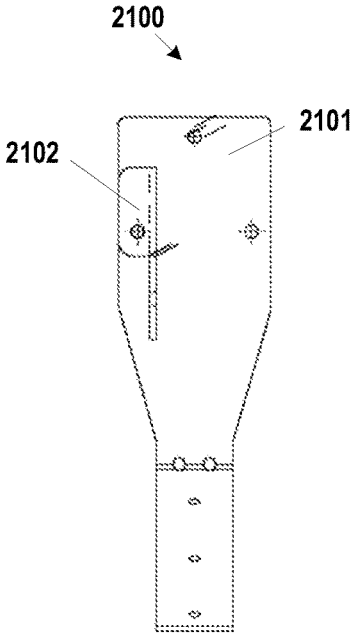
FIGS. 21G to 21I show front, perspective and side views, respectively, of a lateral support hanger bracket including the hanger member of FIGS. 21A to 21C and the lateral support member of FIGS. 21D to 21F.
Figure 21H:
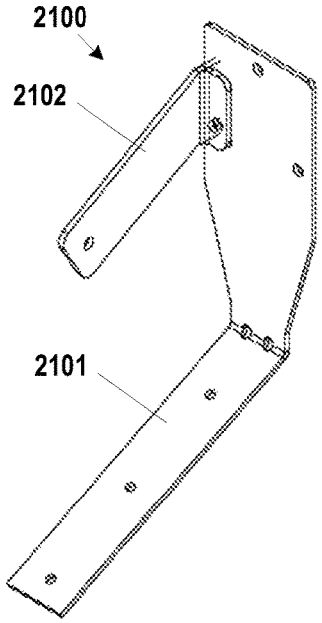
Figure 21I:
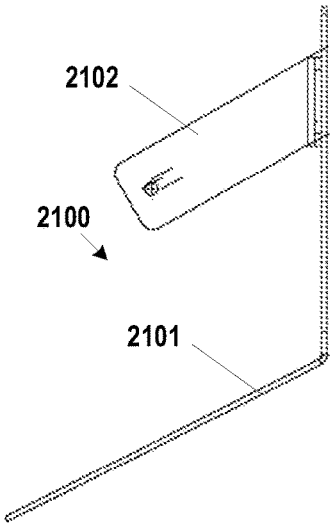

Bending line 2105 provides for stringer mounting member 2104 to rotate relative to upper floor mounting member 2103 to accommodate an angle of the stair stringer. As shown in FIG. 21M, the bending line 2105 can be manually manipulated by a user to accommodate stair stringers having a slope of angle B (e.g. about 40 degrees) to stair stringers having a slope of angle C (e.g. about 10 degrees).

In the embodiment shown in FIGS. 21A to 21C, upper floor mounting portion 2103 is also configured to couple to a lateral support member 2102. For instance, upper floor mounting portion 2103 may include an aperture 2106 positioned to provide for the lateral support member 2102 to be coupled to the upper floor mounting portion 2103 at a position that provides for the lateral support member 2102 to be coupled to a side surface of the stair stringer. One embodiment of a lateral support member 2102 is shown in FIGS. 21D to 21F. Lateral support member 2102, when coupled to upper floor mounting portion 2103, extends outwardly and downwardly from upper floor mounting potion 2103.

Figure 21J:
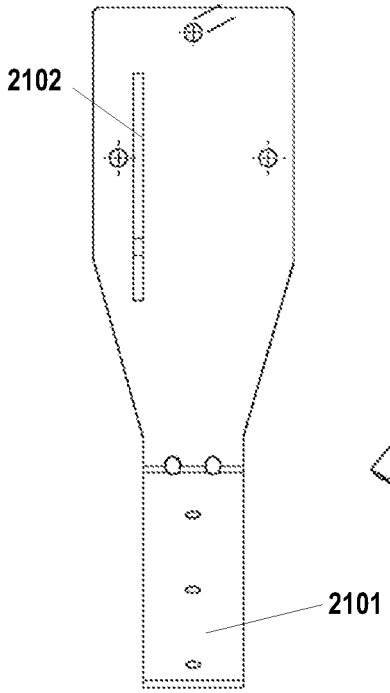
FIGS. 21J to 21L show front, perspective and side views, respectively, of a lateral support hanger bracket according to another embodiment described herein.
Figure 21K:
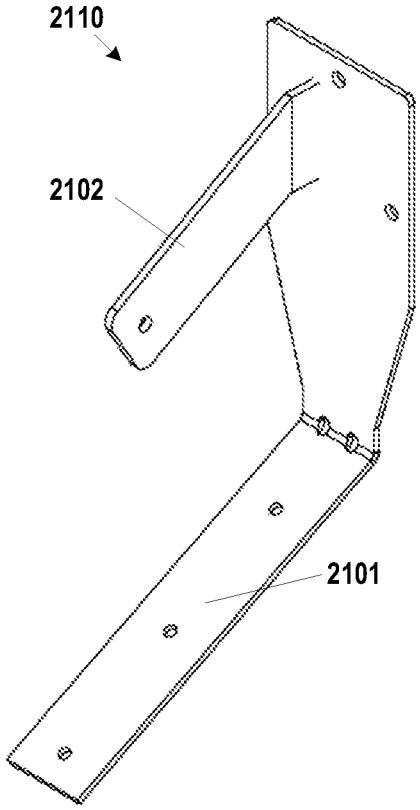
Figure 21L:
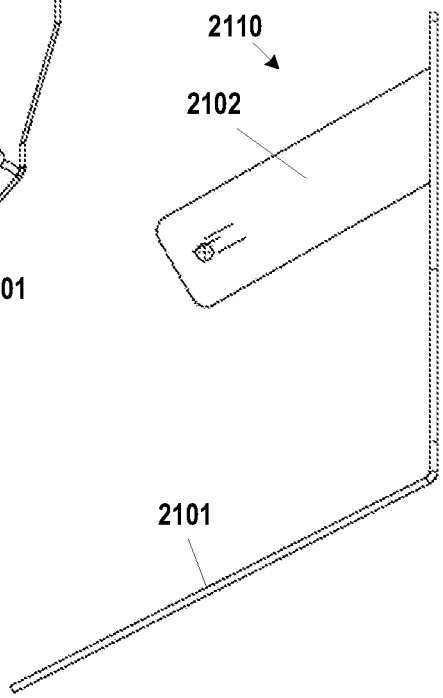
Figure 21M:
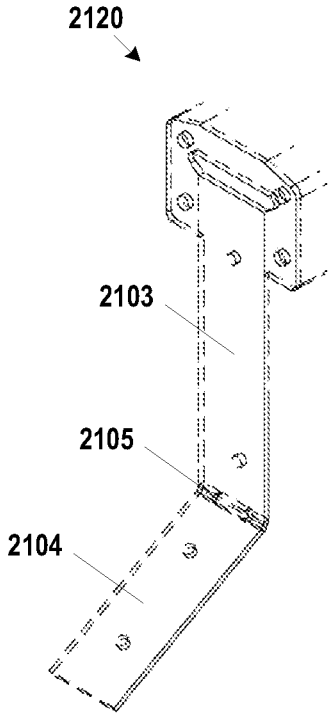
FIGS. 21M to 21O show perspective, side and front views, respectively, of a hanger bracket according to another embodiment described herein.

Another embodiment of a lateral support hanger bracket is shown in FIGS. 21J to 21L. Here, lateral support hanger bracket 2110 includes a hanger member 2101 integrally formed with a lateral support member 2102.

Figure 21N:
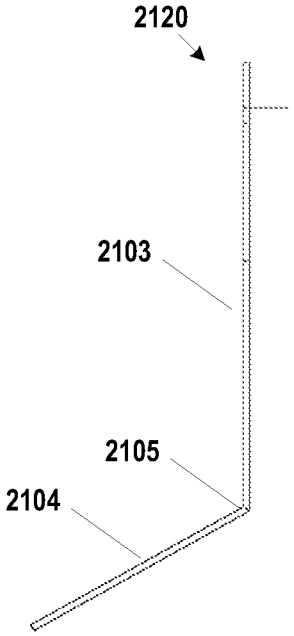
Figure 21O:
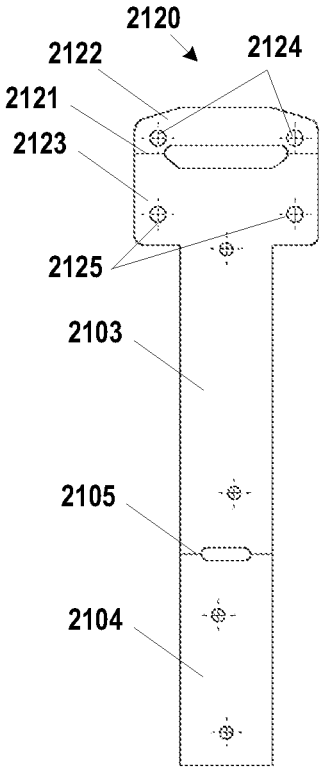

FIGS. 21M to 21O show an embodiment of a hanger bracket 2120 is configured for use with stair stringers having an upper end that is cut to be flush with a mounting portion of a hanger bracket. Hanger bracket 2120 provides lateral support to the stair stringer when the stair stringer is mounted to an upper floor via mounting holes 2125. Hanger bracket 2120 includes an upper floor mounting portion 2103 and a stringer mounting portion 2104. Upper floor mounting portion 2103 and mounting portion 2104 meet at bending line 2105.

Hanger bracket 2120 differs from the embodiments described above in that hanger bracket 2120 includes a second bending line 2121 (see FIG. 21O) separating the upper floor mounting portion 2103 into an upper portion 2122 and a lower portion 2123. Second bending line 2121 provides for upper portion 2122 to be mounted to the upper floor such as but not limited to via one or more fasteners passing through first apertures 2124 above the second bending line 2121. Second bending line 2121 also provides for the hanger bracket 2120 to temporarily bend upwardly during assembly of the staircase (e.g. to provide for attaching components at a lower end of the stair stringer, such as but not limited to a foot). Once the hanger bracket 2120 is ready to be fully affixed to the upper floor, the bracket 2120 can be bent downwardly until lower portion 2123 is flush with the upper floor and lower portion 2123 can be mounted to the upper floor such as but not limited to via one or more fasteners passing through second apertures 2125 below the second bend line 2121. First apertures 2124 are shown as being spaced apart by a distance that is generally greater than a width of a stair stringer to provide for affixing the hanger bracket 2120 to an upper floor after affixing the stair stringer to the hanger bracket. Second apertures 2125 are similarly also spaced apart by a distance that is generally greater than a width of a stair stringer.

Figure 21Q:
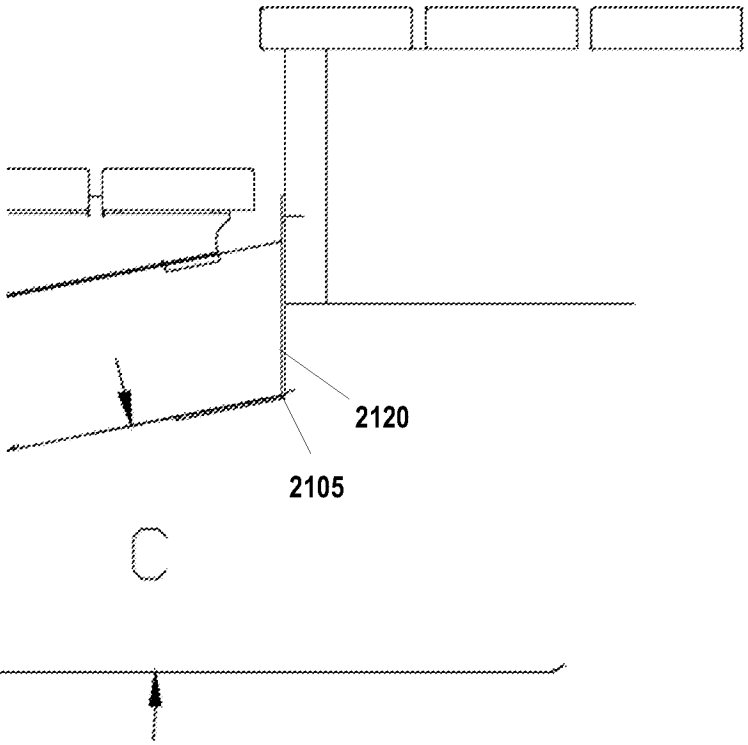
FIG. 21Q shows a side view of a portion of a staircase having the hanger bracket of FIGS. 21M to 21O set at a shallow slope.
Figure 21P:
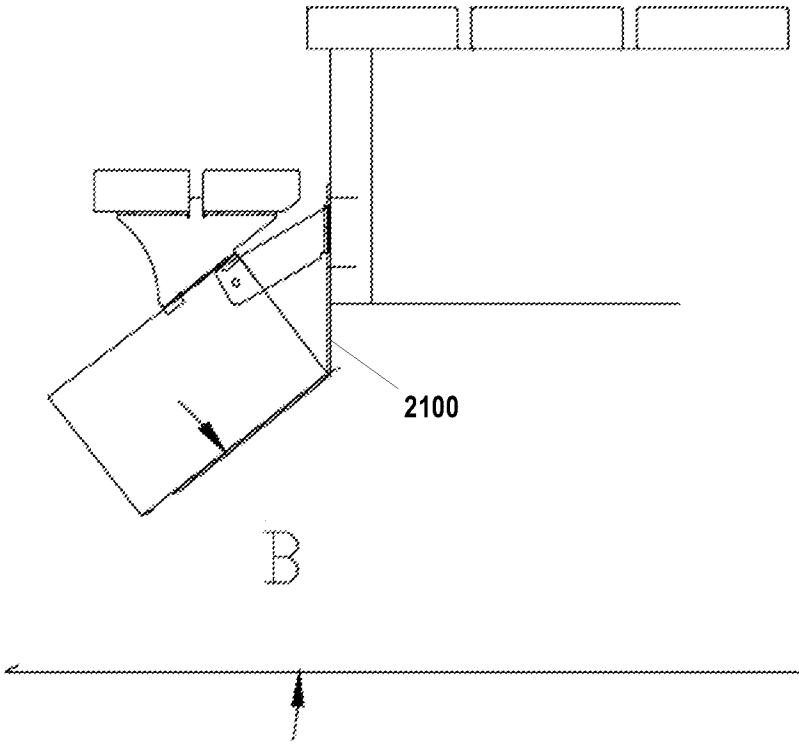
FIG. 21P shows a side view of a portion of a staircase having the lateral support hanger bracket of FIGS. 21J to 21L set at a steep slope.

It should be understood that the hanger brackets described herein may be used in systems for constructing staircases with stair stringers having fixed slopes as shown in FIGS. 21P and 21Q. Specifically, FIG. 21P shows a staircase mounted to an upper floor via the hanger bracket of FIGS. 21A to 21C with a stair stringer having a slope B, whereas FIG. 21Q shows a staircase mounted to an upper floor via the hanger bracket of FIGS. 21M to 21O with a stair stringer having a slope C. As shown, slope B is steeper than slope C, but it should be understood that each of the embodiments of hanger brackets described can adapt (e.g. bend) to accommodate different slopes.

Figure 22A:
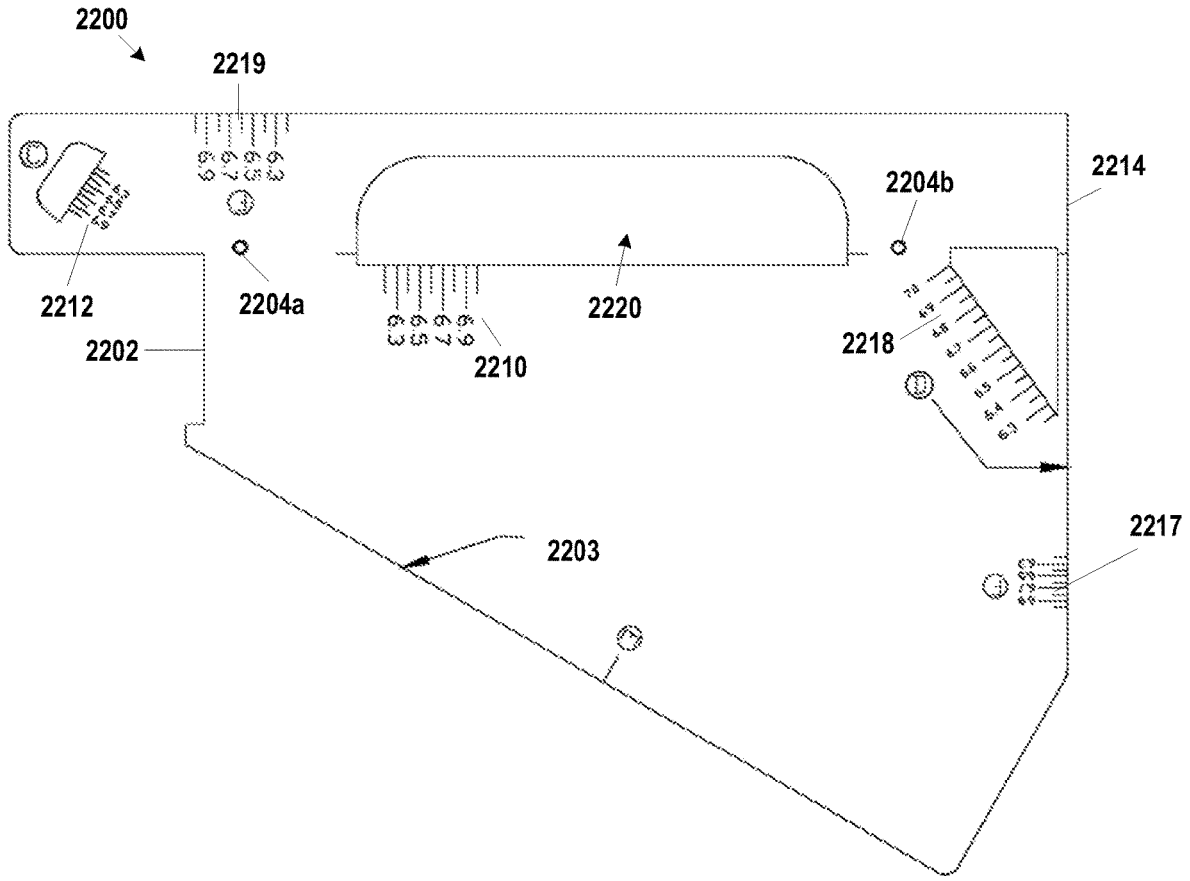
FIG. 22A shows a side view of a jig for constructing a staircase, according to one embodiment described herein.
Figure 22B:
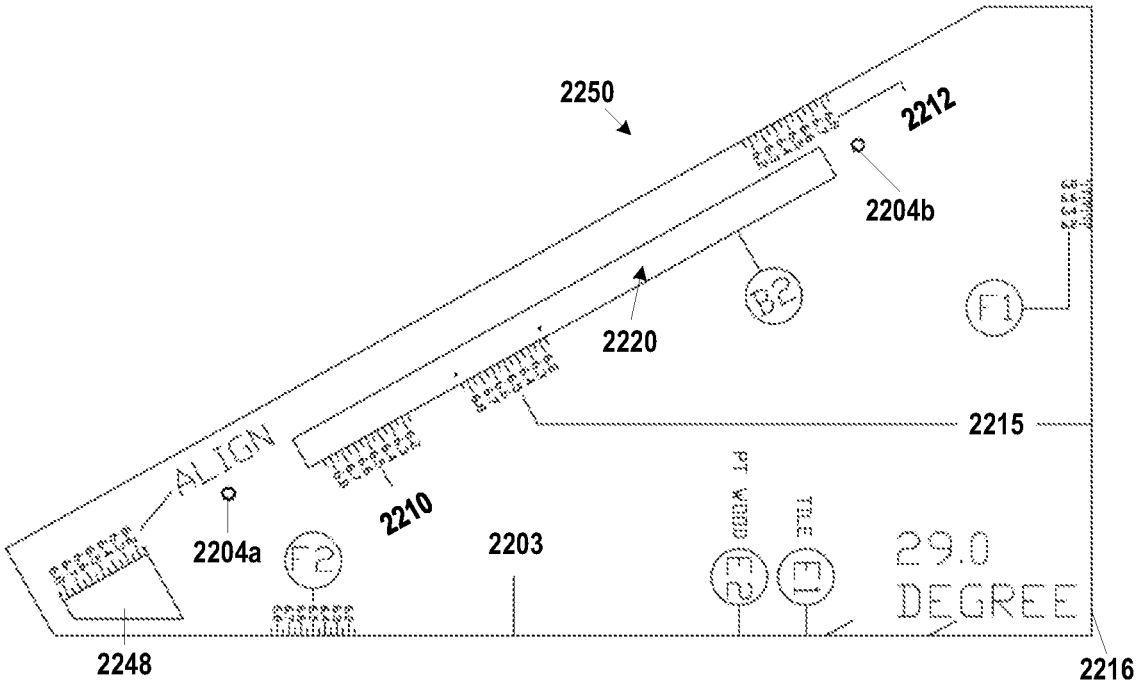
FIG. 22B shows a side view of a jig for constructing a staircase, according to another embodiment described herein.

The systems described herein for constructing staircases having stair stringers with a fixed slope include a jig, such as but not limited to the jigs 2200 and 2250 shown in FIGS. 22A and 22B, respectively. Jigs 2200 and 2250 are each configured to prepare a stair stringer by, for instance, cutting the slope of the stringer and determining a mounting position of each of the tread support structures on the stair stringer when the stair stringer has with a fixed slope. Jigs 2200 and 2250 may also be configured to determine a length of the stair stringer, for instance based on a rise of the staircase and a mounting position of the stair stringer with respect to an upper floor. Jigs 2200 and 2250 may further be configured to provide a cut line to cut an upper end of the stair stringer. The cut line may be at an angle of 90° relative to a top edge of the stringer (e.g. be a stair stringer that requires lateral support from a hanger bracket) or be at an angle that corresponds with an angle of a hanger bracket of the system. Jigs 2200 and 2250 may also provide other measurements and/or features of the staircase being constructed. For instance, jigs 2200 and 2250 may determine a mounting position of a hanger bracket on a face of the upper floor.

Jigs 2200 and 2250 are each configured to provide a staircase having a stair stringer with a pre-determined slope and are each shown as one example of a jig for constructing a staircase. Other jigs for constructing staircases that may be used to construct a staircase having a stair stringer with a different slope than the slope provided by the jigs 2200 and 2250 may vary in appearance when compared to the jig 2200, however, are contemplated herein. For instance, it should be understood that jigs 2200 and 2250 can be configured to accommodate different types of hanger brackets, such as but not limited to the various embodiments of hanger brackets described above. It should also be understood that other embodiments of jigs that are not identical to jigs 2200 and 2250 shown herein may be designed to perform the functions described herein.

Jigs 2200 and 2250 each include a plurality of features (e.g. edges, windows, etc.) and markings (e.g. scales) to be used to prepare stair stringers to be used in staircase systems and to construct staircases. The features and markings are used to measure distances necessary for preparing the stair stringer and constructing the staircase to ensure that the staircase falls within the comfort rules described above. Each of jigs 2200 and 2250 are described in greater detail below while describing step of using the jigs in methods of assembling staircases.

Figure 23A:
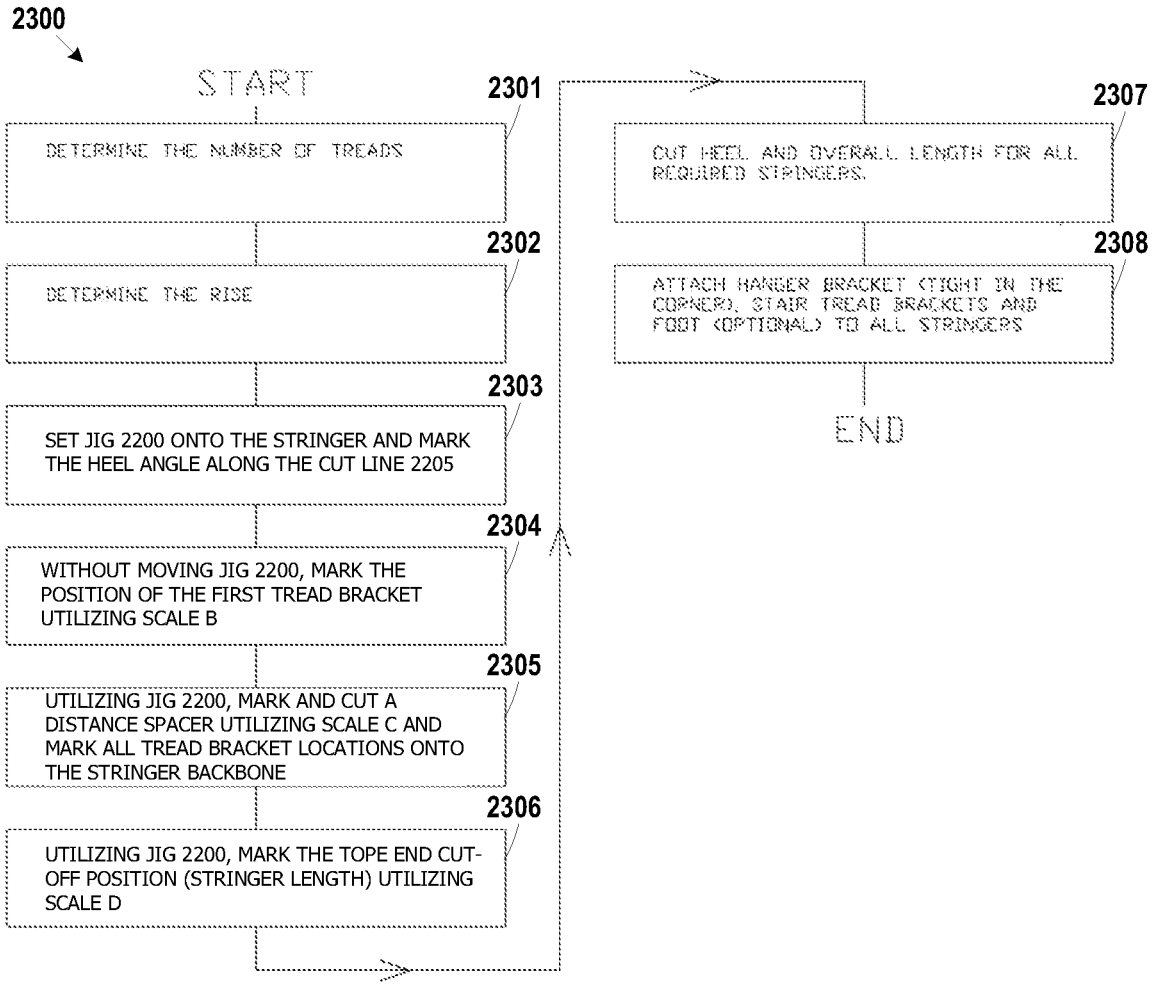
FIG. 23A shows a block diagram of a method of preparing a stair stringer of one of the staircases of FIG. 19, according to one embodiment described herein.
Figure 23B:
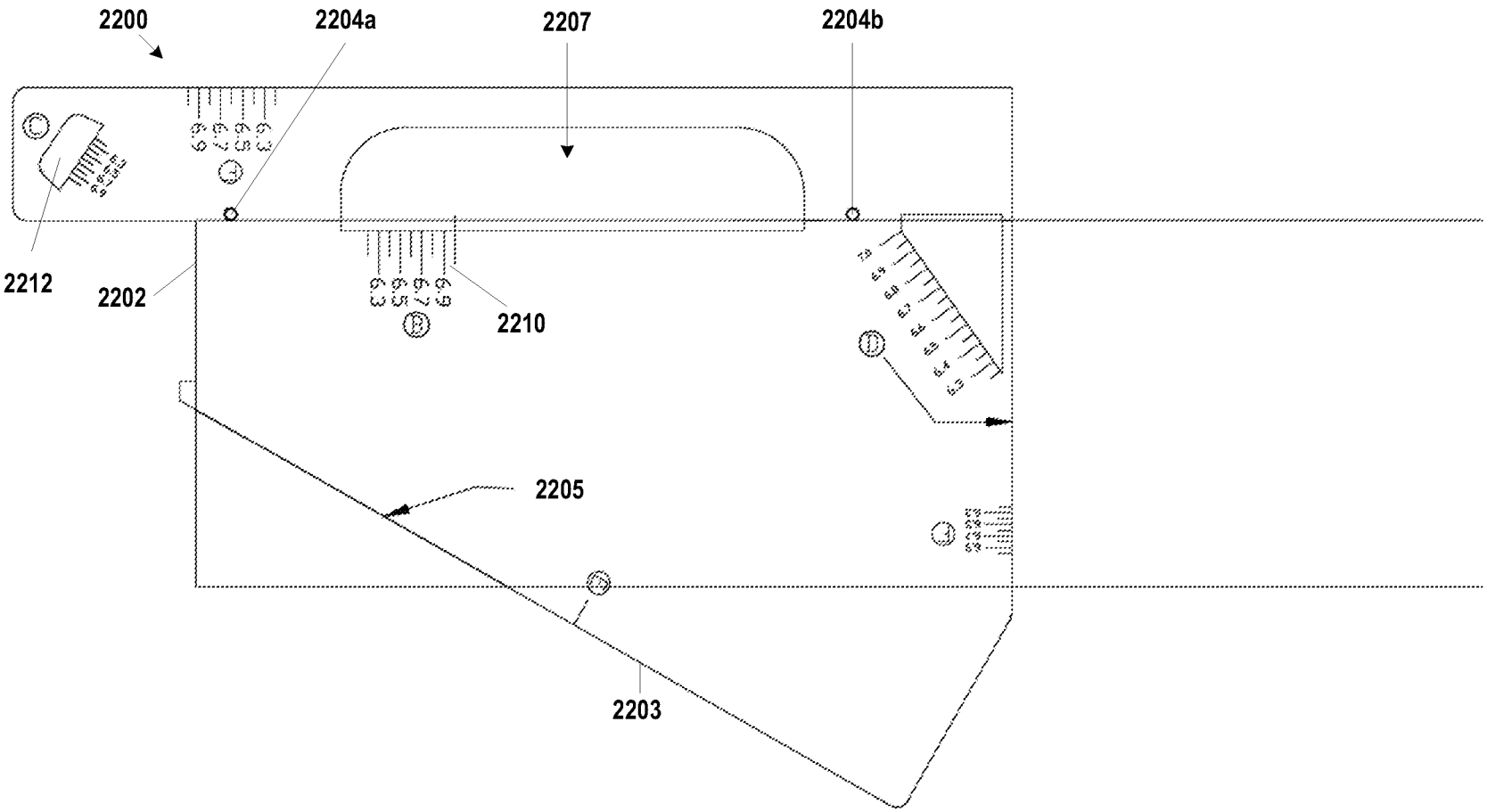
FIG. 23B shows a side view of the jig of FIG. 22A being used to mark a first cut line on a stair stringer in a method of preparing a stair stringer, according to one embodiment described herein.

FIG. 23A shows a method 2300 of preparing a stair stringer. FIGS. 23B-22E provide illustrative examples of some of the steps of the method 2300.

At step 2301, the number of treads of the staircase is determined. Generally, the number of treads of the staircase is determined by measuring a height of the staircase and dividing the height of the staircase by a largest rise shown on each of the scales of the jig 2200. For instance, the jig 2200 offers a range rises between about 6.3 inches and about 7.0 inches. Once a number has been obtained by performing this calculation, the number is rounded up to the nearest whole number and then 1 is subtracted from the number to determine the number of treads required for the staircase.

At step 2302 of the method 2300, the rise of each of the treads of the staircase is determined by dividing the height of the staircase by the sum of the required treads plus 1.

At step 2303 of the method 2300, as shown in FIG. 23B, jig 2200 includes a first edge 2202 for aligning with an end of the stair stringer to determine a position of a first cut line 2205 on the stair stringer. Jig 2200 has first and second pins 2204*a* and 2204*b*, respectively, for resting against a top edge of a stair stringer to properly align the jig 2200 and the stair stringer for marking the first cut line 2205. First cut line 2205 is indicated by the second edge 2203 of the jig 2200 when the end of the stringer is aligned with first edge 2202 and the top edge of the stringer rests against the first and second pins 2204*a* and 2204*b*. Using the jig of 22B, the first edge 2202 is replaced by a scale 2248 for aligning with the end of the stair stringer.

At step 2304, to mark a position of a lowermost tread support structure on the stair stringer, a mark is placed on the stringer adjacent to a marking of a first scale 2210 of the jig 2200 in the first window 2207 corresponding to a desired rise of the lowermost tread when the end of the stringer is aligned with first edge 2202 and the top edge of the stringer rests against the first and second pins 2204*a* and 2204*b* (see FIG. 23B).

Figure 23C:
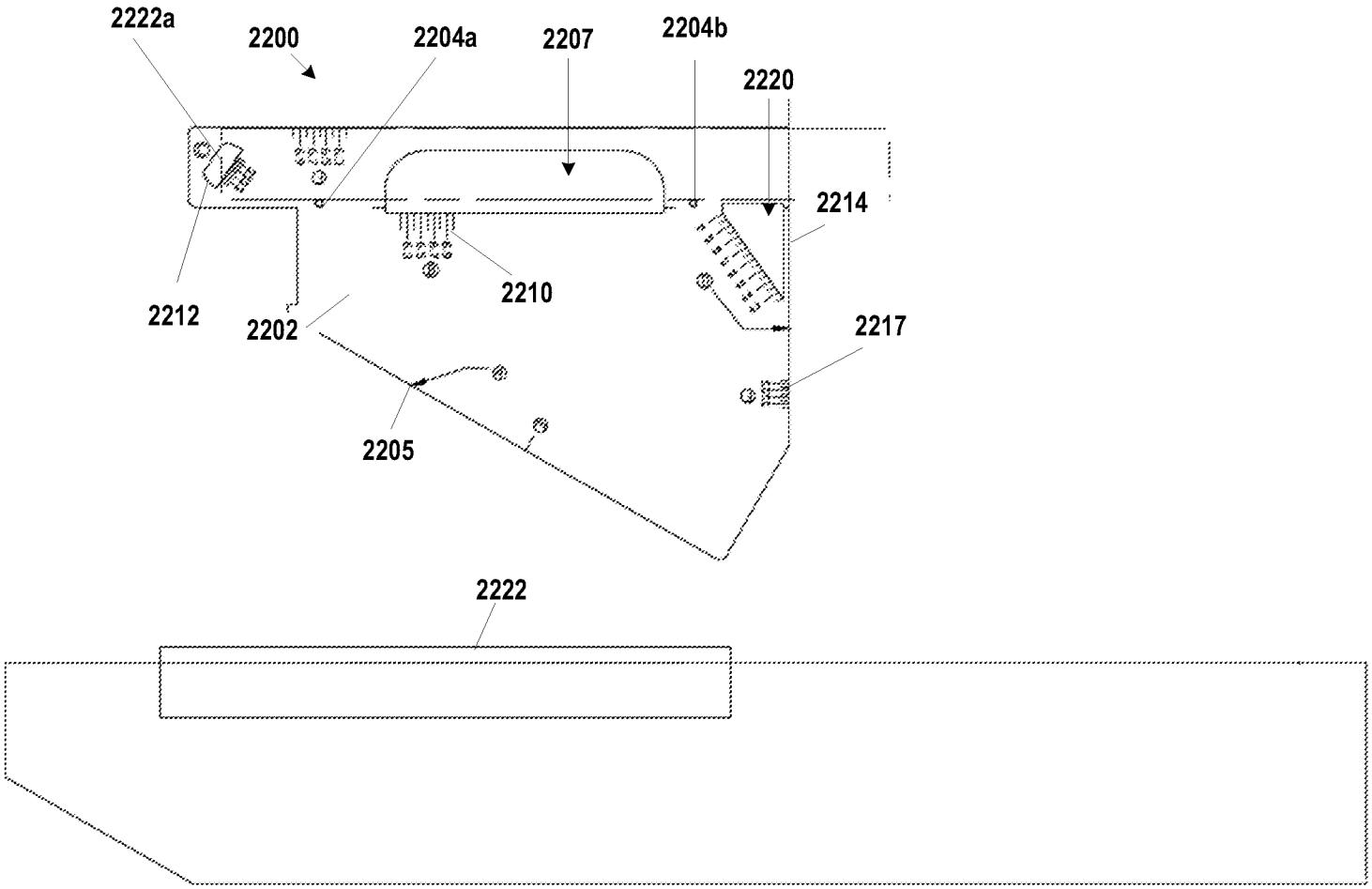
FIGS. 23C shows a side view of the jig of FIG. 22A being used to prepare a spacer jig for use in a method of preparing a stair stringer, according to one embodiment described herein.

As shown in FIG. 23C and described at step 2305, to mark a position of the remaining tread support structures on the stair stringer, a spacer jig 2222 is made using the jig 2200. The spacer jig 2222 has a length corresponding to a distance from a third edge 2214 of the jig 2200 to the end 2222*a* when the spacer jig rests on the pins 2204*a* and 2204*b* and end 2222*a* is aligned with a marking of second scale 2212 at the desired rise of each tread of the staircase to be built.

To mark the tread support structure locations on the stringer, the spacer jig 2222 is placed against the stair stringer and used to measure a distance between adjacent tread support structures upwardly from the lowermost tread support structure mounting position to the top end of the stair stringer.

Figure 23D:
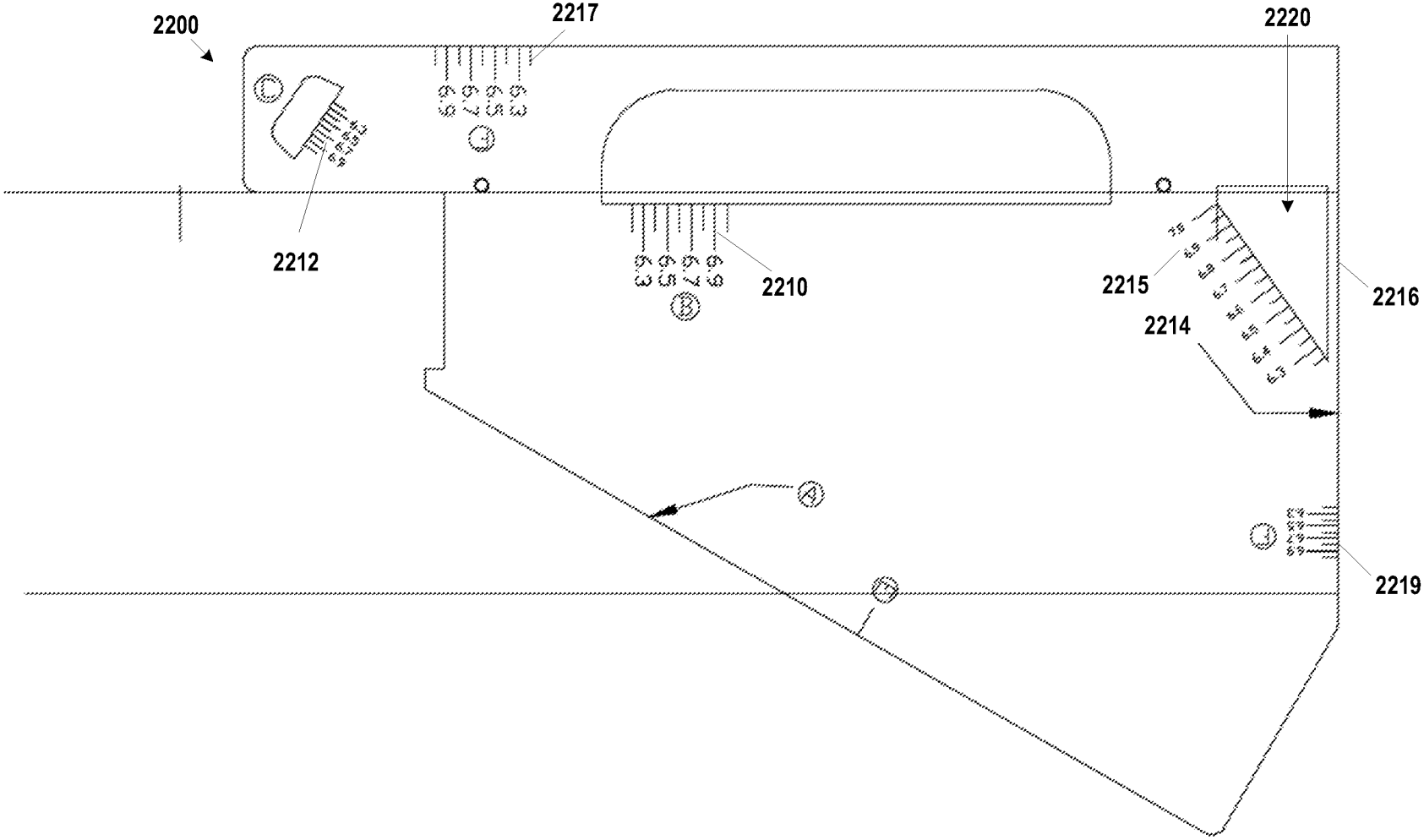
FIGS. 23D shows a side view of the jig of FIG. 22A being used to mark a second cut line on a stair stringer in a method of preparing a stair stringer, according to one embodiment described herein.

At step 2306, shown in FIG. 23D, to mark a second cut line 2216 on the stringer, a mark is placed on the stringer adjacent to third edge 2214 when the stringer is placed against the pins 2204*a* and 2204*b* and the uppermost tread support structure mounting position is viewable through the second window 2220. When the mounting position of the uppermost tread support structure is aligned with a marking of third scale 2215 corresponding to a selected rise of the treads of the staircase, the second cut line 2216 can be marked along the third edge 2214.

Figure 23E:
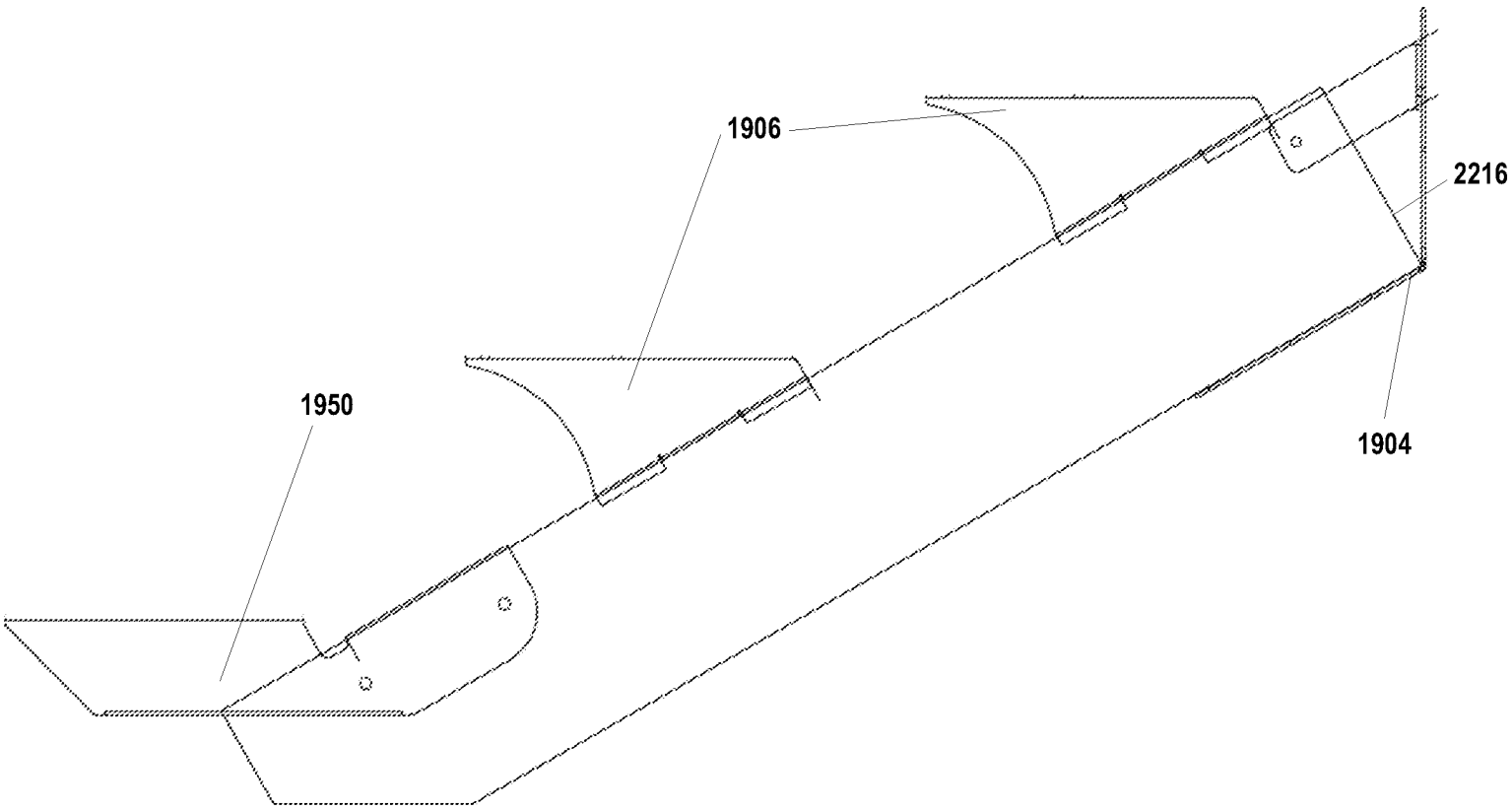
FIGS. 23E shows a side view of a stair stringer prepared using the jig of FIG. 22A in a method of preparing a stair stringer, according to one embodiment described herein.

At steps 2307 and 2308, the top of the stringer is cut along the second cut line 2216, and the tread support structures (e.g. tread support structures 1906 and base tread support structure 1950) and the hanger bracket are attached to the stair stringer, respectively. An assembled stringer is shown in FIG. 23E.

Figure 23F:
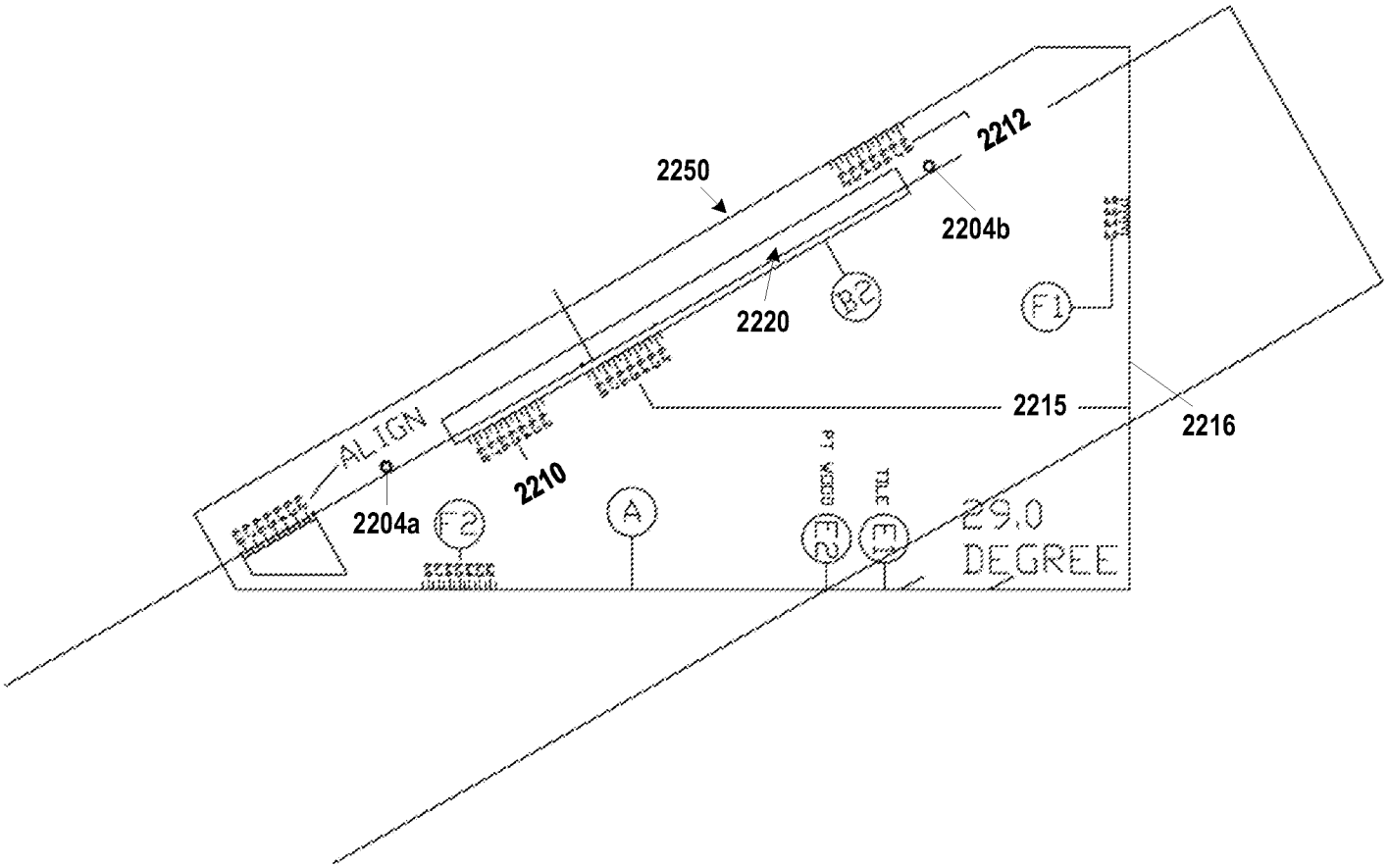
FIGS. 23F shows a side view of the jig of FIG. 22B being used to mark a second cut line on a stair stringer in a method of preparing a stair stringer, according to one embodiment described herein.

In an alternative embodiment of step 2306, shown in FIG. 23F, a second cut line 2216 can be marked on the stringer using jig 2250. In this embodiment, the second cut line 2216 does not have a 90° angle relative to the top edge of the stair stringer. Rather, the second cut line 2216 has an angle relative to a bottom edge of the stair stringer that corresponds to an angle of the hanger bracket so after the stair stringer is cut at the second cut line the upper end of the stair stringer is flush with the hanger bracket when the stair stringer is mounted to the hanger bracket. An example of this is shown in FIG. 23G.

Briefly, in this alternative embodiment, after marking the uppermost tread support structure location on the stringer, the jig 2250 is placed on the stringer adjacent to third edge 2214 when the stringer is placed against the pins 2204*a* and 2204*b* and the uppermost tread support structure mounting position is viewable through the second window 2220. When the mounting position of the uppermost tread support structure is aligned with a marking of third scale 2215 corresponding to a selected rise of the treads of the staircase, the second cut line 2216 can be marked along the third edge 2214.

Figure 23G:
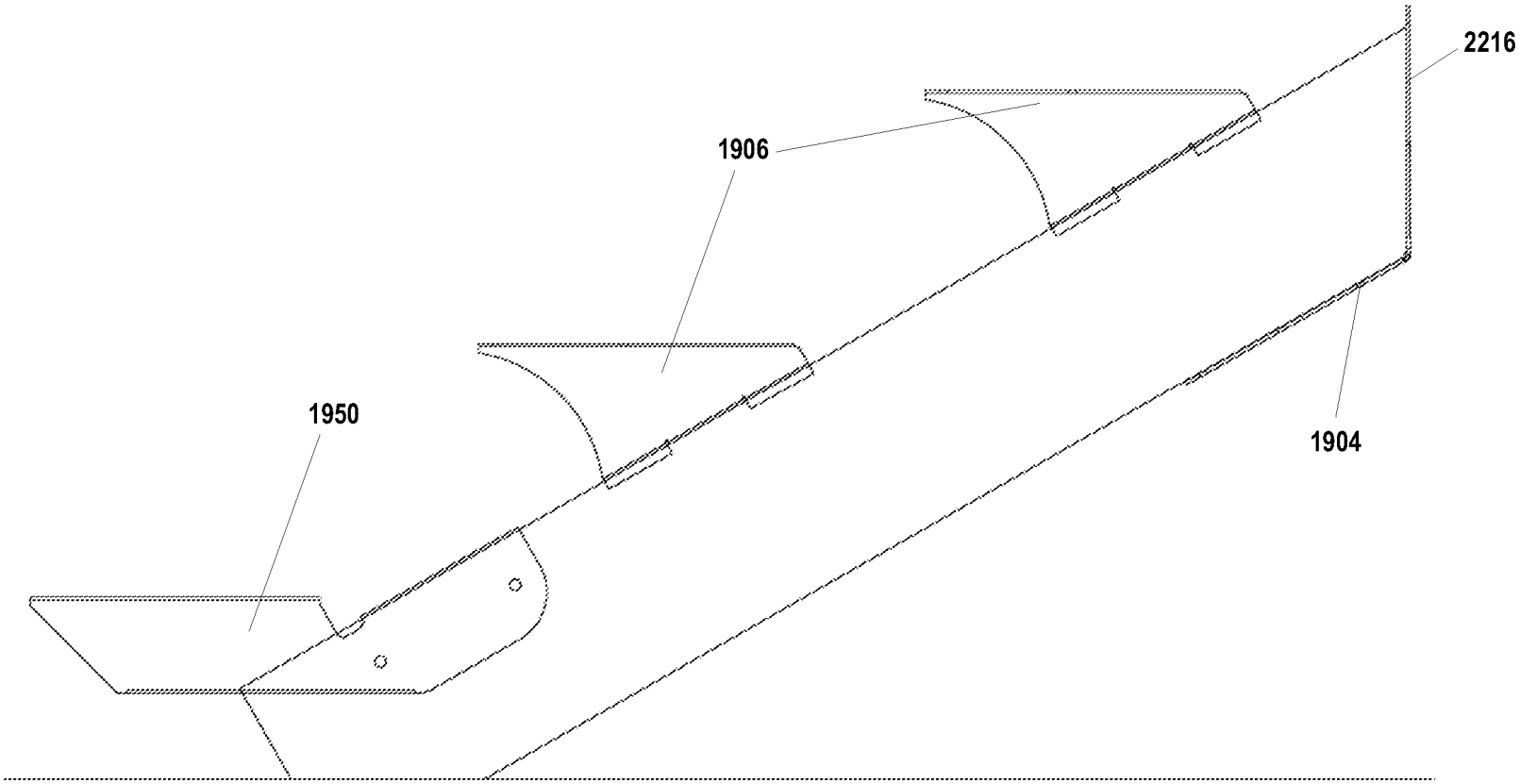
FIGS. 23G shows a side view of a stair stringer prepared using the jig of FIG. 22B in a method of preparing a stair stringer, according to one embodiment described herein.

Referring now to FIG. 23G, illustrated therein is a staircase including the hanger bracket shown in FIGS. 21M-21O and constructed using jig 2250 illustrated in FIG. 22B.

Figure 24A:
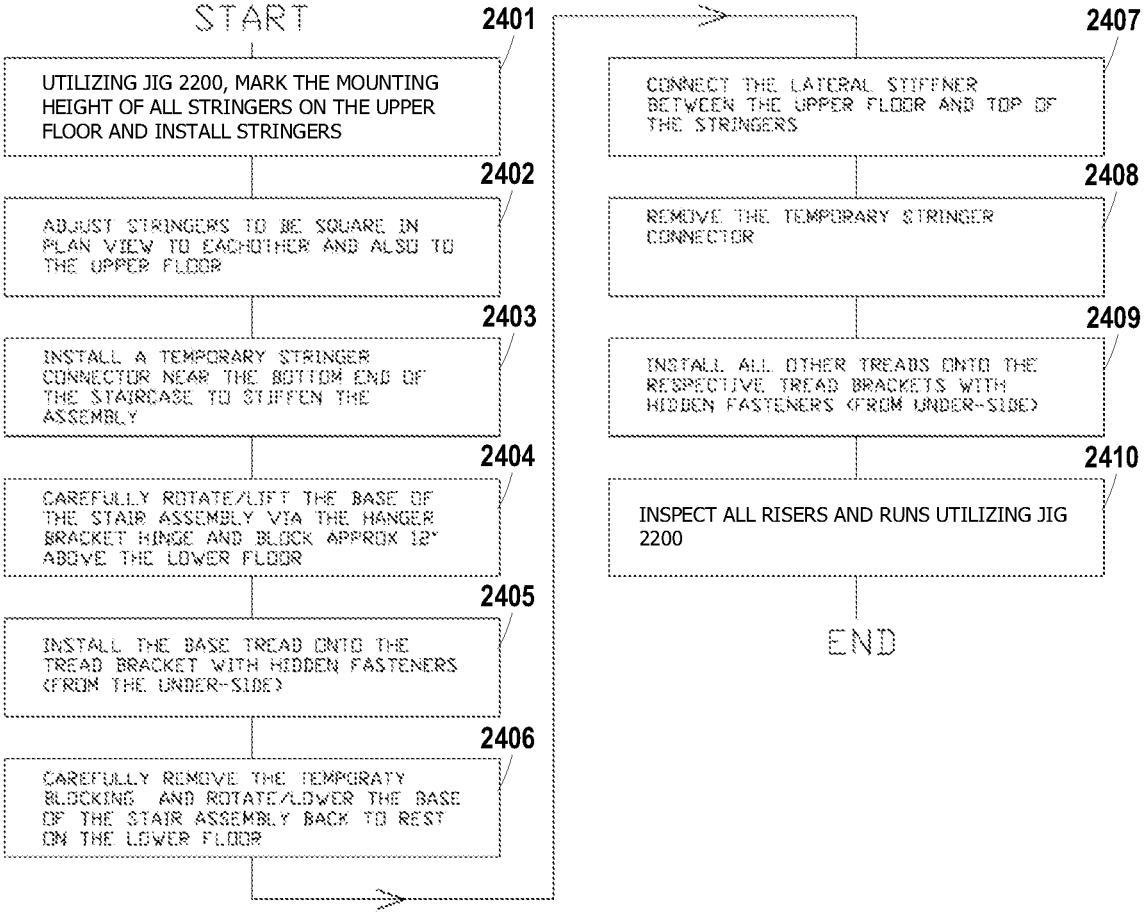
FIG. 24A shows a block diagram of a method of constructing a staircase assembly, according to one embodiment described herein.
Figure 24B:
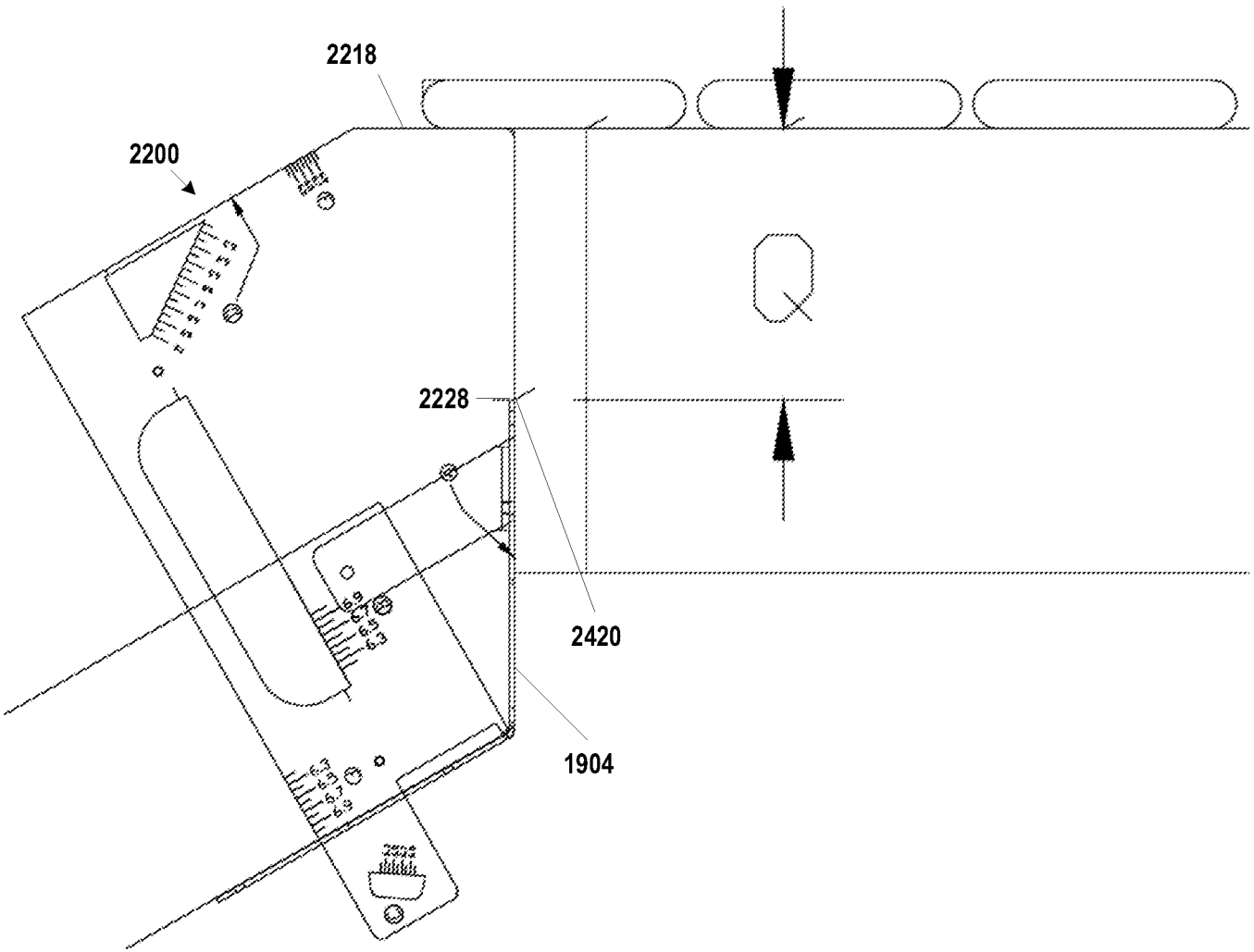
FIG. 24B shows a side view of the jig of FIG. 22A being used to mount a lateral support hanger bracket in the method of constructing a staircase of FIG. 24A.

Referring now to FIG. 24A, illustrated therein is a method 2400 of assembling a staircase. In the method 2400, step 2401 (illustrated in FIG. 24B) includes marking a mounting position 2420 of all stringers of the staircase on the upper floor. All stringers are then installed (i.e. mounted) to the upper floor. The mounting position 2420 of the hanger bracket is provided by a marking 2228 of the jig 2200 when the fourth edge 2218 is pressed against underside of the upper floor or otherwise aligned with a height of the upper floor. Marking 2228 provides for the mounting position 2420 of the hanger bracket to be a distance Q from the top of the upper floor structure.

At step 2402, the stringers of the staircase are adjusted to be square in plan view to each other and also to the upper floor.

Figure 24C:
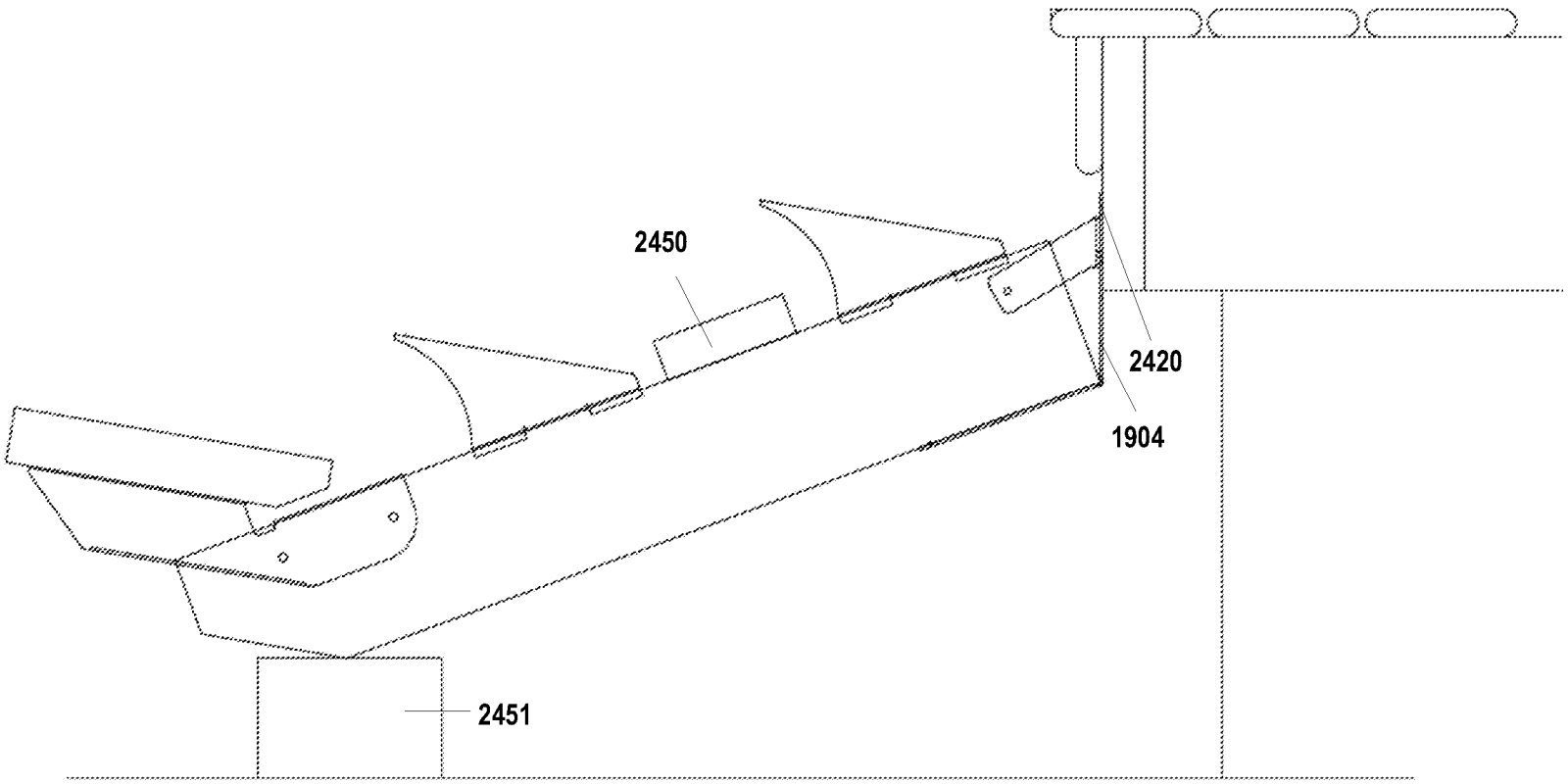
FIG. 24C shows a side view of a stair stringer rotated upwardly off of a lower floor during the method of constructing a staircase of FIG. 24A, the stair stringer being coupled to the upper floor by the hanger bracket of FIGS. 21J to 21L.

Steps 2403 to 2405 are illustrated in FIG. 24C. Specifically, at step 2403, illustrated in FIG. 24C, a temporary stringer connector 2450 is installed just above the mounting line near a bottom end of the staircase to temporarily stiffen the assembly. At step 2404, the base of the stair assembly is rotated/lifted via a bend line on the hanger bracket (e.g. bend line 2105 of lateral support hanger bracket 2100) and temporarily raised (e.g. about 12 inches) off of the lower floor via a temporary block 2451. At step 2405, the base tread is installed onto the lowermost tread brackets with fasteners from an underside.

Figure 24D:
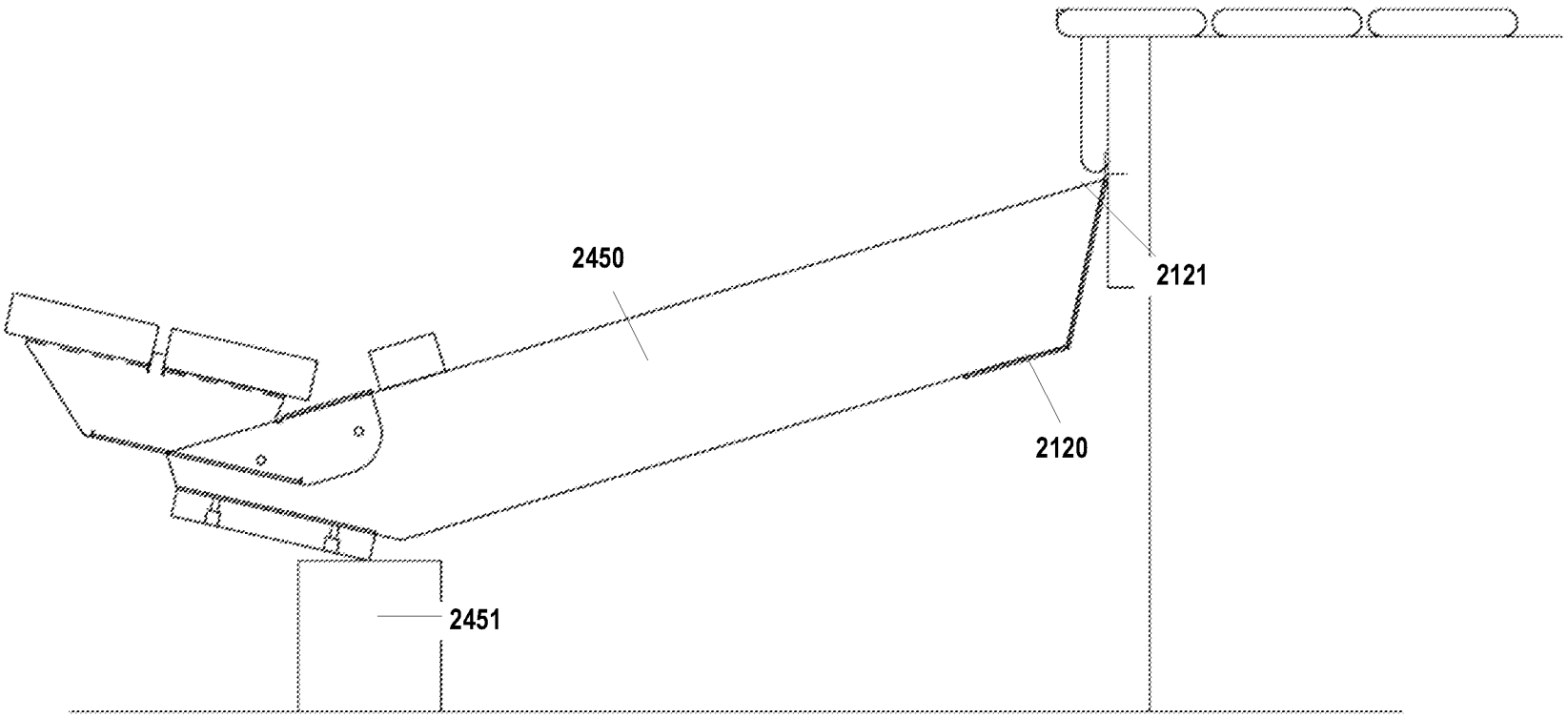
FIG. 24D shows a side view of a stair stringer rotated upwardly off of a lower floor during the method of constructing a staircase of FIG. 24A, the stair stringer being coupled to the upper floor by the hanger bracket of FIGS. 21M to 21O.

An alternative embodiment of step 2404 is shown in FIG. 24D, where the base of the stair assembly is rotated/lifted via a second bend line of an upper floor mounting portion of the hanger bracket (e.g. second bend line 2121 of hanger bracket 2120) and temporarily raised (e.g. about 12 inches) off of the lower floor via a temporary block 2451.

Figure 24E:
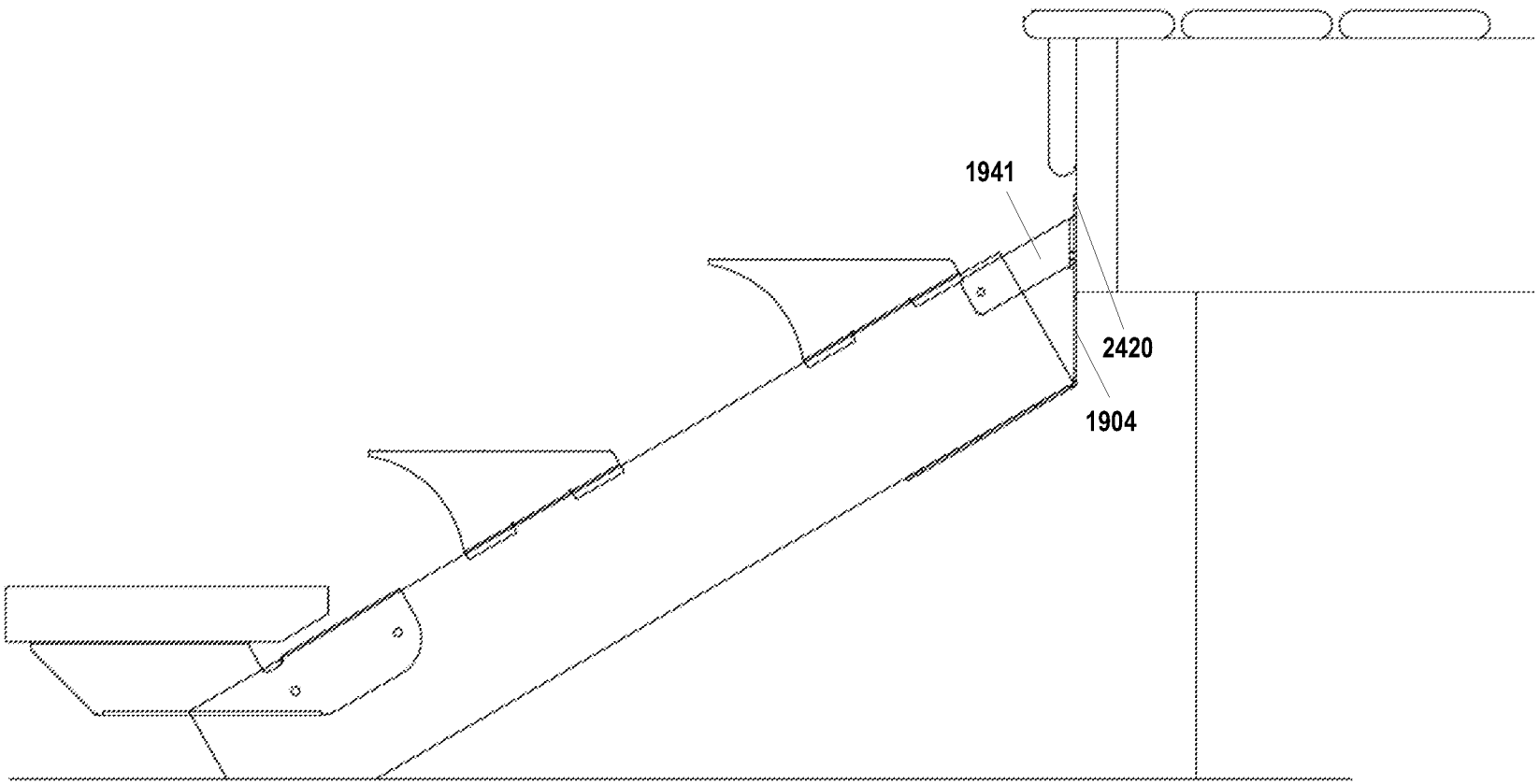
FIG. 24E shows a side view of a stair stringer of a staircase constructed using the method of constructing a staircase of FIG. 24A.

Steps 2406 to 2408 are illustrated in FIG. 24E. Specifically, at step 2406, the temporary block 2451 is removed and the base of the stair assembly is rotated and lowered back down to the lower floor. At step 2407, a lateral stiffner (e.g. a lateral support member of a lateral support hanger bracket) is connected between the upper floor and the top of the stair stringer.

At step 2408, the temporary stringer connector 2450 is removed.

At step 2409, the remaining treads are installed on the tread brackets with fasteners (e.g. from an underside).

Figure 24F:
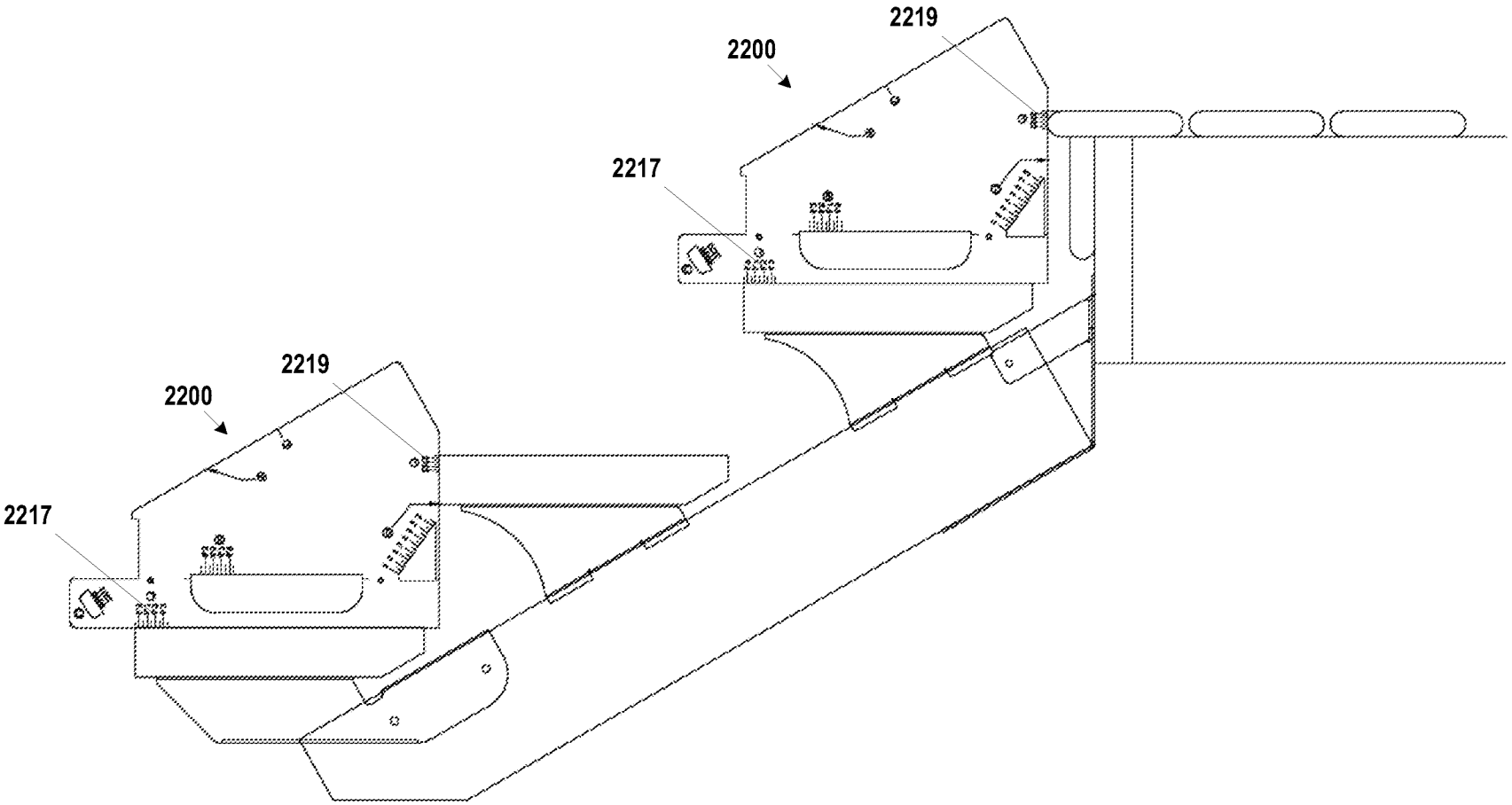
FIG. 24F shows a side view of a stair stringer and a jig being used to confirm the rise and run of each tread of the stair stringer during the method of constructing a staircase of FIG. 24A.

At step 2410 (see FIG. 24F), the staircase is inspected using the first jig 2200 to confirm the run and the rise of each tread. This is completed using the sixth and seventh scales 2217 and 2219, respectively, of the jig 2200 in the manner shown.

Figure 25:
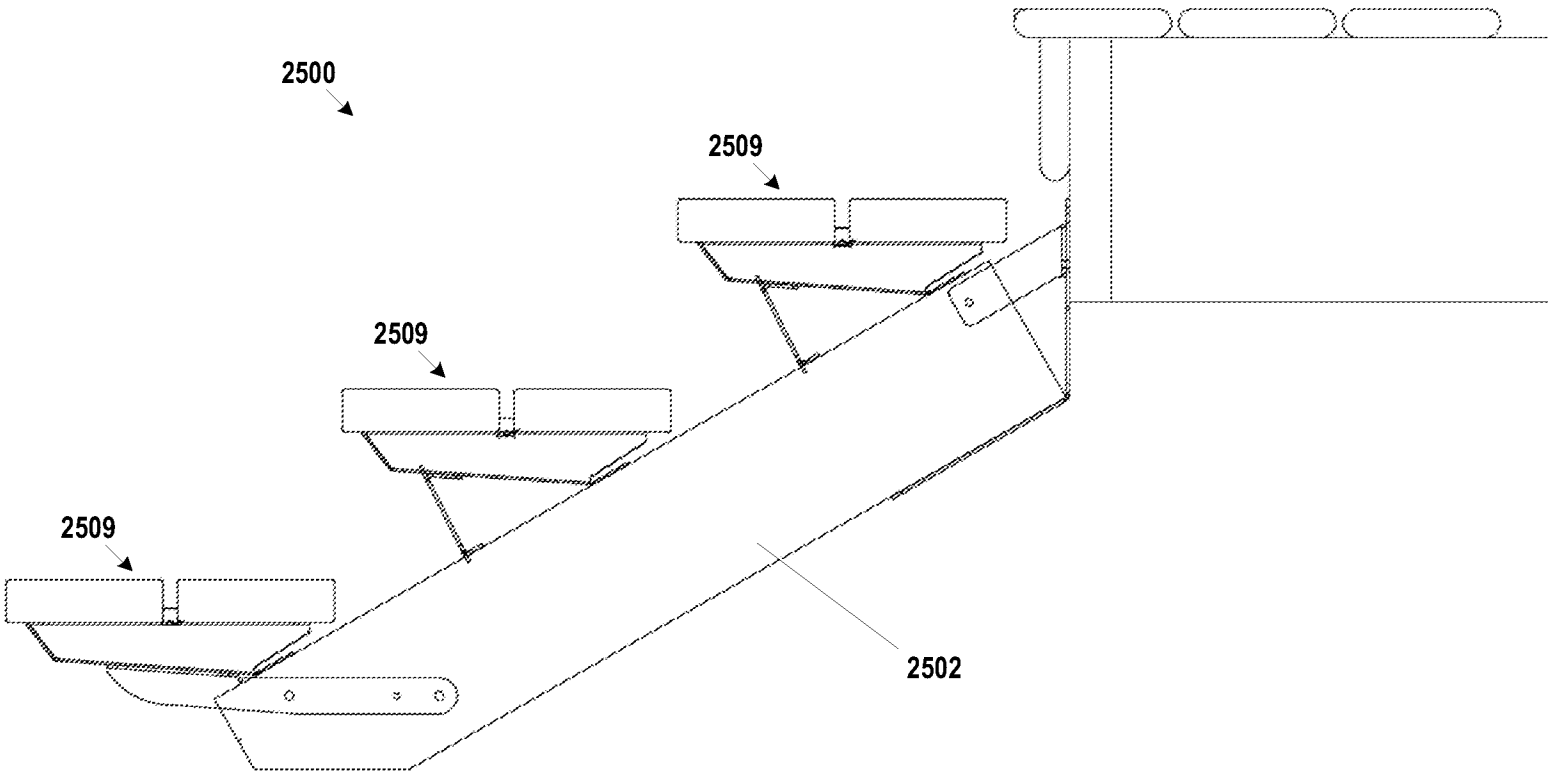
FIG. 25 shows a side view of a variable slope/fixed run staircase constructed using a set of jigs, according to one embodiment described herein.

In accordance with another embodiment, another variable rise staircase 2500 is shown in FIG. 25. Staircase 2500 has the added feature of fixed run and is also configured to be code compliant (i.e. 2015 International Building Code (IBC)) and follow the common comfort rules for staircases, namely the Rule of 18 and the Rule of 25. In contrast to staircase 1900 shown in FIG. 19, staircase 2500 may have a variable slope, meaning that a jig set used to construct the staircase 2500 is not limited to constructing a staircase having one specific slope. Rather, a user of the jig set to construct the staircase 2500 may select a rise and a run for the staircase 2500 and the jig set determines the most appropriate slope for the selected rise while maintaining a fixed run and compliance with the codes and comfort rules.

Further, staircase 2500 is constructed using a set of jigs offering a wider range of rises of each tread 2509 of the staircase 2500 when compared to fixed slope staircase 1900 shown in FIG. 19. For instance, each tread 2509 of the staircase 2500 can have a rise in a range of about 5.9 inches to about 7.4 inches while maintaining an 11.75 inch run. The active range of a fixed run/variable slope stair system is roughly double the active range of a fixed slope stair system, by altering the step run and reconfiguring this type of jig set accordingly, comfortable and code compliant staircases of greater and lesser slope ranges can be constructed.

Figure 26:
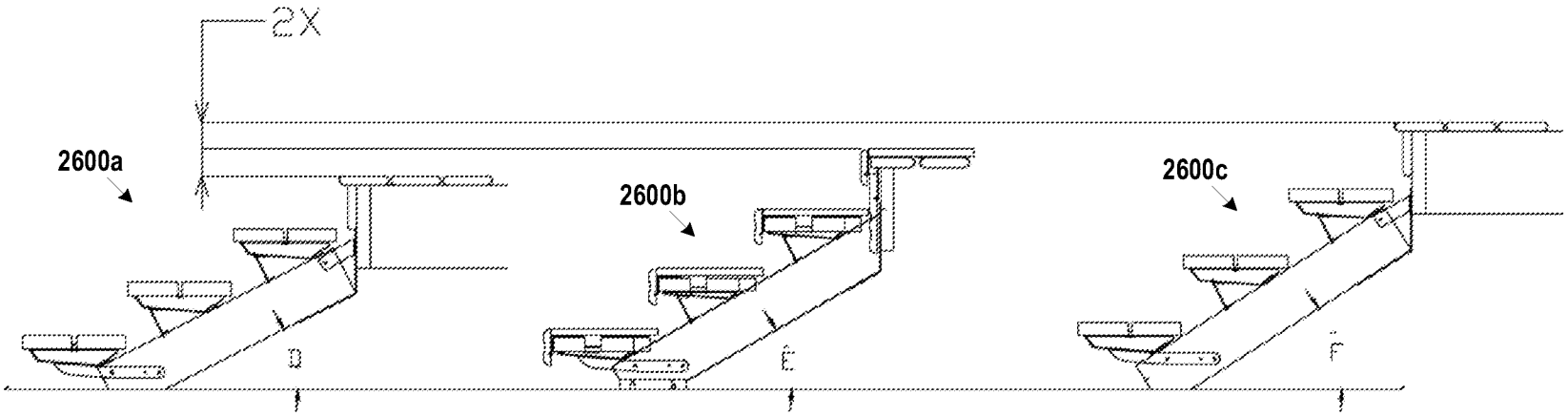
FIG. 26 shows a side view of three modular staircases according to further embodiments described herein, the three staircases each having different slopes and rises and the same run.

FIG. 26 shows three exemplary staircases 2600*a*, 2600*b* and 2600*c* using the component parts of staircase 2500. The treads of each the three staircases have a fixed run that is the same for each of the staircases. However, the rise of the staircases are different and, therefore, the stair stringers of the staircases have different slopes. For instance, the stair stringer of staircase 2600*a* has a slope of D degrees, the stair stringer of staircase 2600*b* has a slope of E degrees and the stair stringer of staircase 2600*c* has a slope of F degrees. In some embodiments, the angles D, E and F can all be within a range of about 25 degrees to about 35 degrees, for example.

The slope of stair stringer of the staircases 2600*a*, 2600*b* and/or 2600*c* may vary depending on factors including but not limited to the type of staircase (e.g. indoor or outdoor application, the type of treads placed thereon, etc.), the location of the staircase, a desired rise of each tread of the staircase, a total rise of the staircase, a total run of the staircase, etc. The jig set to construct comfortable and code compliant staircases can be configured to many applications.

To provide for stair stringers of the staircases 2600*a*-2600*c* to have slopes that vary, some of the component parts of the staircases 2600*a*-2600*c* adapt and/or are adjustable. For instance, the tread support structures (i.e. tread brackets and support brackets) described herein for use with variable slop stair stringers are adaptable to accommodate various potential slopes of the stair stringer 2502.

Figure 27D:
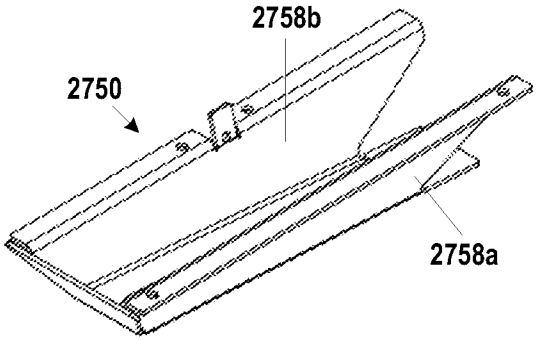
FIGS. 27D to 27F show a perspective view, a side view and a top view, respectively, of a tread bracket according to a second embodiment described herein.
Figure 27E:
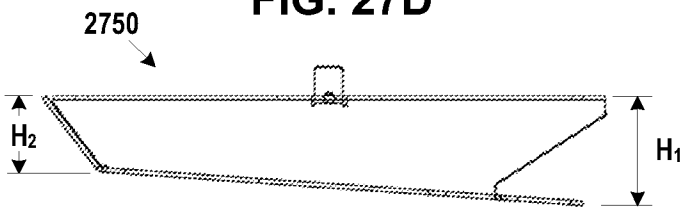
Figure 27F:
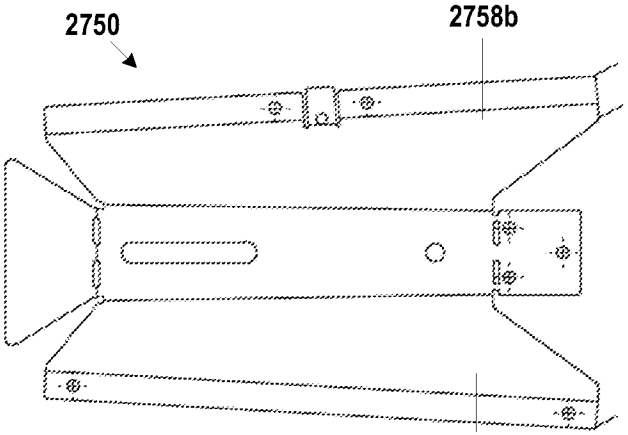
Figure 27A:
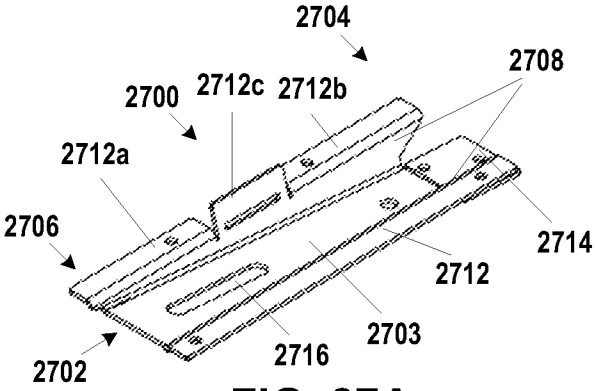
FIGS. 27A to 27C show a perspective view, a side view and a top view, respectively, of a tread bracket according to one embodiment described herein.
Figure 27B:
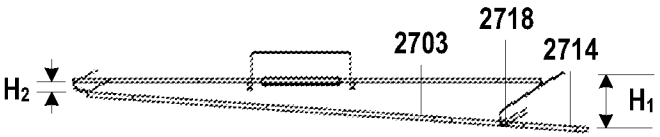
Figure 27C:
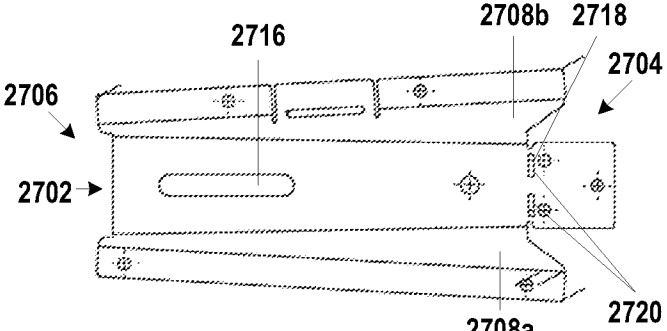

Turning to FIGS. 27A to 27C, illustrated therein are perspective, side view and top views, respectively, of one embodiment of a tread bracket 2700 of a tread support structure described herein. Tread bracket 2700 is used together with a support bracket (described below) to form a tread support structure for coupling a tread to a stair stringer.

FIG. 27A shows that tread bracket 2700 includes a base 2702 having a support bracket receiving portion 2703 and a connection tab 2714. Support bracket receiving portion 2703 and connection tab 2714 are separated by a bending line 2718. Base 2702 is bendable via bending line 2718, however, it should be understood that perforations on bending line 2718 is one example of a mechanism to provide for base 2702 to be field adjustable (e.g. for support bracket receiving portion 2703 to bend relative to connection tab 2714). Base 2702 is manually bendable about bending line 2718 (shown in FIGS. 27B and 27C) separating the support bracket receiving portion 2703 and the connection tab 2714. In the embodiment shown, bending line 2718 includes perforations 2720 (see FIG. 27C) to provide for bending along the bending line 2718. Bending line 2718 provides for the tread bracket 2700 to adapt to the slope of the stair stringer 2502 and provide for a flange 2712 of the tread bracket 2700 to be level with one or both of an upper floor or a lower floor regardless of the slope of the stair stringer 2502.

Base 2702 has a top end 2704 and a bottom end 2706 opposed to top end 2704. Top end 2704 is positioned upwardly (e.g. towards an upper floor) from bottom end 2706 on stair stringer 2502 when tread bracket 2700 is to be affixed to stair stringer 2502.

Returning to FIG. 27A, support bracket receiving portion 2703 includes a slot 2716 formed therein. Slot 2716 is configured to provide for the tread bracket 2700 to releasably couple to a support bracket (described below) that supports the base 2702 above a top surface of the stair stringer. Slot 2716 may be formed in the support bracket receiving portion 2703 at a position towards the bottom end 2706 of the base 2702.

Connection tab 2714 is configured to be affixed to stair stringer 2502 (e.g. by fasteners). Support bracket receiving portion 2703 is configured to receive a support bracket and provide for the support bracket to support the base 2702 above a top surface of a stair stringer 2502 when level.

Tread bracket 2700 also includes a flange 2712 configured to receive a tread of the staircase (see FIG. 27A). Flange 2712 extends away from one or more extending members 2708 of the tread bracket 2700 at an angle to provide for a tread received by the flange 2712 and affixed to the flange to be level with at least one of an upper floor and a lower floor when the staircase is constructed. Flange 2712 can be configured to receive different styles of treads for different applications. For instance, in some embodiments, flange 2712 can include more than one planar portion to provide a flat surface for supporting more than one tread plank. In the embodiment shown in FIGS. 27A-C, the flange 2712 includes a first portion 2712*a* and a second portion 2712*b*. In other embodiments, flange 2712 can include one or more upwardly extending portions (such as 2712*c*) that space apart two treads received on the flange 2712.

Tread bracket 2700 also includes one or more side extending members 2708 coupling the base 2702 to a flange 2712. The members 2708 extend upwardly from the base to coupling base 2702 to flange 2712. In some embodiments, one or more of the side members 2708 may extend upwardly from the base 2702 at an angle greater than 90 degrees relative to the base 2702. In other embodiments, the side members 2708 may extend upwardly from the base 2702 at a 90 angle relative to the base 2702.

For instance, as shown in FIG. 27C, tread bracket 2700 includes two upwardly extending members 2708*a* and 2708*b* extending upwardly from opposed sides of base 2702. Each of side members 2708*a* and 2708*b* has a first height Hi at top end 2704 of base 2702 and a second height $H_2$ at bottom end 2706 of base 2702 (as shown in FIG. 27B). In some embodiments, first height $H_1$ is greater than second height $H_2$.

FIGS. 27D to 27F show another embodiment of a tread bracket 2750 where two side members 2758*a* and 2758*b* extend upwardly from opposed sides of the base 2702 and each have heights $H_1$ and $H_2$, that are greater than respective heights $H_1$ and $H_2$ of side members 2708*a* and 2708*b* of tread bracket 2750. This tread bracket may be appropriate for use in applications where treads supported by the tread bracket 2750 are thinner than those supported by tread bracket 2700.

Figure 28A:
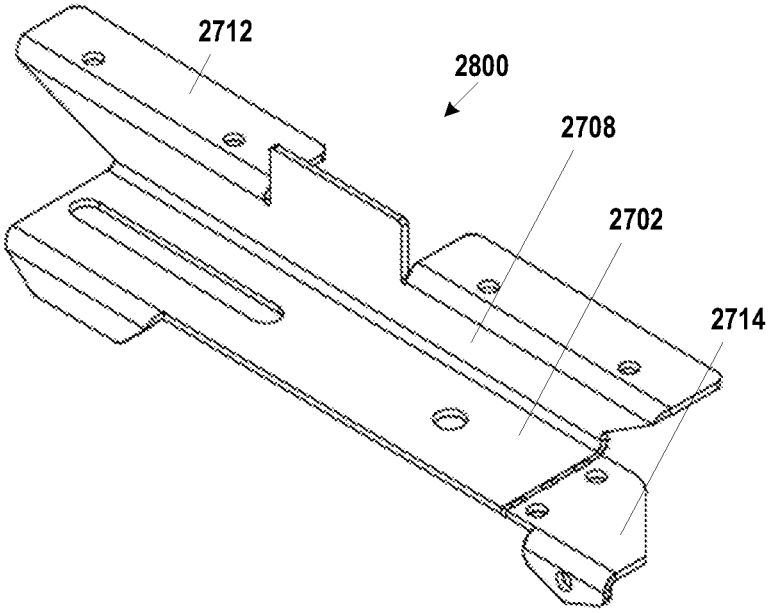
FIGS. 28A and 28B show a perspective view and a side view, respectively, of a tread bracket according to a third embodiment described herein.
Figure 28B:
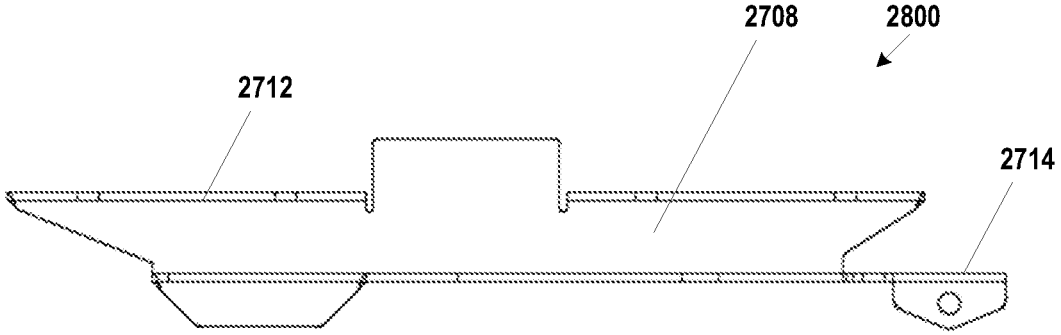

Another embodiment of tread bracket 2800 is shown in FIGS. 28A and 28B. This embodiment includes one side member 2708 extending upwardly from base 2702.

The tread brackets described herein, including but not limited to tread brackets 2700 and 2800, may be formed from a variety of materials, such as but not limited to formed steel and plastic. The tread brackets described herein could be formed by a variety of methods including but not limited to fabrication (e.g. cutting, bending and assembling), stamping, casting and injection molding.

Figure 29A:
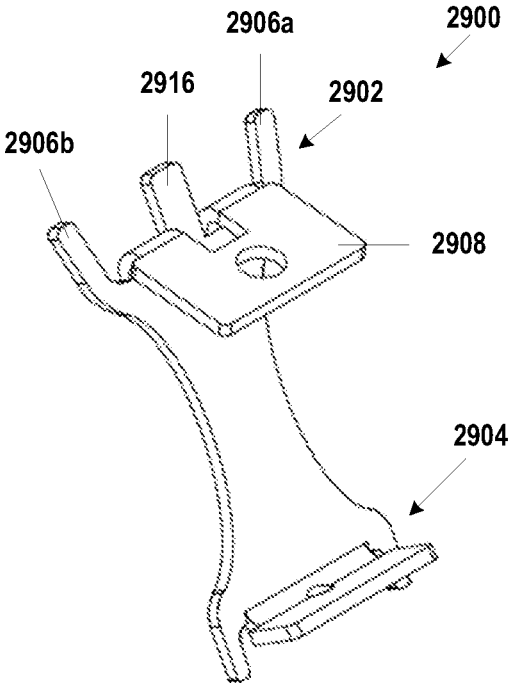
FIGS. 29A to 29C show perspective, side and rear views, respectively, of a support bracket, according to one embodiment described herein.
Figure 29B:
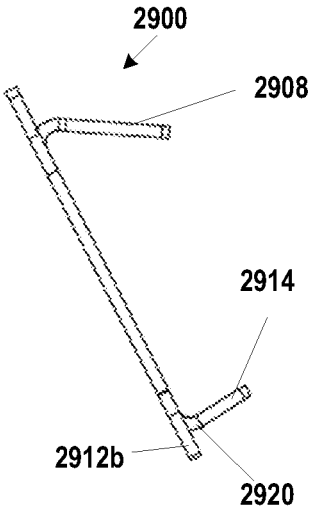
Figure 29C:
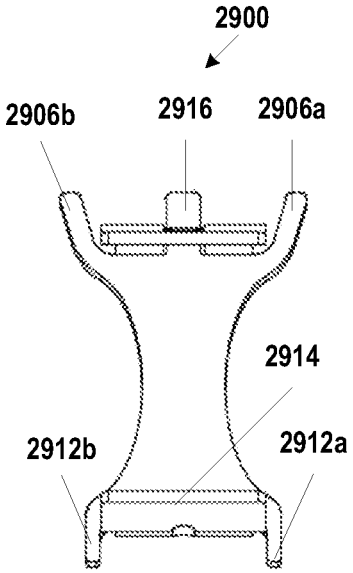

FIGS. 29A to 29C show a support bracket 2900 of a tread support structure, described herein, according to one embodiment. The support brackets described herein generally support a tread bracket (e.g. tread bracket 2700) on the stair stringer and provide for the tread bracket to support a tread that is parallel with an upper and/or a lower floor adjacent to the staircase. As the tread brackets described herein are adaptable (e.g. bendable) to accommodate various slopes of a stair stringer, the support bracket 2900 slidably engages the tread bracket and comes to rest at the stair stringer to accommodate a position of the tread brackets on the stair stringer. In some embodiments, the support brackets described herein adapt to accommodate various slopes of a stair stringer by being able to support a tread bracket a various positions along the stair stringer. In other embodiments, the support brackets described herein adapt to accommodate various slopes of a stair stringer by having an adjustable height. Herein, at least two embodiments of support brackets that apt to accommodate various slopes of a stair stringer are provided, however, it should be understood that other designs and configurations of support brackets that fall within the scope of the support brackets described herein may be possible.

Support bracket 2900 includes an upper receiving portion 2902 configured to couple to the tread bracket and a lower receiving portion 2904 configured to couple to a top edge of the stringer and support the tread bracket (such as any of the tread brackets shown in FIGS. 27 and 28 and described above) when the tread bracket is parallel with a ground surface.

In support bracket 2900, upper receiving portion 2902 (see FIG. 29A) includes two upwardly extending projections 2906*a* and 2906*b* spaced apart to receive a tread bracket therebetween. Upper receiving portion 2902 also includes an upper connection tab 2908 extending away from upwardly extending projections 2906*a* and 2906*b* for coupling support bracket 2900 to a tread bracket. The two upwardly extending projections 2906*a* and 2906*b* may be spaced apart by a distance that provides for the two upwardly extending projections to partially surround a base of the tread bracket.

Upper receiving portion 2902 may also include a middle upwardly extending projection 2916 positioned between the two spaced apart upwardly extending projections 2906*a* and 2906*b*. Middle upwardly extending projection 2916 may be sized and shaped to be received in a slot of the tread bracket (described above) to secure the support bracket 2900 to a tread bracket and from a tread support structure.

In support bracket 2900, lower receiving portion 2904 may include two downwardly extending projections 2912*a* and 2912*b* (see 29C) spaced apart to receive a stair stringer therebetween. Lower receiving portion 2904 may also include a lower connection tab 2914 extending away from downwardly extending projections 2912*a* and 2912*b* for coupling support bracket 2900 to a stair stringer. The downwardly extending projections 2912*a* and 2912*b* may be spaced apart by a distance that provides for the two downwardly extending projections 2912*a* and 2912*b* to partially surround the stair stringer and provides for support bracket 2900 to self-center on a top edge of the stair stringer.

In some embodiments, lower connection tab 2914 (see FIG. 29B) extends away from the downwardly extending projections 2912*a* and 2912*b* at an angle that provides for an edge 2920 of the lower connection tab 2914 to be attached directly to a top edge of the stair stringer when the support bracket 2900 engages the stair stringer.

Figure 30:
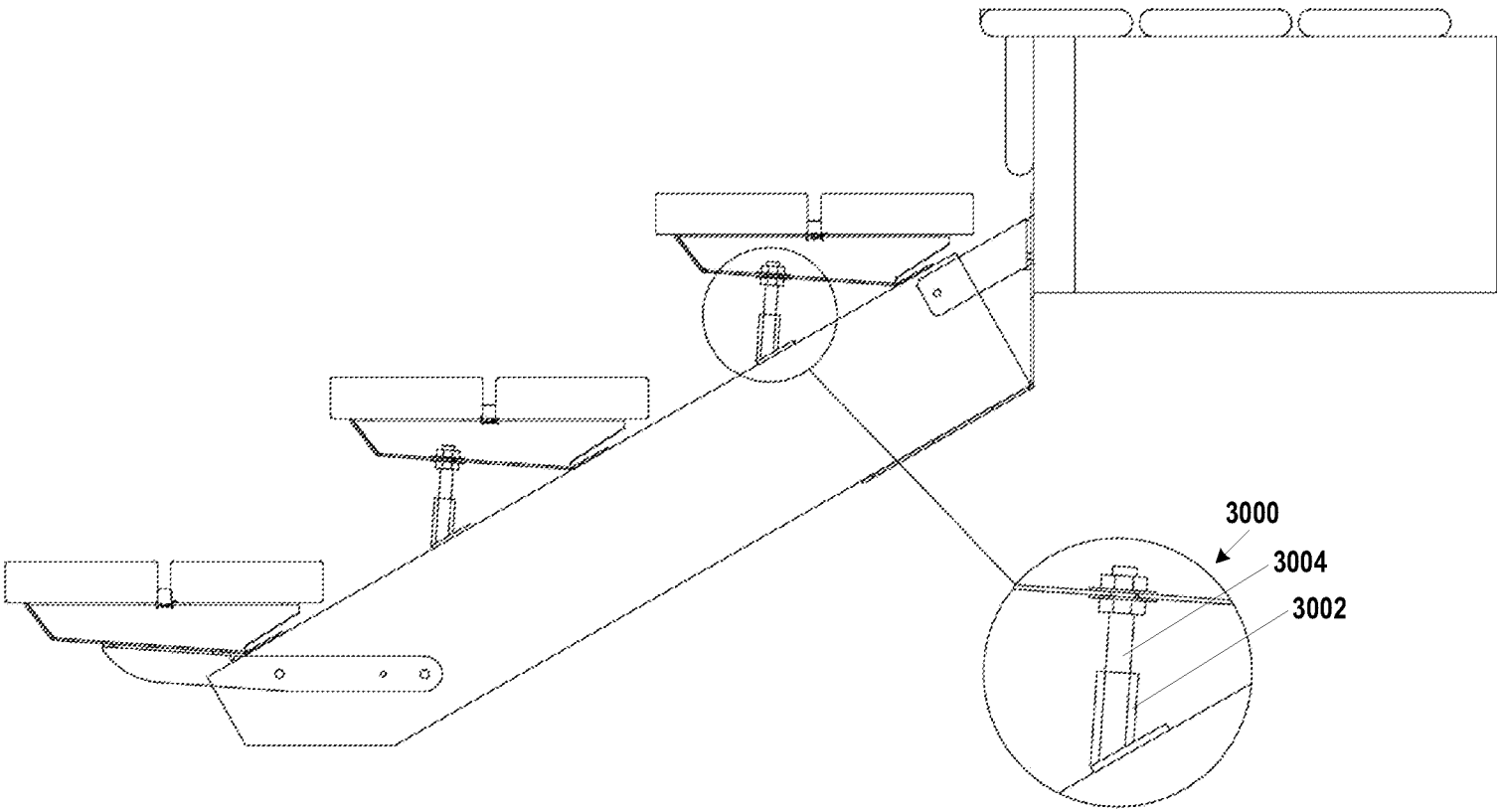
FIG. 30 shows a side view of a staircase having tread support structures with support brackets according to another embodiment.
Figure 31A:
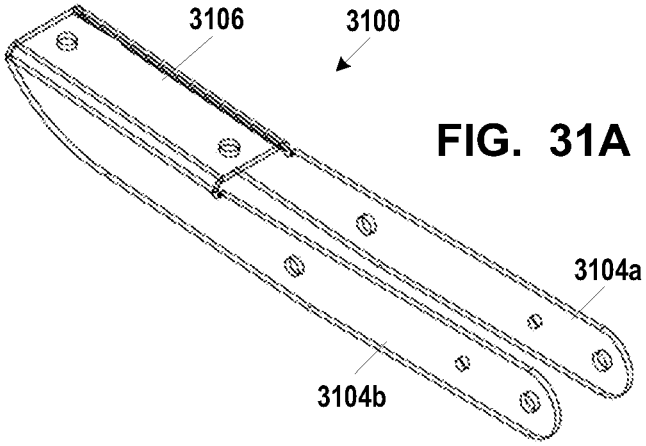
FIGS. 31A to 31D show a perspective, a top, a side and an end view, respectively, of a base support bracket, according to another embodiment described herein.
Figure 31B:
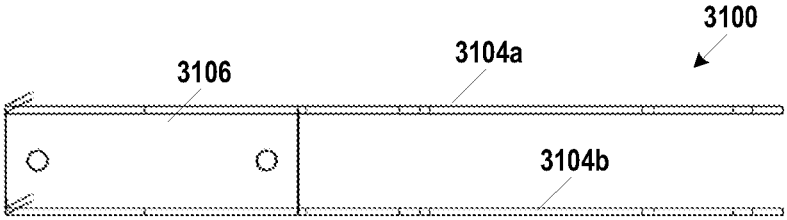
Figure 31D:
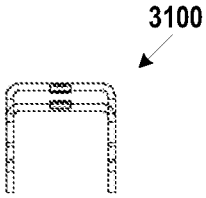
Figure 31C:
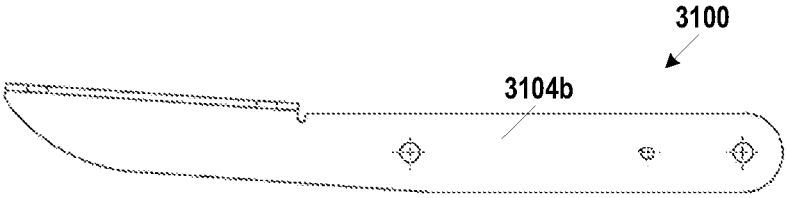

Another embodiment of a support bracket of a tread support structure is shown in FIG. 30. Support bracket 3000 has a variable height and includes a mounting portion 3002 configured to be mounted to a top edge of a stair stringer and a threaded rod 3004 extending upwardly from the mounting portion 3002. Mounting portion 3002 is configured to slide along top edge of the stair stringer, to be mounted to the top edge of the stair stringer to adapt to the variability of the distance between the tread bracket and the top edge of the stair stringer.

Threaded rod 3004 provides for tread support bracket 3000 to have a variable height. Threaded rod 3004 is configured to insert directly into a slot of a tread bracket (e.g. tread bracket 2700). Nuts (and optionally washers) can be used to secure the threaded rod 3004 to the tread bracket.

FIGS. 31A to 31D show perspective, top, end and side views, respectively, of a base tread support bracket 3100 according to one embodiment. Specifically, base tread support 3100 is configured to connect to both side surfaces of the stair stringer. This additional support (i.e. being configured to be affixed to the side surfaces of the stair stringer) provides for the base tread support 3100 to engage a smaller portion of the top surface of the stair stringer when compared with tread support structures in FIGS. 27 to 29, and described above, to support the lowermost tread of the staircase.

Specifically, in this embodiment, base tread support 3100 includes two parallel side stringer mounting portions 3104*a* and 3104*b* and a tread support portion 3106. Side stringer mounting portions 3104*a* and 3104*b* are configured to engage and be affixed (e.g. by one or more fasteners) to opposed side surfaces of the stair stringer. Tread support portion 3106 extends away from mounting portions 3104*a* and 3104*b* at an angle and provides for the tread bracket to be level with at least one of an upper floor and a lower floor when supported on tread support portion 3106 and the mounting portions are connected to the stringer.

Staircase 2500, for example, having a variable slope can be constructed using a set of jigs, such as but not limited to the first jig 3200 and the second jig 3300 shown in FIG. 32 and FIG. 33 respectively, and in FIGS. 35A to 35G (described in greater detail below). The jigs 3200 and 3300 are configured to determine a slope of the staircase, to position of each of the tread support structures on the stair stringer, to determine a length and cut-off point of the stair stringer based on the total rise of the staircase, and to provide a mounting position of the stair stringer with respect to the upper floor.

Figure 32:
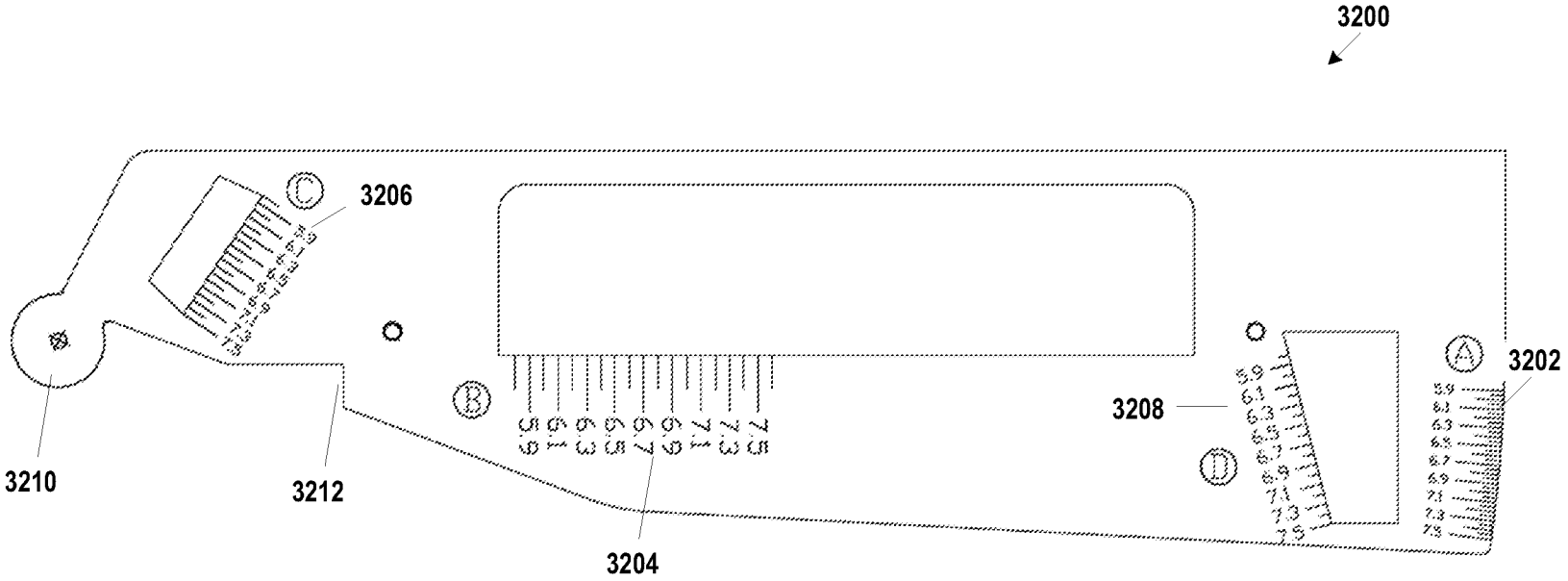
FIG. 32 shows a side view of a first jig of a set of jigs for constructing a staircase, according to one embodiment described herein.

FIG. 32 shows a side view of a first jig 3200 of a set of jigs for constructing a staircase. The first jig 3200 includes four scales: first scale 3202, second scale 3204, third scale 3206 and fourth scale 3208, and a ball joint 3210. FIG. 33 shows a side view of a second jig 3300 of a set of jigs for constructing a staircase. Second jig 3300 includes first scale 3302 and second scale 3304, feature 3306 and socket 3308.

First jig 3200 and second jig 3300 are coupleable to each other (see FIG. 35A) and are used to determine a slope of the stair stringer of the staircase.

Figure 33:
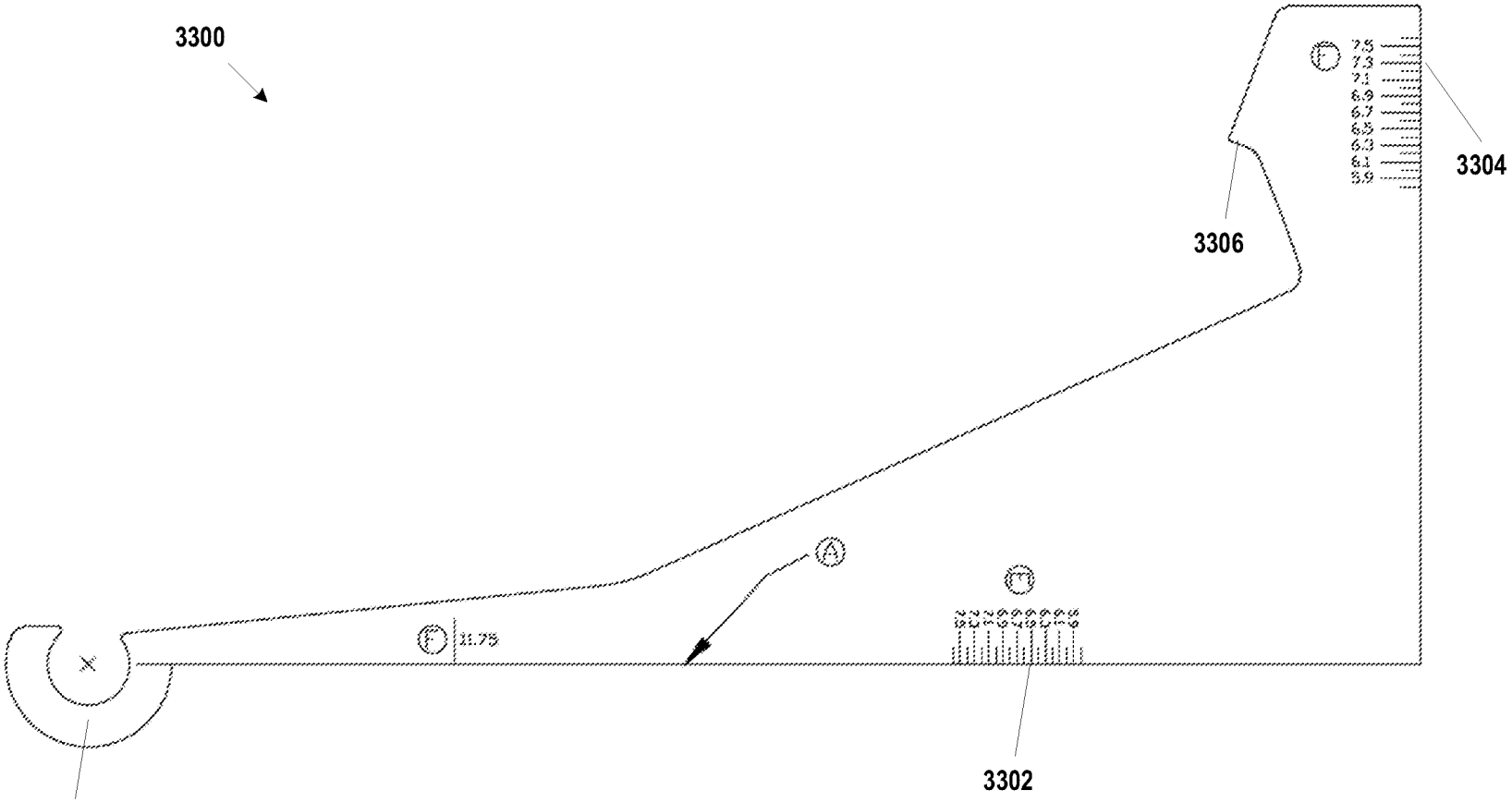
FIG. 33 shows a side view of a second jig of a set of jigs for constructing a staircase, according to one embodiment described herein.
Figure 34:
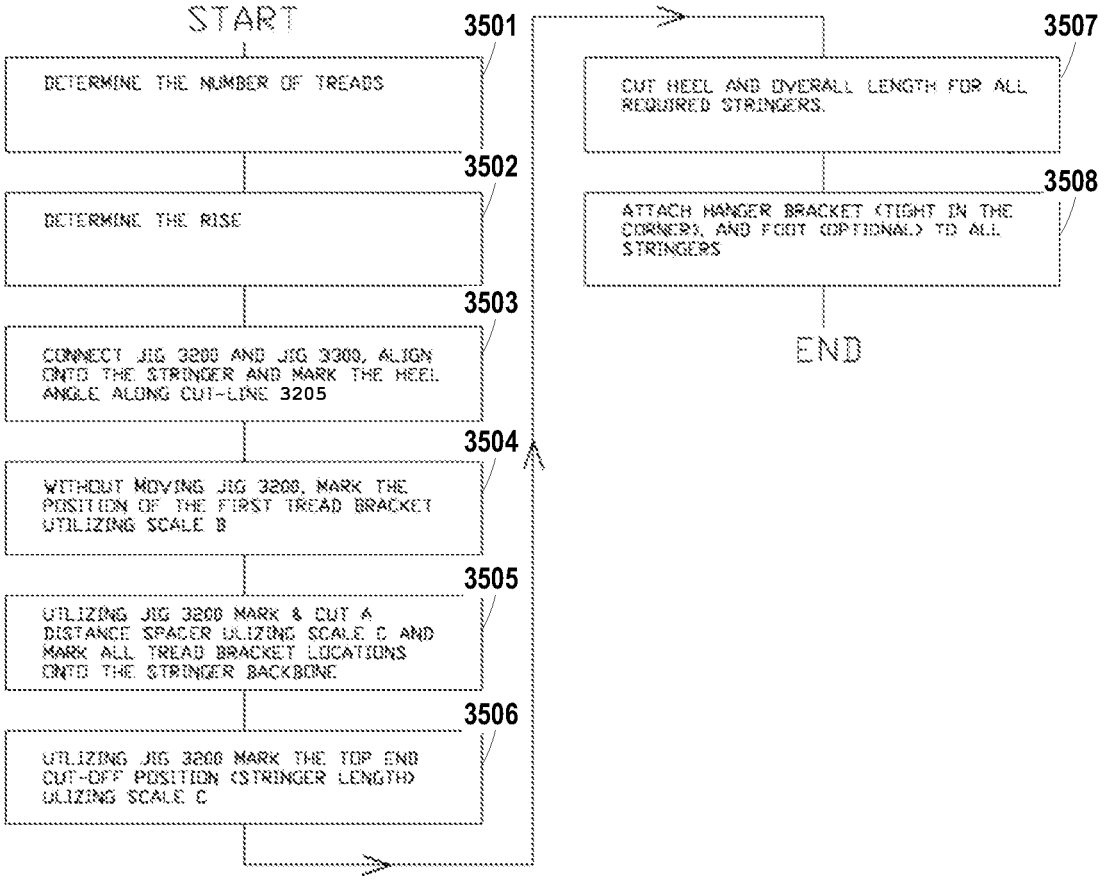
FIG. 34 shows a block diagram of a method of preparing a stair stringer, according to another embodiment.
Figure 35A:
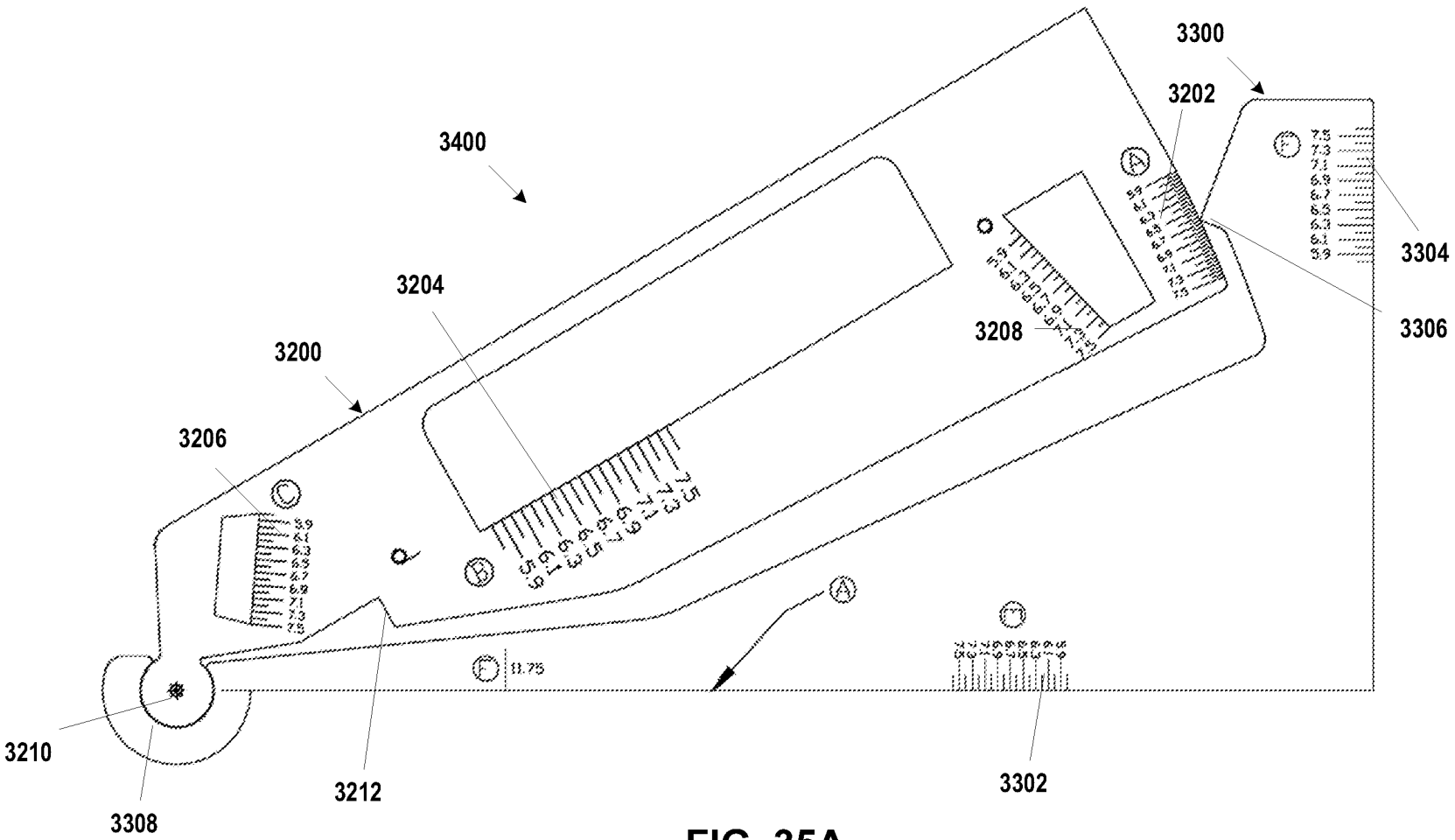
FIG. 35A shows a side view of the first jig of FIG. 32 coupled to the second jig of FIG. 33 for establishing the slope of a staircase.

FIG. 35A shows a side view of the set of jigs 3400 including the first jig 3200 of FIG. 32 and the second jig 3300 of FIG. 33 for constructing a staircase. In this embodiment, first jig 3200 is coupled to second jig 3300 by ball joint 3210 of first jig 3200 being inserted into socket 3310 of second jig 3300. In this configuration, second jig 3300 can rotate about the ball joint 3210. It should be understood that the ball joint 3210 of the first jig 3200 and the socket 3310 of the second jig 3300 are only one example of how the first jig 3200 and the second jig 3300 can be coupled to each other. Generally, first jig 3200 and second jig 3300 are coupleable to each other to provide for the second jig 3300 to move (e.g. rotate) about the first jig 3200 to determine a position of a first cut line of on the stair stringer 2502 (described in further detail below).

Below, reference will be made to FIGS. 32, 33, 34 and 35A-35G, which shows a method 3500 of assembling a stair stringer. FIGS. 35A-35G provide illustrative examples of some of the steps of the method 3500.

At step 3501, the number of treads of the staircase is determined. Generally, the number of treads of the staircase is determined is determined by measuring a height of the staircase and dividing the height of the staircase by a largest rise shown on each of the scales of the first jig 3200. For instance, one jig set comprising of jig 3200 and jig 3300 offers a range rises between about 5.9 inches and about 7.4 inches. Once a number has been obtained by performing this calculation, the number is rounded up to the nearest whole number and then 1 is subtracted from the number to determine the number of treads required for the staircase.

At a step 3502 of the method 3500, the rise of each of the treads of the staircase is determined by dividing the height of the staircase by the sum of treads required plus 1.

Jig 3200 has first and second pins 3214*a* and 3214*b*, respectively, for resting against a top edge 2502*t* of a stair stringer 2502 to properly align the jig 3200 and the stair stringer 2502 for marking the first cut line 3205. First cut line 3205 is indicated by a first edge 3312 of the second jig 3300 when an end of the stair stringer 2502 is aligned with first edge 3202, the top edge of the stringer rests against the first and second pins 3214*a* and 3214*b* and feature 3308 of the second jig 3300 is aligned with a desired rise of the treads of the staircase of the first scale 3202 of the first jig 3200.

Figure 35B:
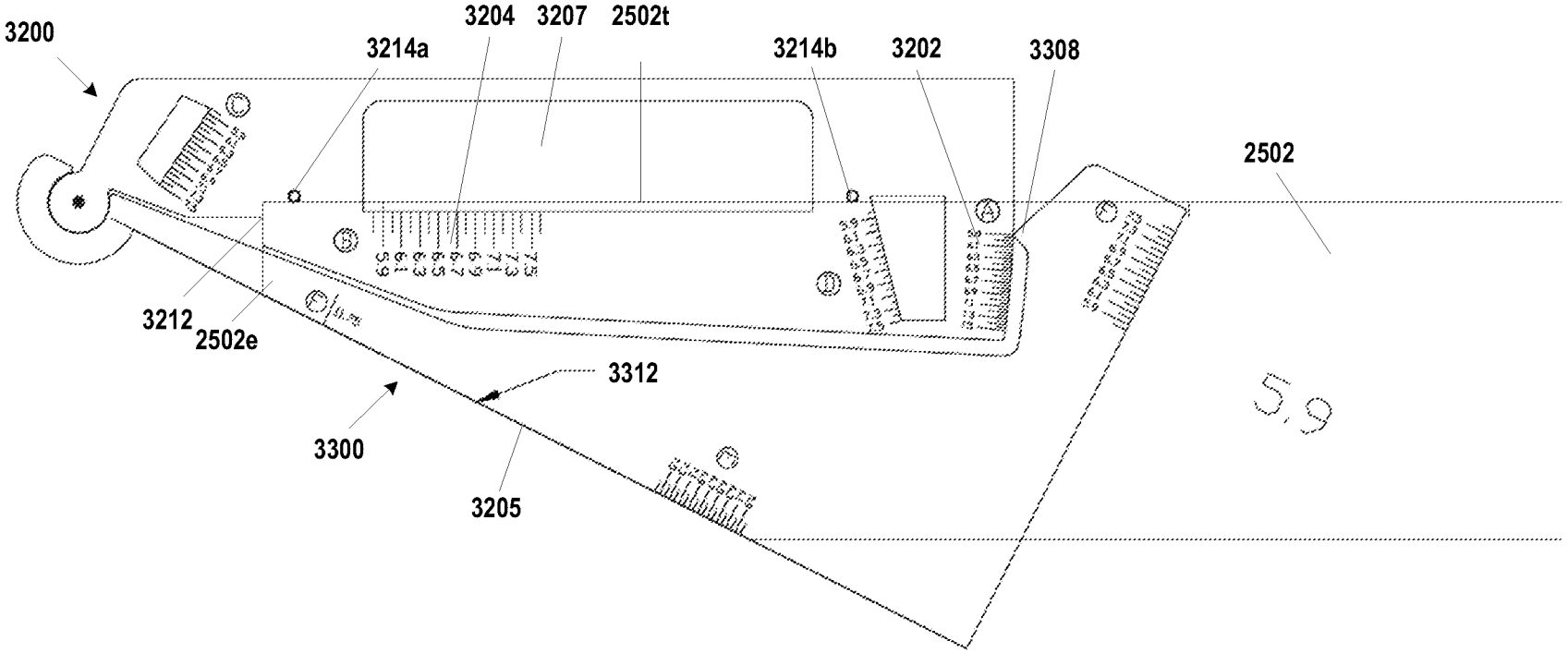
FIG. 35B shows a side view of the jigs of FIGS. 32 and 33 being used to mark a first cut line on a stair stringer during a method of preparing a stair stringer, according to one embodiment.

At step 3504, also shown in FIG. 35B, to mark a position of a lowermost tread bracket on the stair stringer 2502, a mark is placed on the stringer adjacent to a marking of second scale 3204 of jig 3200 in first window 3207 corresponding to a desired rise of the tread when the end of the stringer 2502*e* is aligned with first edge 3212 and top edge 2502*t* of the stair stringer 2502 rests against first and second pins 2204*a* and 2204*b*.

Figure 35C:
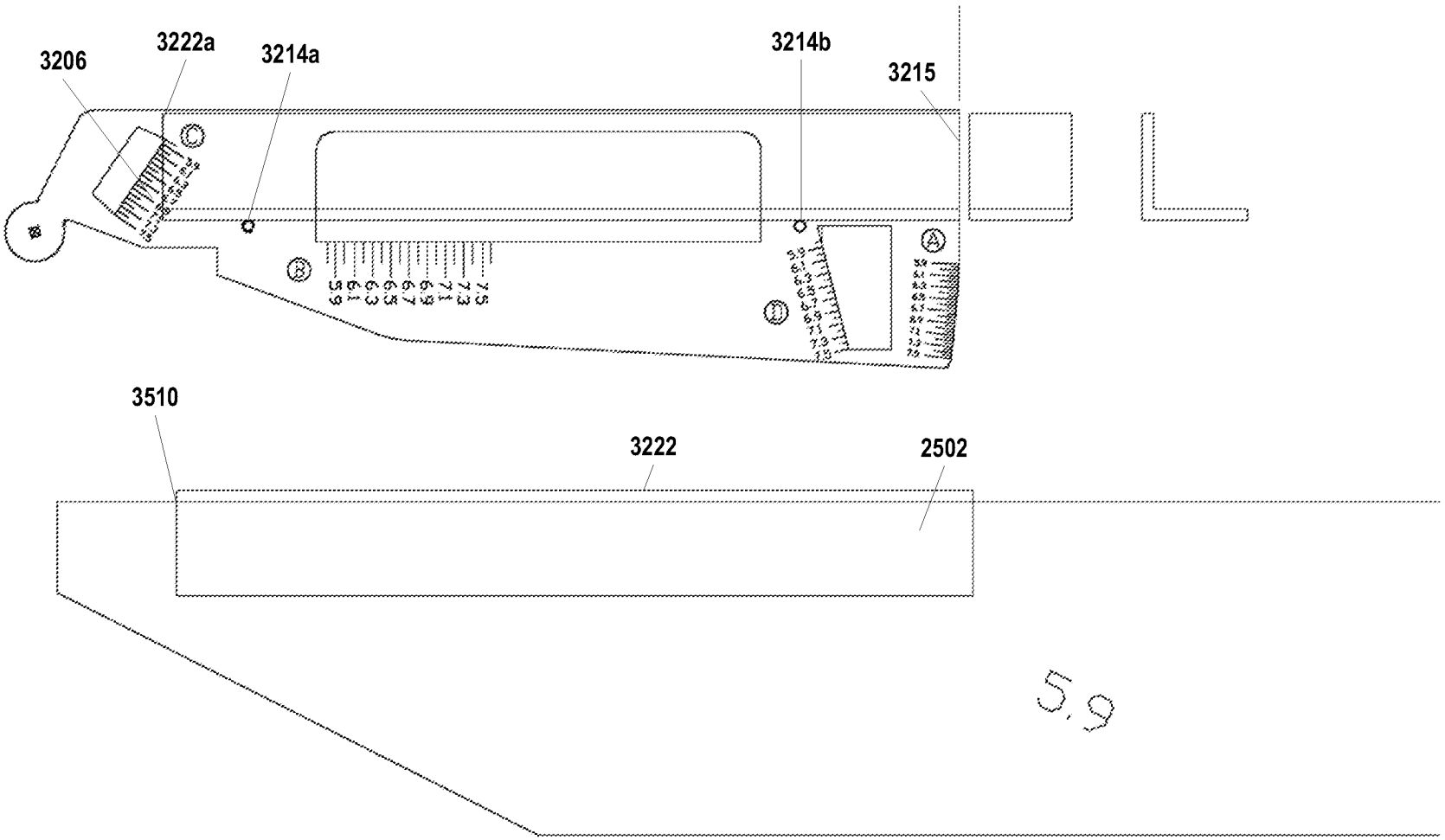
FIGS. 35C shows a side view of the jig of FIG. 32 being used to prepare a spacer jig for use in a method of preparing a stair stringer, according to one embodiment.

At step 3505, to mark a position of the remaining tread brackets on the stair stringer 2502, a spacer jig 3222 can be made using the jig 3200. This is shown in FIG. 35C. The spacer jig 3222 has a length corresponding to a distance from an edge 3215 of the jig 3200 to the end 3222*a* when the spacer jig rests on the pins 3214*a* and 3214*b*. Specifically, the length of the spacer jig 3222 is equal to a distance between a marking of third scale 3206 of the jig 3200 corresponding to the rise of each tread of the staircase and third edge 3215 of the jig 3200 when the spacer jig rests on the pins 3214*a* and 3214*b*.

To mark the tread bracket locations on the stringer, the spacer jig 3222 placed against the stringer and used to measure a distance upwardly from the lowermost tread bracket position 3510 to the top end of the stair stringer 2502 (see FIG. 35C).

Figure 35D:
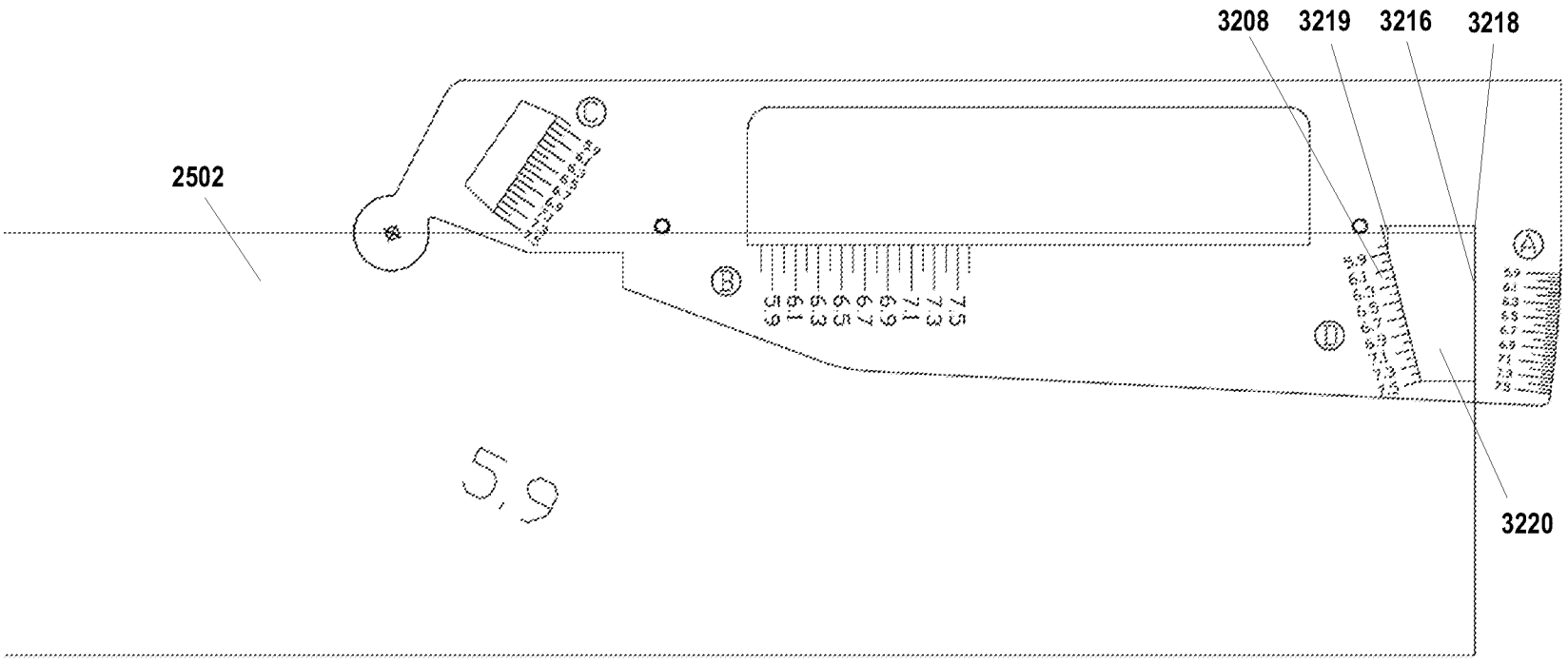
FIGS. 35D shows a side view of the jig of FIG. 32 being used to mark a second cut line on a stair stringer in a method of preparing a stair stringer, according to one embodiment.

At step 3506 and as per FIG. 35D, to mark second cut line 3216 on the stringer, a mark is placed on the stringer along a fourth edge 3218 of jig 3200 in a window 3220 when a mark of position 3219 of the uppermost tread is aligned with a mark of fourth scale 3208 representing the rise of each tread of the staircase when the stringer is placed against the first pin 3214*a* and the second pin 3214*b*. In the embodiment shown, the rise of each tread of the staircase is 5.9 inches and position 3219 of uppermost tread is shown aligned with the marking corresponding to 5.9 inches of fourth scale 3208. A square can be used to extend the mark made on the stringer to provide a square cut line 3216.

Figure 35E:
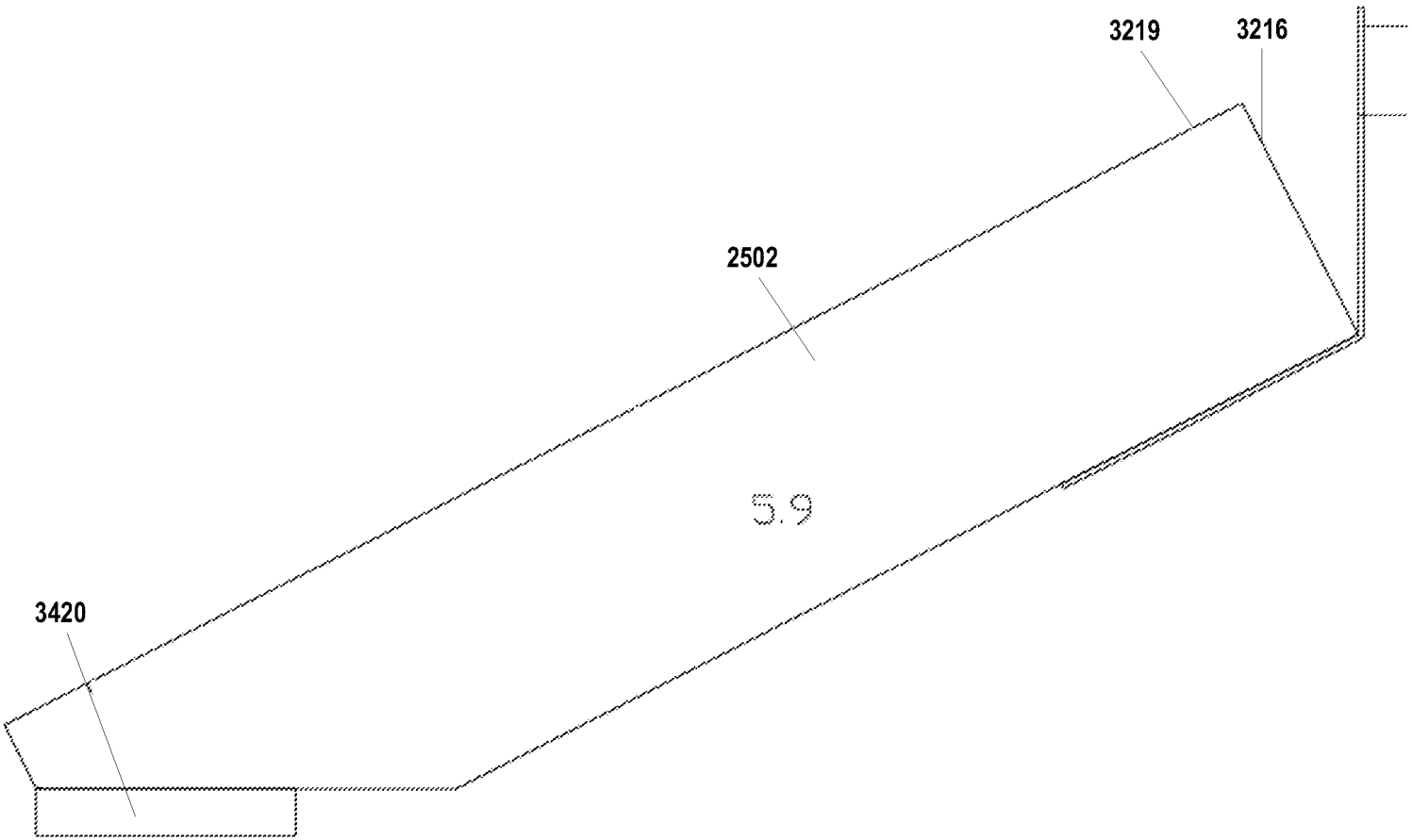
FIGS. 35E shows a side view of a stair stringer prepared using the jigs of FIGS. 32 and 33 in a method of preparing a stair stringer, according to one embodiment.

At FIG. 35E, at steps 3507 and 3508, the top of the stringer is cut along the second cut line 3216 and the hanger bracket is attached to the stair stringer 2502. An optional foot 3420 may also be attached to the stair stringer.

Figure 35F:
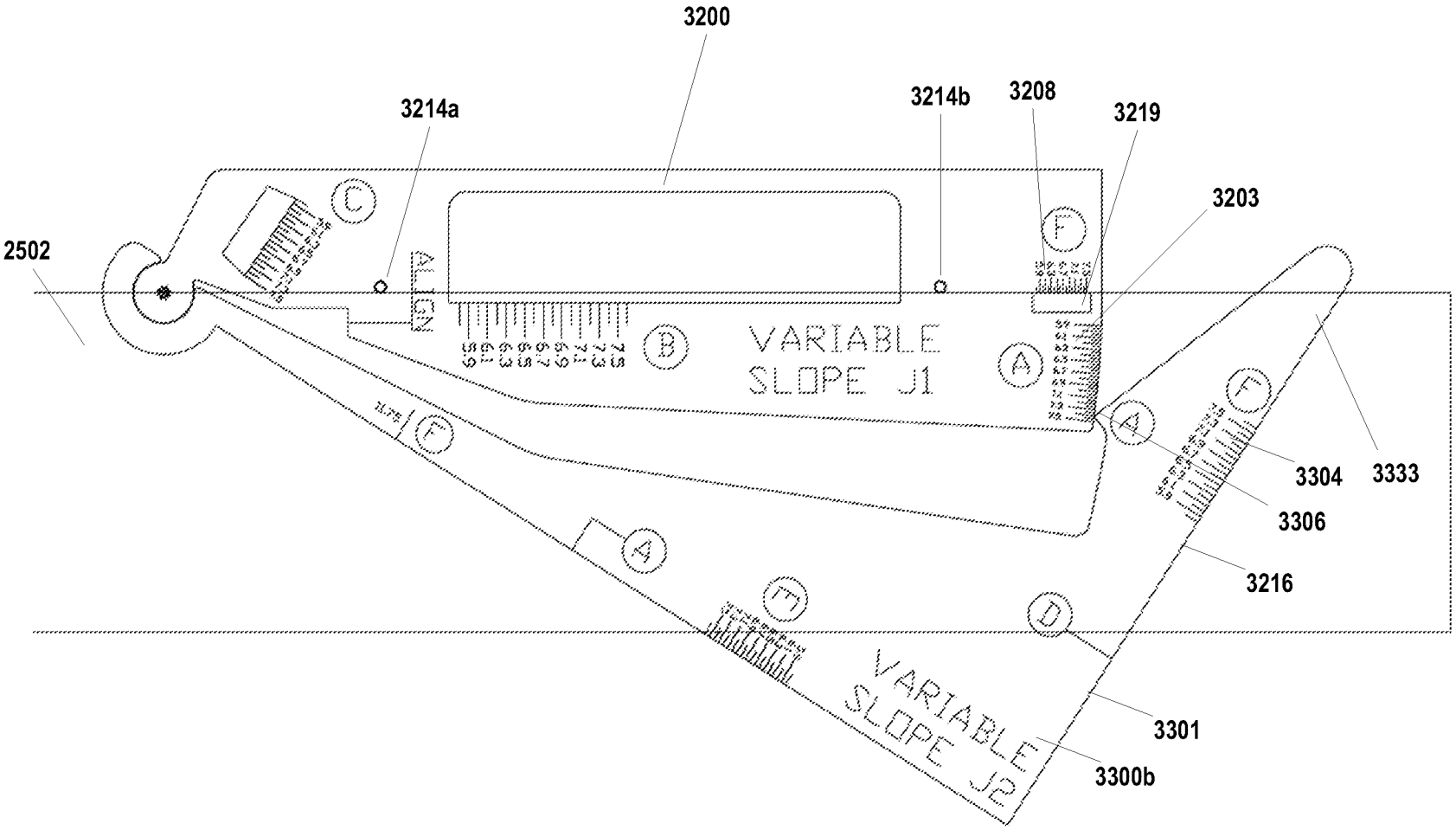
FIGS. 35F shows a side view of the jig of FIG. 32 and an alternate embodiment of the jig of FIG. 33 having an upwardly extending portion used to mark a second cut line on a stair stringer in a method of preparing a stair stringer, according to another embodiment.
Figure 35G:
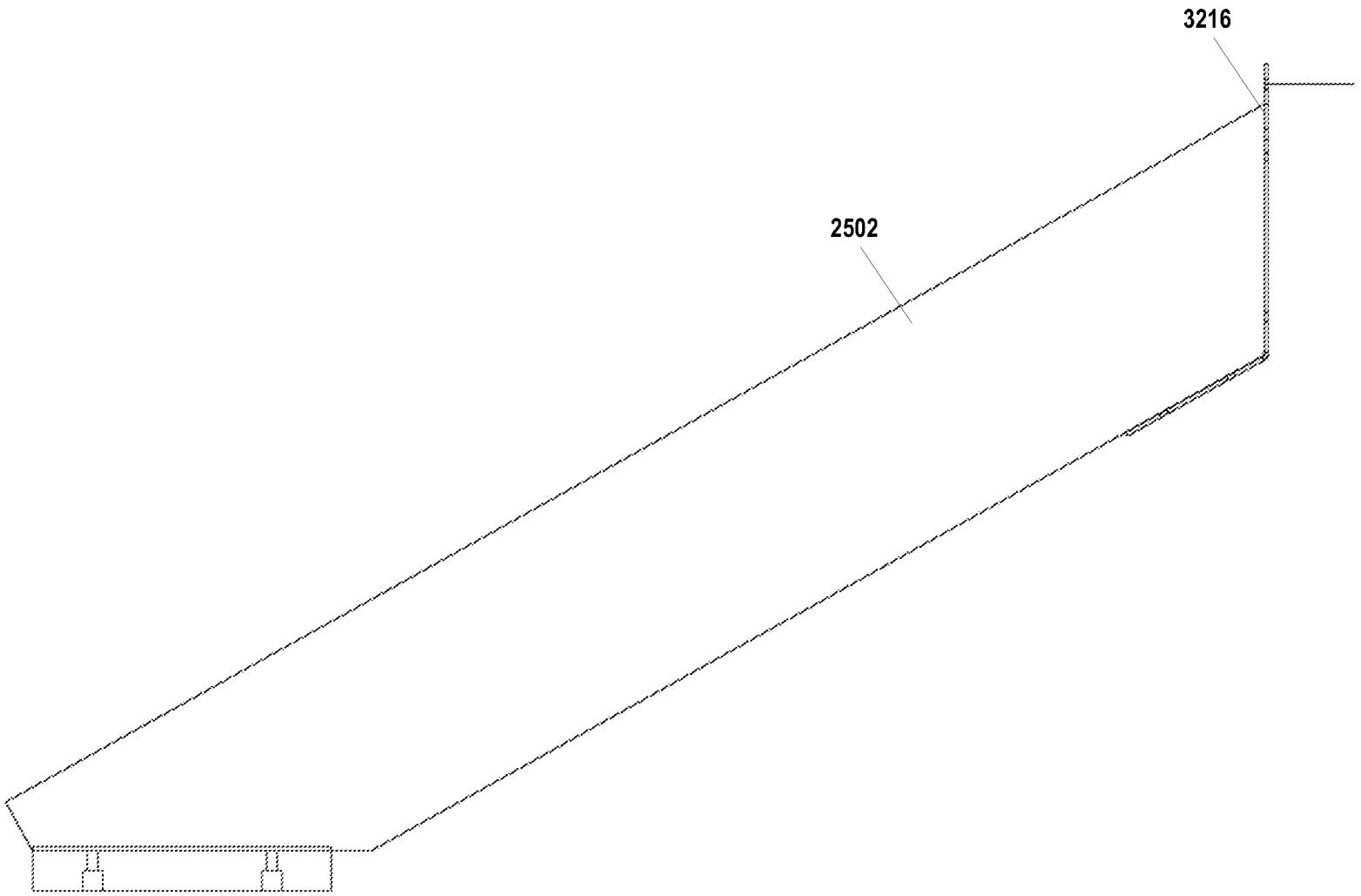
FIGS. 35G shows a side view of a stair stringer prepared using the jigs of FIGS. 32 and 33 in a method of preparing a stair stringer, according to another embodiment.

An alternative embodiment to step 3506 is shown in FIG. 35F, where second cut line 3216 can be marked on the stair stringer using jigs 3200 and 3300*b*. In this embodiment, the jig 3300*b* includes an upwardly extending portion 3333 adjacent to scale 3304. Upwardly extending portion 3333 extends the length of edge 3301 to provide for marking a longer cut line 3216 on the stringer than is available with jig 3300. By resting pins 3214*a* and 3214*b* of jig 3200 on the top edge of the stair stringer 2502, and aligning a mark of position 3219 of the uppermost tread with a mark of fourth scale 3208 representing the rise of each tread of the staircase, the second cut line 3216 can be determined using edge 3301 of jig 3300*b* when jig 3300*b* and 3200 are coupled to each other and jig 3300*b* is rotated relative to jig 3200 such that feature 3306 of jig 3300*b* is aligned with a mark of first scale 3202 representing the rise of each tread of the staircase. In the embodiment shown, the rise of each tread of the staircase is 7.4 inches. Using this alternative step, the jigs 3200 and 3300*b* provide for an upper end of stringer 2502 to be cut at an angle relative to a bottom edge of the stair stringer 2502 that corresponds to an angle of a hanger bracket so, after stair stringer 2502 is cut at second cut line 3216, the upper end of the stair stringer 2502 is flush with the hanger bracket when the stair stringer 2502 is mounted to the hanger bracket. An example of this is shown in FIG. 35G.

Figure 36A:
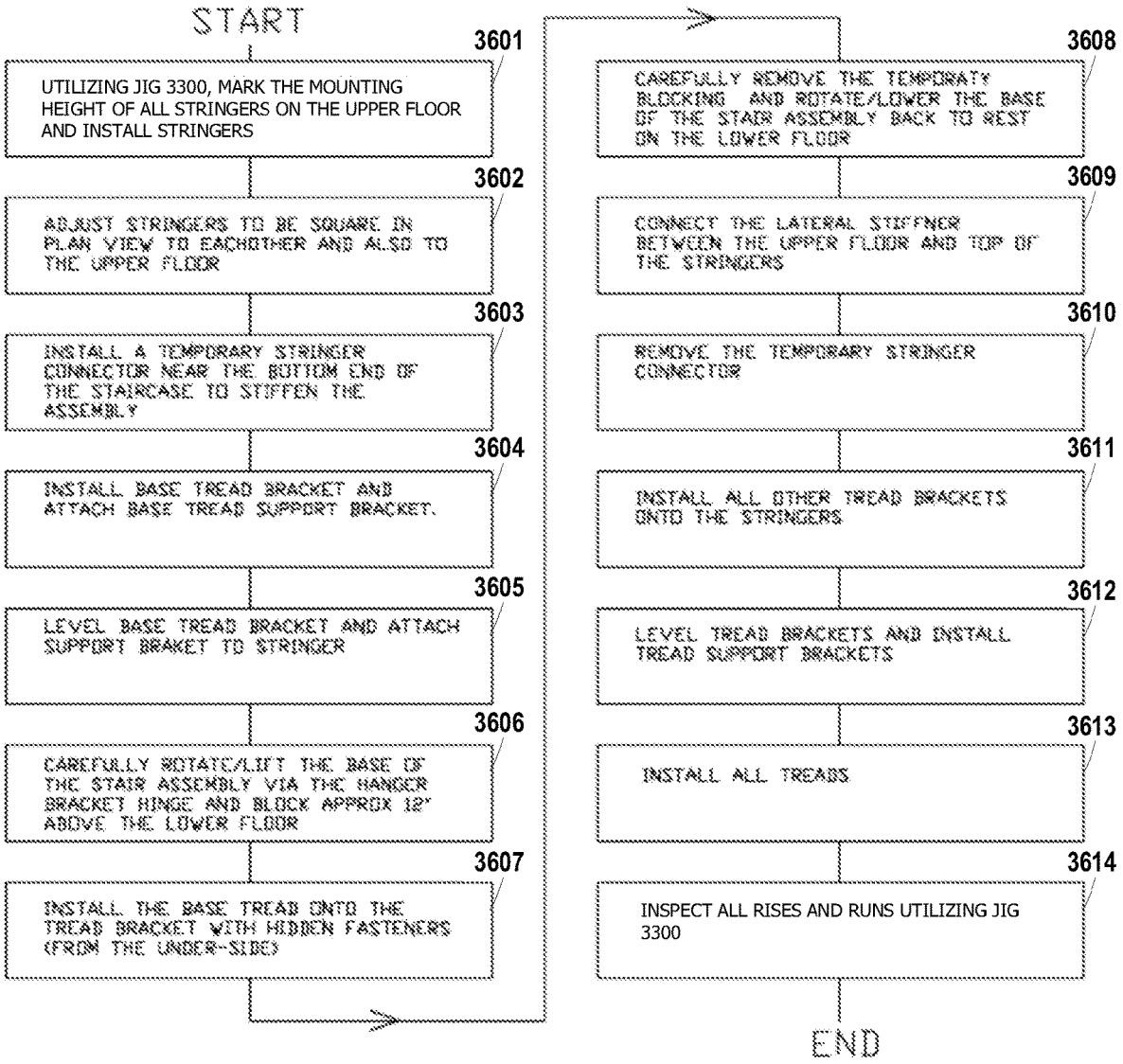
FIG. 36A shows a block diagram of a method of constructing a staircase assembly, according to another embodiment.
Figure 36B:
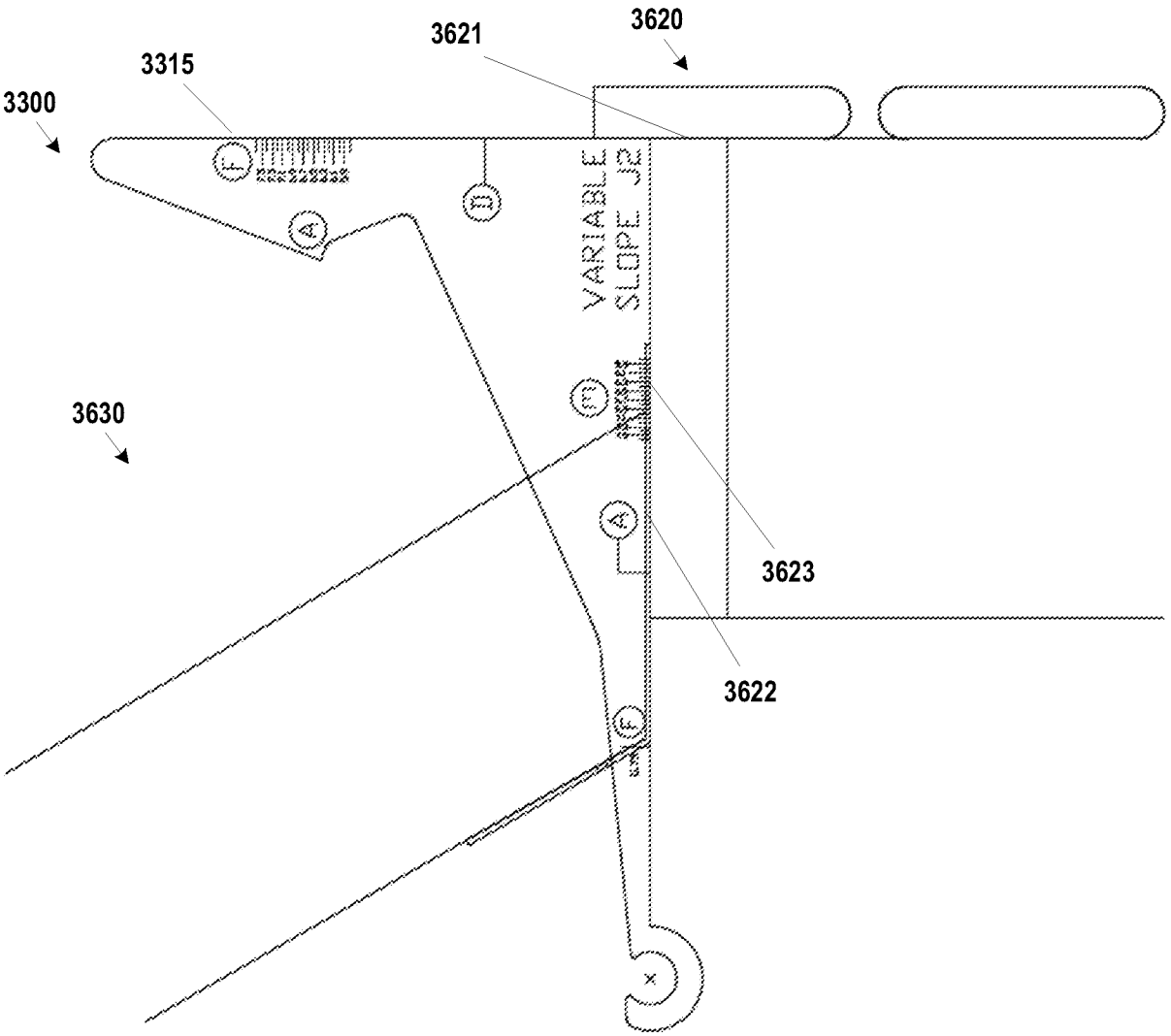
FIG. 36B shows a side view of the jig of FIG. 33 being used to mount a hanger bracket in the method of constructing a staircase of FIG. 36A.

FIG. 36A shows a block diagram of a method 3600 of constructing a staircase. Method 3600 includes at a step 3601, marking a mounting height of all the stair stringers of the staircase on an upper floor. All stringers are then installed (i.e. mounted) to the upper floor. A portion of an example staircase 3630 illustrating this is shown in FIG. 36B. As shown, edge 3315 of the jig 3300 is aligned with a top surface 3621 of the upper floor 3620 and against a face 3622 of the upper floor 3620 such that first scale 3202 identifies a mounting position 3623 of the hanger bracket at a mark of the first scale 3202 corresponding to the rise of the treads of the staircase.

Figure 36C:
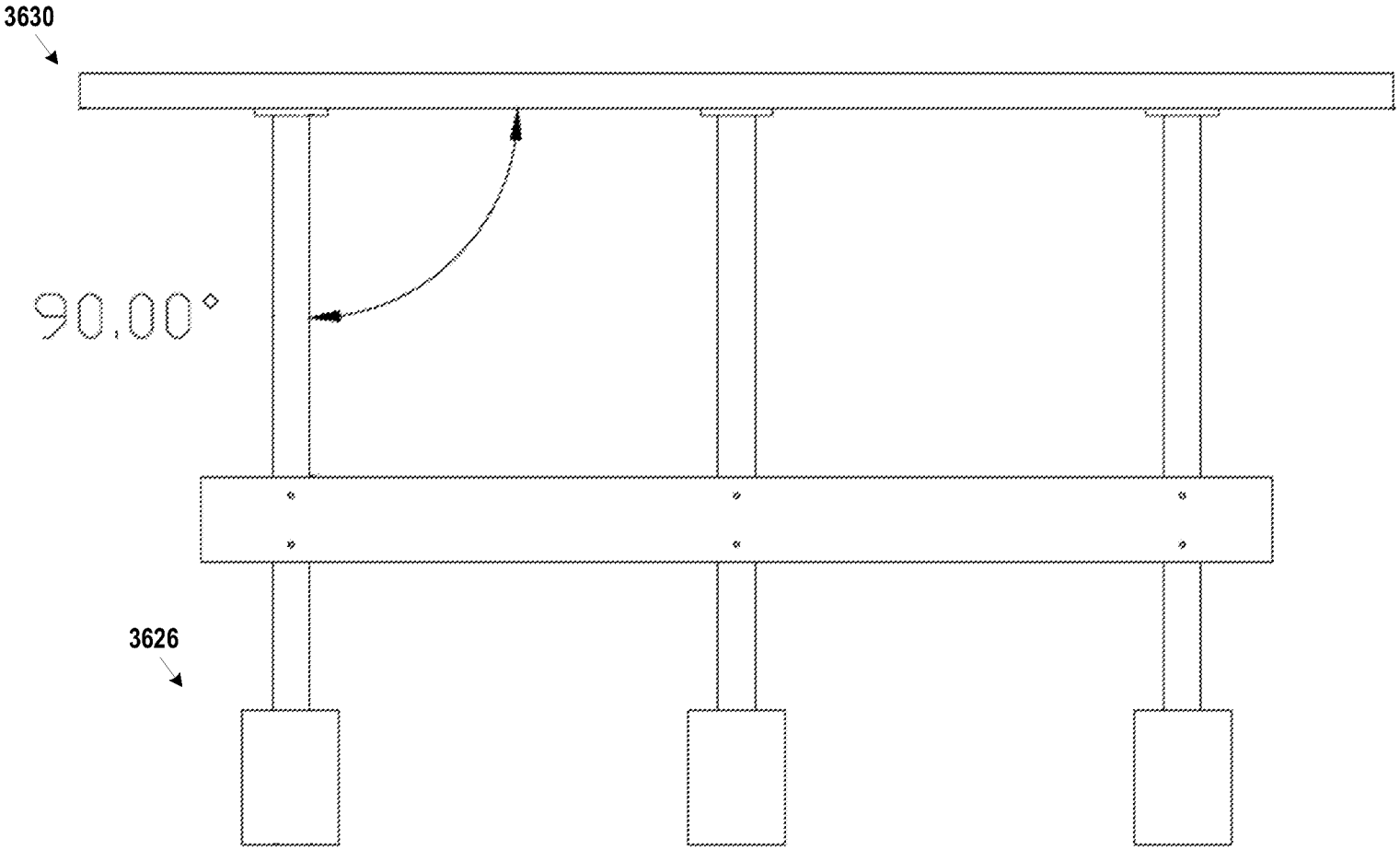
FIG. 36C shows a plan view of a staircase having three stringers and a temporary stringer connector.

At step 3602, the stringers of the staircase 3630 (FIG. 36C) are adjusted to be square in plan view to each other and also square to the upper floor 3620.

At step 3603, a temporary stringer connector (FIG. 36C) is installed near a bottom end 3626 of the staircase 3630 to stiffen the assembly.

Figure 36D:
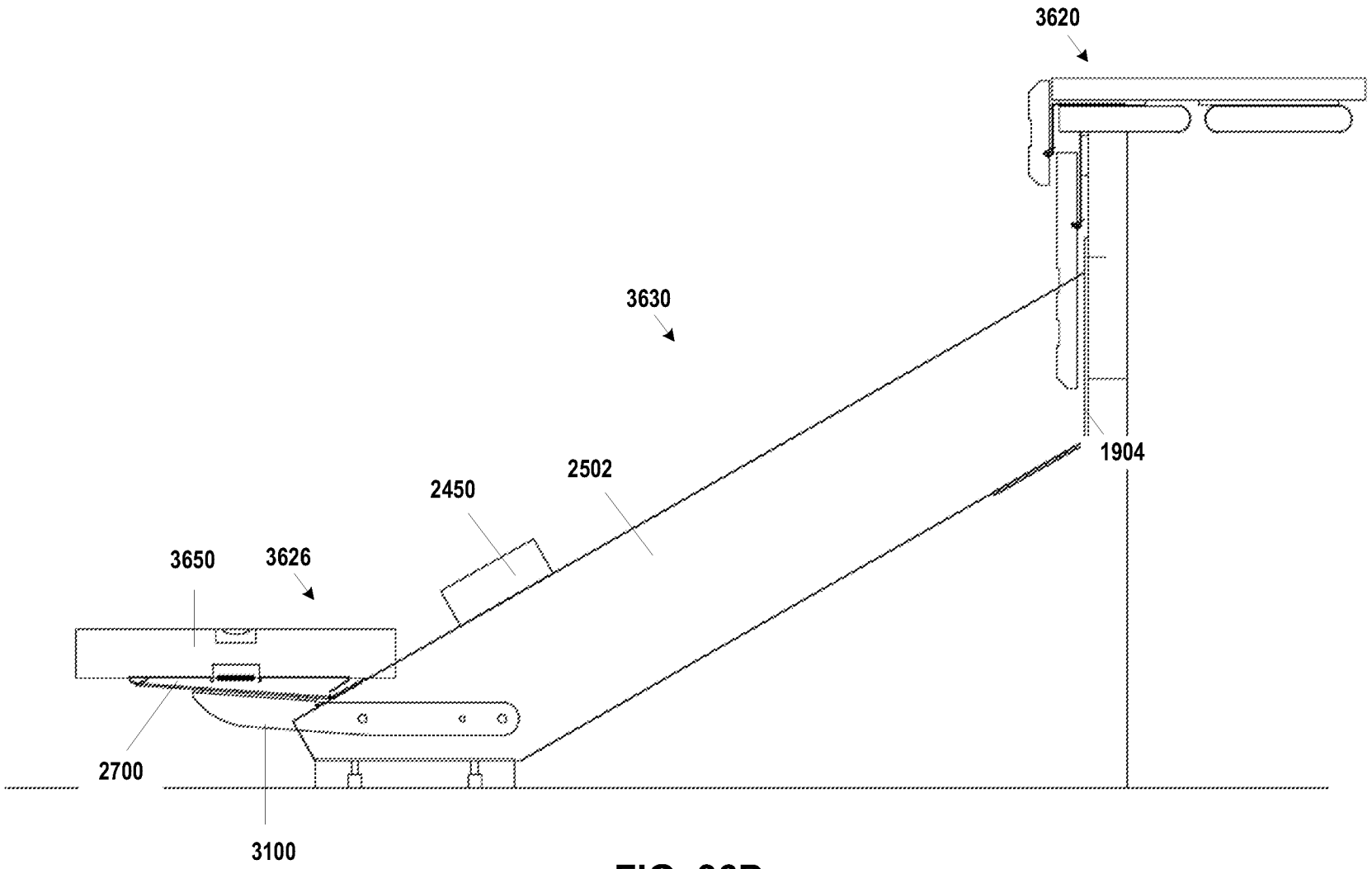
FIG. 36D shows a side view of a base tread bracket being coupled to a stair stringer during the method of constructing a staircase of FIG. 36A.

Steps 3604 and 3605 are shown in FIG. 36D. Specifically, at step 3604, the base (e.g. lowermost) tread bracket 2700 is installed and the base tread support bracket 3100 of the staircase 3630 is attached. At step 3605, base tread bracket 2700 is levelled (e.g. via level 3650) and its support bracket 3100 is attached to stair stringer 2502.

Figure 36E:
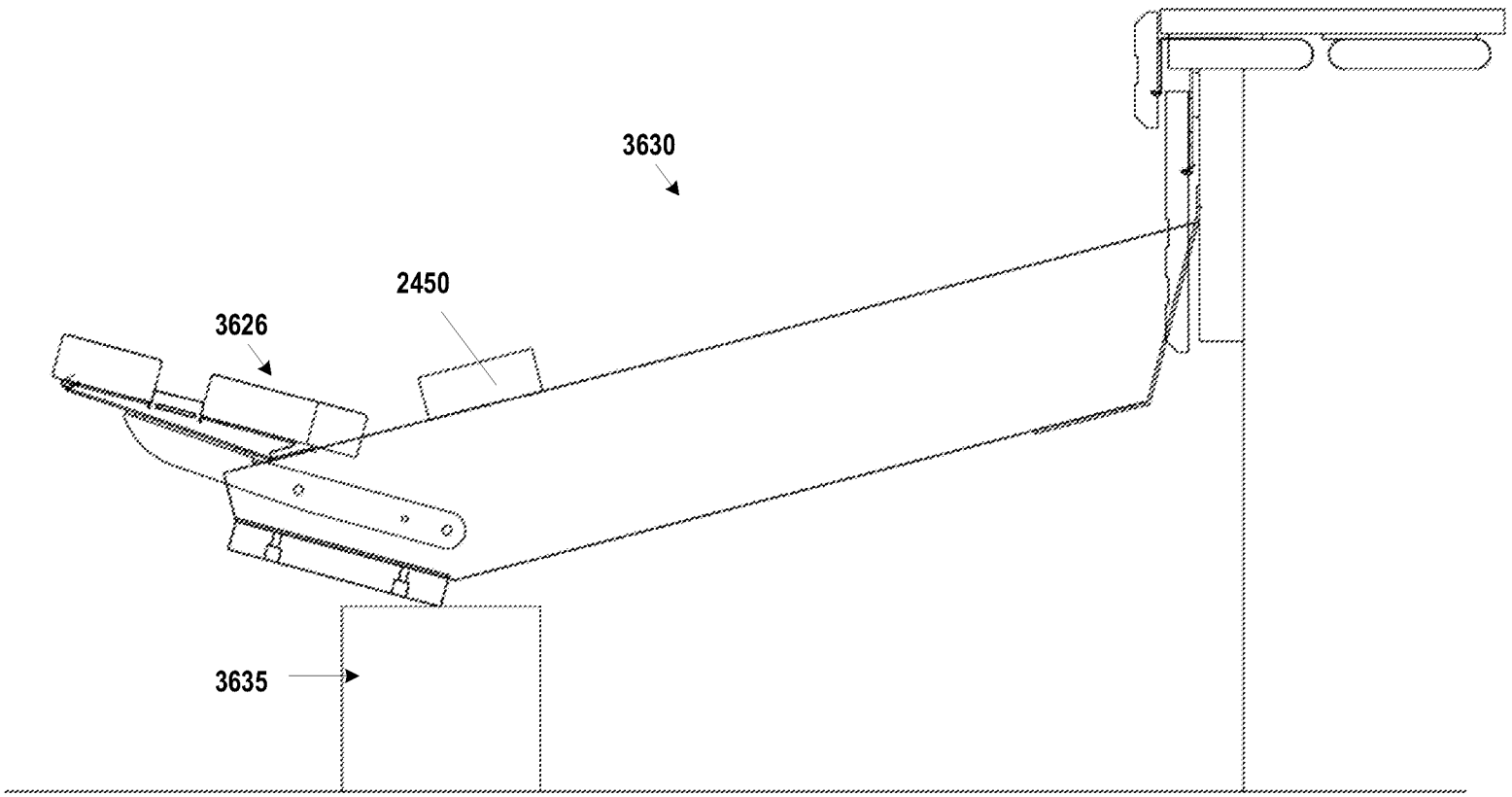
FIG. 36E shows a side view of a stair stringer rotated upwardly off of a lower floor during the method of constructing a staircase of FIG. 36A.

At step 3606, shown in FIG. 36E, the lower end 3626 of the staircase 3630 is rotated/lifted via a bend line of a lateral support hanger bracket (e.g. bend line 2105 of lateral support hanger bracket 2100) and temporarily raised (e.g. about 12 inches) off of the lower floor via a temporary block 3635.

At step 3607, shown in FIG. 36E, a lowermost tread is installed onto the lowermost tread support structure (e.g. with fasteners from an underside).

Figure 36F:
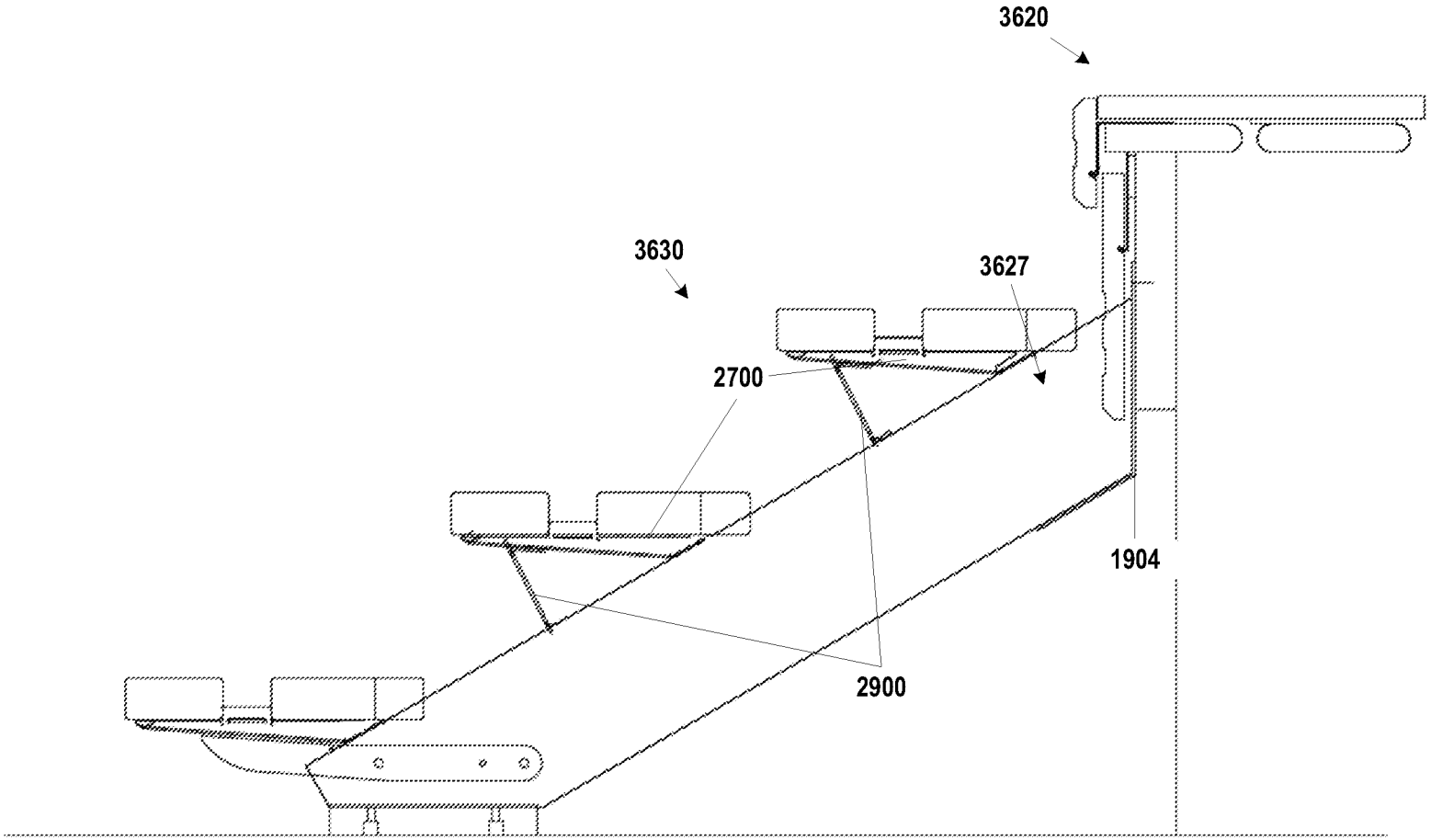
FIG. 36F shows a side view of a stair stringer of a staircase constructed using the method of constructing a staircase of FIG. 36A.

At step 3608, shown in FIG. 36F, the temporary block 3635 is removed and the base of the stair assembly is rotated and lowered back down to the lower floor.

At step 3609, shown in FIG. 36F, a lateral support member of a lateral support hanger bracket is connected between the upper floor 3620 and a top end 3227 of the stringer 2502. At step 3610, the temporary stringer connector is removed and at step 3611 the remaining tread brackets are installed onto the stringer 2502.

At step 3612, illustrated in FIG. 36F, the tread brackets 2700 are levelled and the support brackets 2900 are installed. In some embodiments, levelling the tread brackets includes attaching a first end of the tread bracket 2700 to the stair stringer 2502, bending the tread bracket 2700 upwardly until a top surface of the tread bracket 2700 is level with the lower floor and attaching a support bracket 2900 to the stair stringer 2502 and to the tread bracket 2700 to support the tread bracket 2700 and maintain the top surface of the tread bracket being level with the lower floor and in the correct positioning along the stair stringer 5202.

Figure 36G:
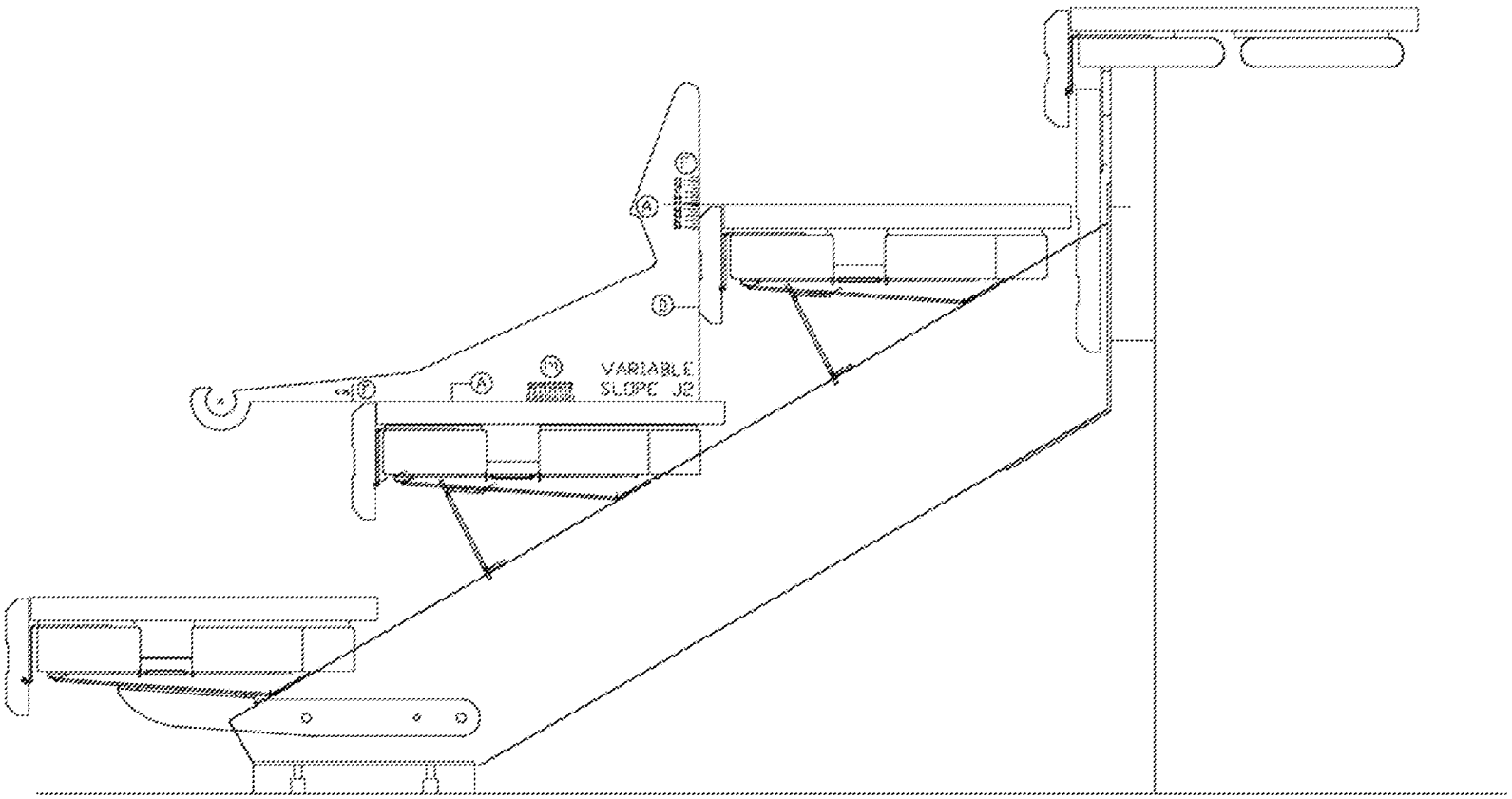
FIG. 36G shows a side view of a stair stringer and a jig being used to confirm the rise and run of each tread of the stair stringer during the method of constructing a staircase of FIG. 36A.

At step 3613, illustrated in FIG. 36G, all treads are installed on the staircase 3630 and at step 3614 all rises and runs are inspected with jig 3300.

Figure 37:
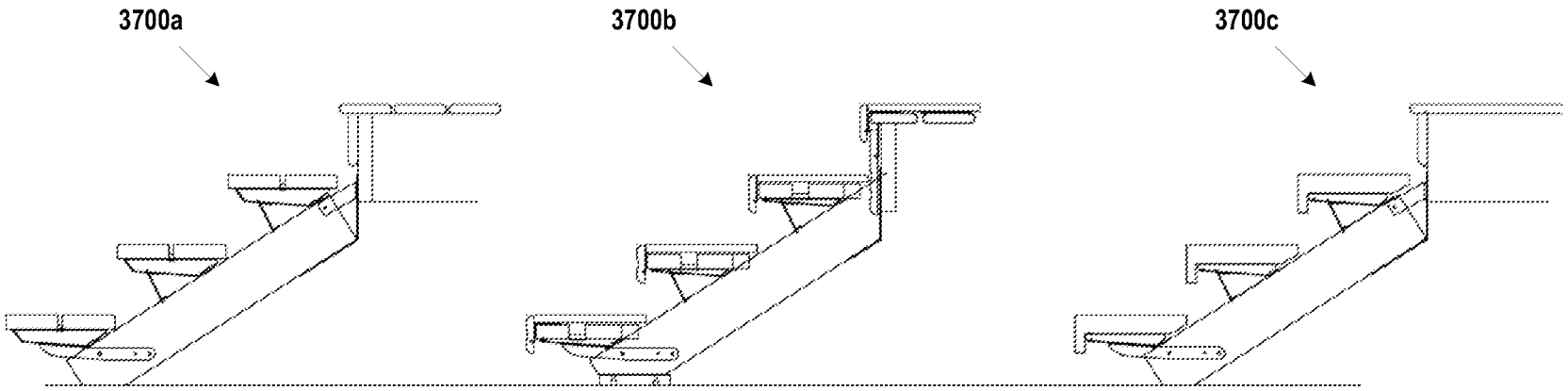
FIG. 37 shows a side view of three staircases, each staircase constructed using the jigs described in FIGS. 32 and 33 and including a tread bracket to facilitate various tread finish options.

FIG. 37 shows side views of three modular staircases 3700*a*, 3700*b* and 3700*c*. Each of the staircases shown in FIG. 37 demonstrates an application of a staircase constructed using the jig(s) and the components described above. For instance, staircase 3700*a* shows an outdoor staircase with pressure-treated lumber used as the treads 375 of the staircase. The staircase 3700*a* is mounted to an upper floor by a hanger bracket with a lateral support member. Conversely, outdoor staircase 3700*b* has a thin tile tread overlaying a wooden substructure and is mounted to the upper floor by a hanger bracket that does not have a lateral support member. Staircase 3700*c* shows an interior staircase in which the treads are solid wood. The staircase 3700*c* is also mounted to an upper floor by a hanger bracket with a lateral support member. Each of the staircases shown in FIG. 37 is code compliant, follows the common comfort rules and is built with the exact same jig set.

Figure 38A:
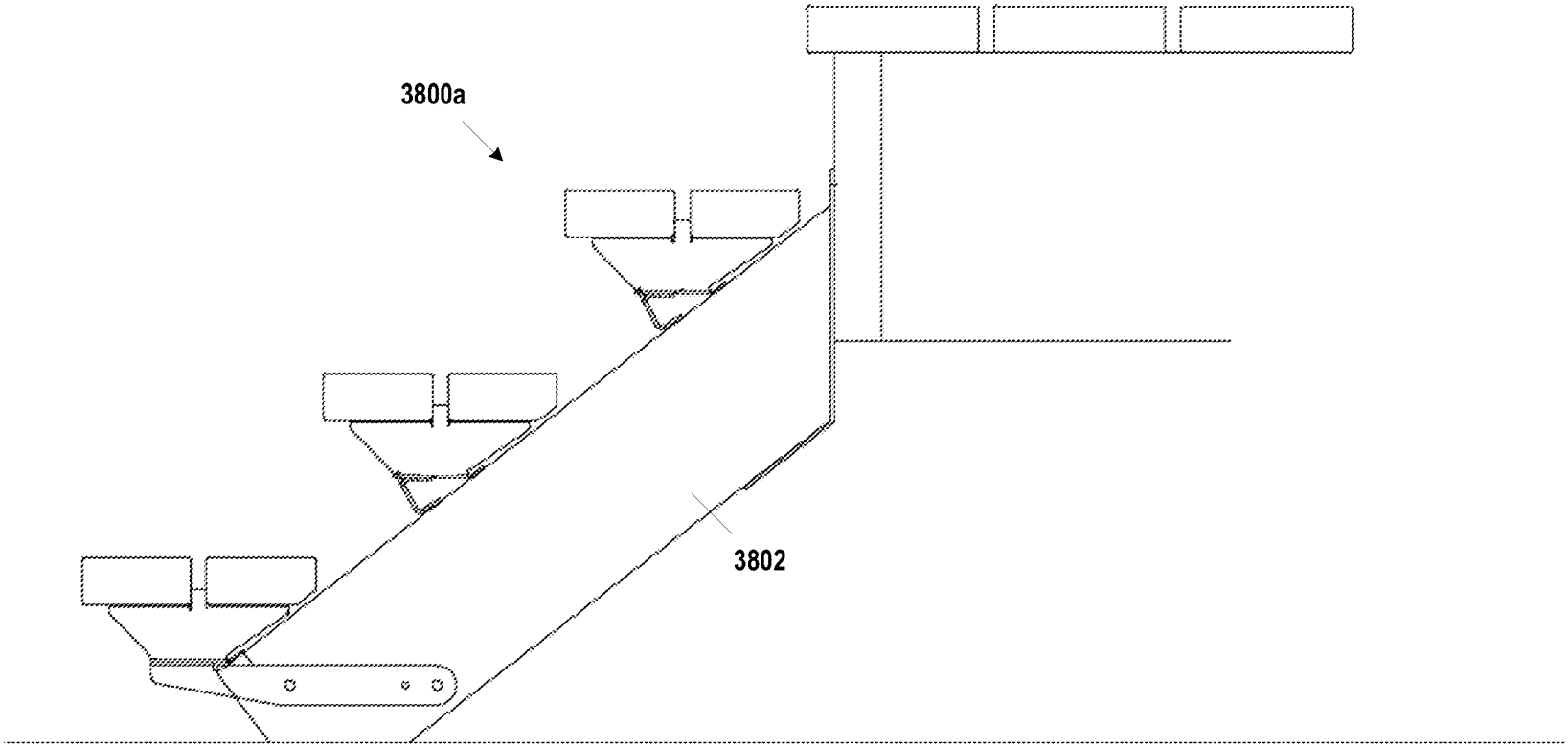
FIGS. 38A and 38B each show a side view of two staircases, each staircase constructed using jigs described herein, the jigs being configured for special purpose applications.
Figure 38B:
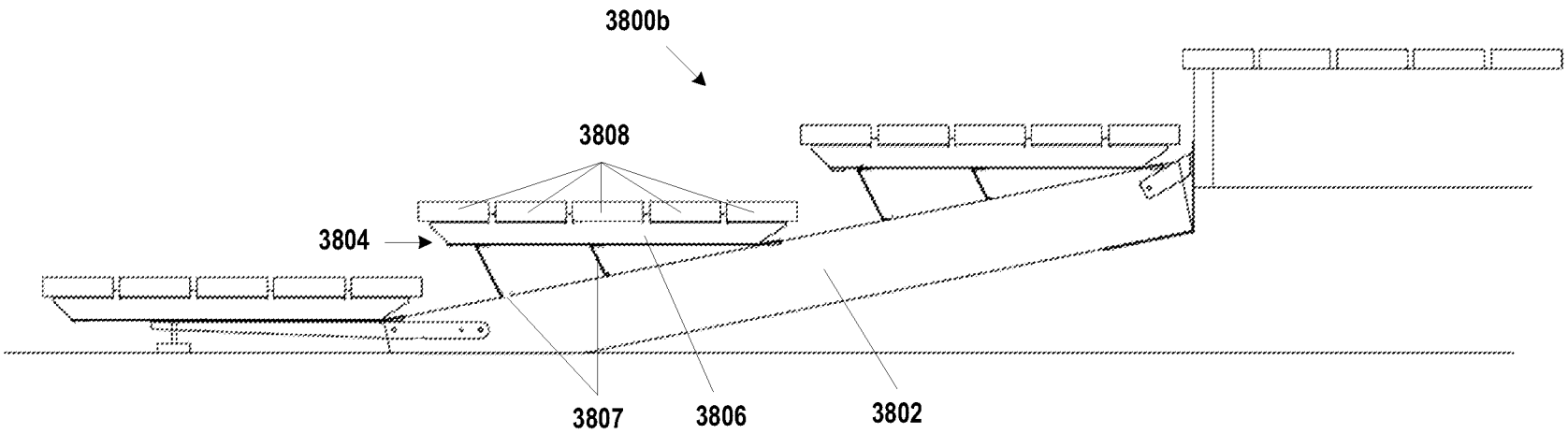

It should be understood that staircases that may be constructed with systems and/or jig sets described herein may include staircases for special applications. For instance, as shown in FIG. 38A, the slope of the stair stringer 3802 of the staircase 3800*a* is very steep. As shown in FIG. 38B, the slope of the stair stringer 3802 of staircase 3800*b* is very shallow. Each of these safe staircases can be constructed using the systems described herein, with minor modifications to the respective jig sets that are within the scope of the embodiments described herein. For instance, to exemplify the versatility of the system and as shown in the staircase 3800*b*, the treads 3808 of the staircase are coupled to the stringer 3802 by tread support structures 3804 including one tread brackets 3806 and two support brackets 3807.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

What is claimed is:

1. A system for constructing a staircase having a plurality of treads, each tread having a predetermined run and a selected rise, the system comprising:
- a hanger bracket configured to couple a stair stringer of the staircase to an upper floor;
- a plurality of tread support structures, each tread support structure configured to couple a tread to the stair stringer; and
- a jig comprising:
  - a first component; and
  - a second component movably coupled to the first component, each of the first component and the second component having at least one scale thereon, each scale having a set of markings, each marking of each set of markings representing a different potential rise of each tread of the staircase, the jig having a first position where:
  - an edge of one of the first component and the second component of the jig identifies a position of a cut line on the stair stringer of the staircase, the cut line identifying a bottom of the stringer that engages the ground, when:
    - the jig is wresting on the stair stringer;
    - the first component and the second component are coupled to each other; and
    - one of the first component and the second component has an indicator pointing to a marking of a first scale of the other component, the marking indicating the selected rise of each tread of the stair stringer of the staircase.

2. The system of claim 1, wherein the jig is further configured to determine a length of the stair stringer and a mounting position of the hanger bracket with respect to an upper floor.

3. The system of claim 1, wherein each of the tread support structures is configured to slidingly engage the stair stringer.

4. The system of claim 1, wherein each of the tread support structures includes a tread bracket configured to adaptively support a respective tread of the plurality of treads on the stair stringer based on the a slope of the stair stringer.

5. The system of claim 4, wherein each of the tread brackets includes a bendable base configured to adaptively support the respective tread on the stair stringer.

6. The system of claim 4, wherein each of the tread support structures further includes a support bracket configured to support a respective tread bracket on the stair stringer.

7. The system of claim 1, wherein the hanger bracket includes a first bending line to provide for the hanger bracket to conform to the a slope of the stair stringer.

8. The system of claim 7, wherein the hanger bracket includes a second bending line to provide for the hanger bracket to bend upwardly to an angle that accommodates installation of hidden fasteners to the lowermost tread support bracket.

9. The system of claim 1, wherein the indicator is on the second component of the jig and the first scale is on the first component of the jig.

10. The system of claim 1, wherein the jig is at the first position when a first edge of the first component is aligned with a first end of the stair stringer and pins of the first component are resting against a top edge of the stair stringer.

11. The system of claim 1, wherein a corresponding marking on another scale of the jig identifies a mounting location of a lowermost tread support bracket of one of the tread support structures on the stair stringer when the jig is at the first position, the corresponding marking indicating the selected rise of each tread of the stair stringer.

12. The system of claim 11, wherein the another scale of the jig is on a second scale of the first component of the jig.

13. A jig for constructing a staircase having a plurality of treads, each tread having a predetermined run and a selected rise, the jig comprising:

a first component; and a second component movably coupled to the first component, each of the first component and the second component having at least one scale thereon, each scale having a set of markings, each marking of each set of markings representing a different potential rise of each tread of the staircase, the jig having a first position where:

an edge of one of the first component and the second component of the jig identifies a position of a cut line on a stair stringer of the staircase, the cut line identifying a bottom of the stringer that engages the ground, when:

the jig is at a first position resting on the stair stringer;

the first component and the second component are coupled to each other; and one of the first component and the second component has an indicator pointing to a marking of a first scale of the other component, the marking indicating the selected rise of each tread of the stair stringer of the staircase.

14. The jig of claim 13, wherein the jig is further configured to determine a length of the stair stringer and a mounting position of a hanger bracket with respect to an upper floor.

15. The jig of claim 13, wherein the indicator is on the second component of the jig and the first scale is on the first component of the jig.

16. The jig of claim 13, wherein the jig is at the first position when a first edge of the first component is aligned with a first end of the stair stringer and pins of the first component are resting against a top edge of the stair stringer.

17. The jig of claim 13, wherein the selected rise is between 4 inches and 8 inches.

18. The jig of claim 13, wherein a corresponding marking on another scale of the jig identifies a mounting location of a lowermost tread support bracket of one of the tread support structures on the stair stringer when the jig is at the first position, the corresponding marking indicating the selected rise of each tread of the stair stringer.

19. The jig of claim 18, wherein the another scale of the jig is a second scale of the first component of the jig.

* * * * *